US005977462A

United States Patent [19]

Wolfson

[11] Patent Number: 5,977,462

[45] Date of Patent: Nov. 2, 1999

[54] INDICATORS FOR A STRINGED MUSICAL INSTRUMENT

[76] Inventor: Aaron William Wolfson, 8456 Allenwood Rd., Los Angeles, Calif. 90046-1003

[21] Appl. No.: 08/808,091

[22] Filed: Feb. 28, 1997

[51] Int. Cl.[6] ..... G10D 1/00; G10D 1/08; G10D 3/06

[52] U.S. Cl. ..... 84/267; 84/293; 84/314 R; 84/477 R

[58] Field of Search ..... 84/267, 293, 314 R, 84/477 R, 478, 646, 722, DIG. 30

[56] References Cited

U.S. PATENT DOCUMENTS 1,095,900 5/1914 Manby ..... 84/314 R
2,792,738 5/1957 Donahue ..... 84/267
3,783,731 1/1974 Pash ..... 84/267 X
3,943,815 3/1976 Gilbert ..... 84/293
5,373,768 12/1994 Sciortino .

*Primary Examiner*—Stanley J. Witkowski
*Attorney, Agent, or Firm*—I. Morely Drucker; Fulwider Patton Lee & Utecht, LLP

[57] ABSTRACT

Indicators for a stringed musical instrument having a fingerboard and strings stretched over the fingerboard. The indicators indicate the pitch produced when the string is pressed down against the fingerboard and plucked or bowed. There may be indicators for some or all of the twelve half steps of a chromatic scale (A; A♯, which is equivalent to B♭; B; C; C♯, which is equivalent to D♭; D; D♯, which is equivalent to E♭; E; F; F♯, which is equivalent to G♭; G; and G♯, which is equivalent to A♭). The indicators may be colored black and white like a piano keyboard. The invention includes a method for making portions of musical instruments having such indicators.

34 Claims, 21 Drawing Sheets

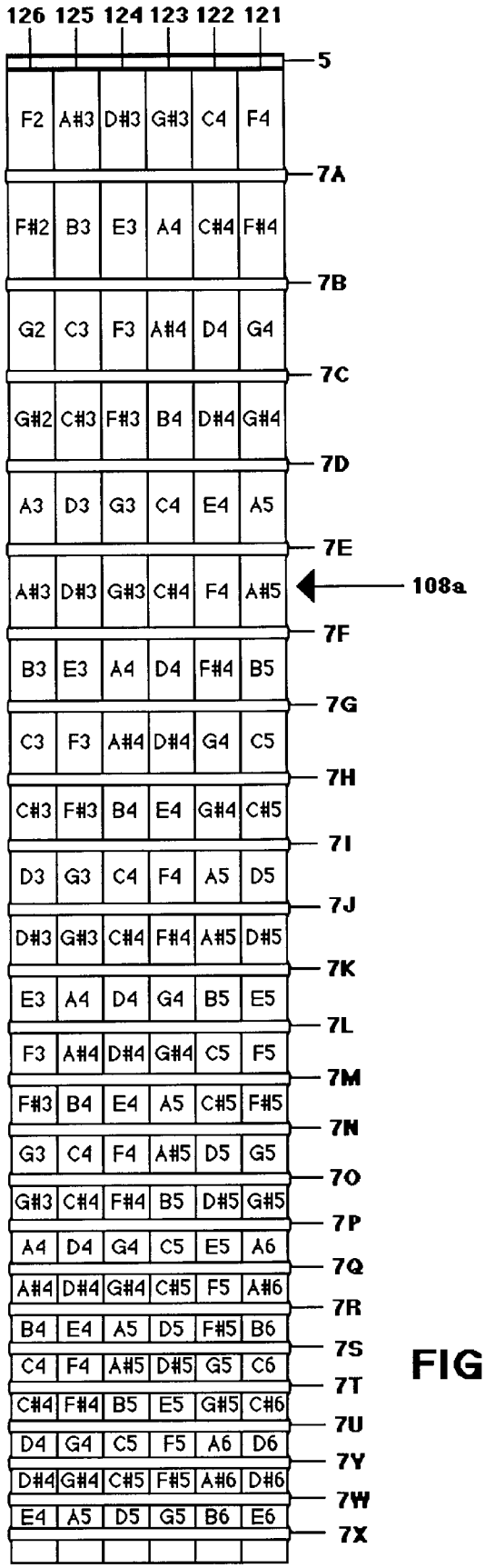
FIG. 6-a

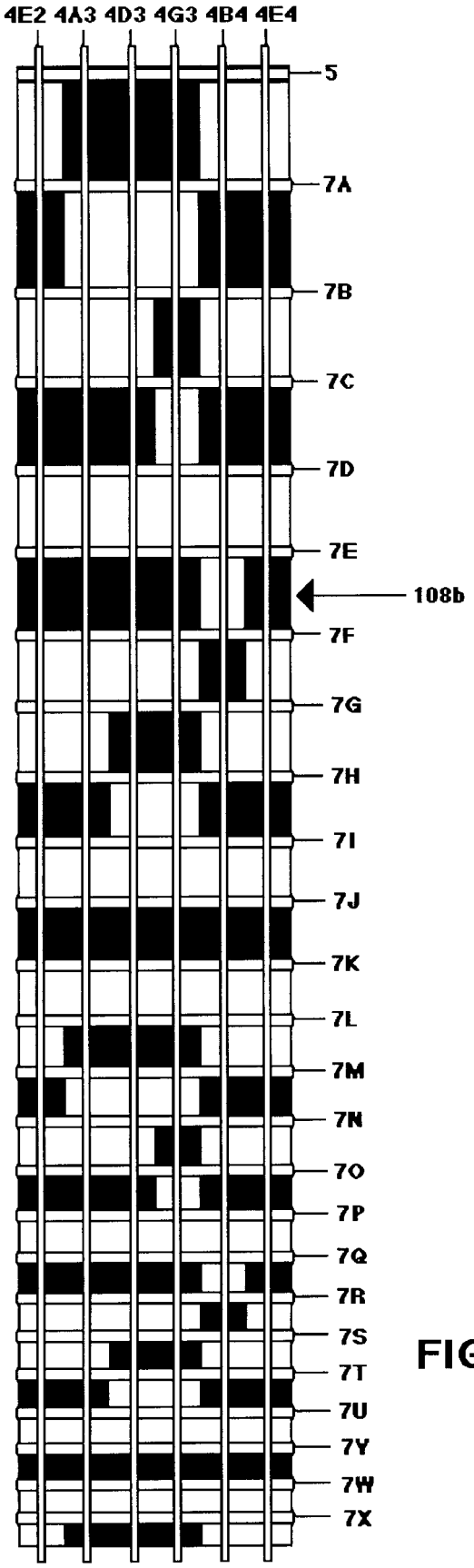
FIG. 6-b

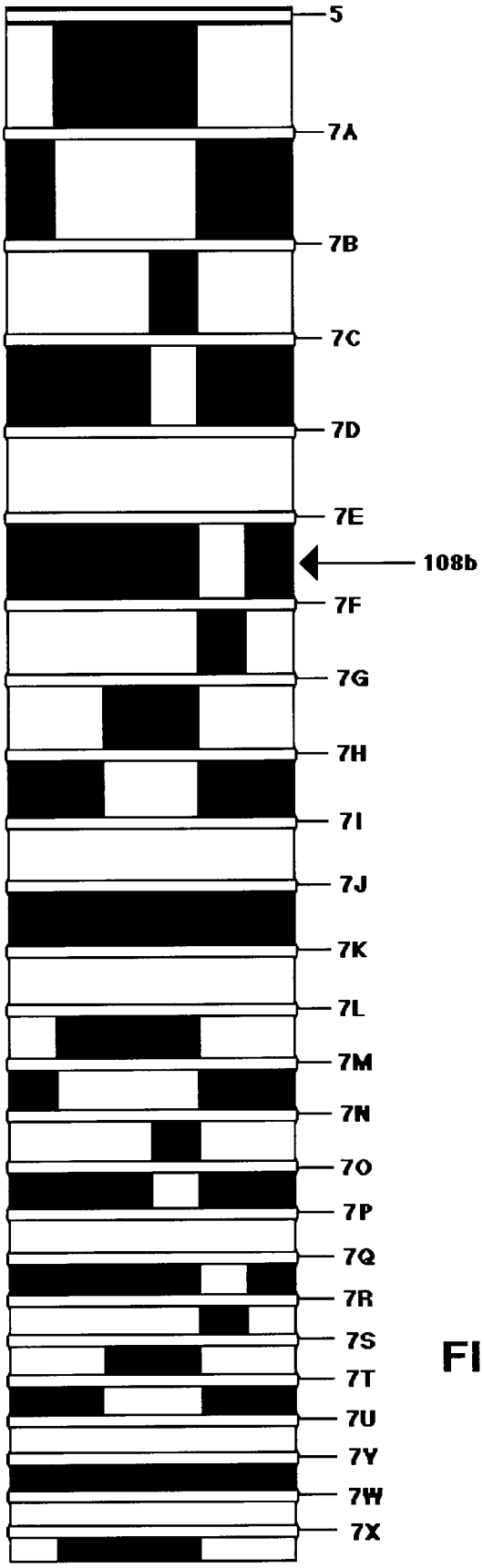
FIG. 6-c

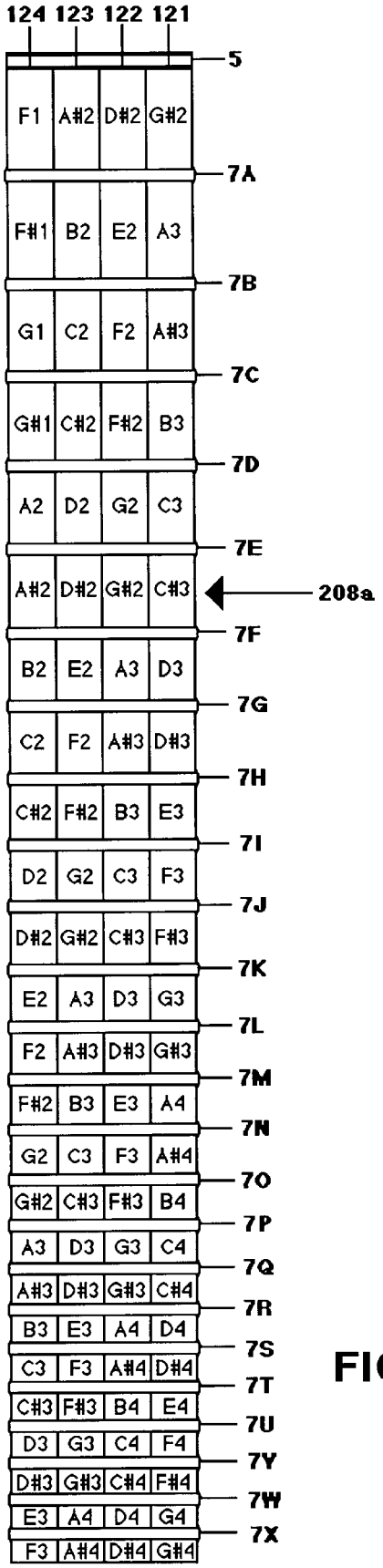
FIG. 7-a

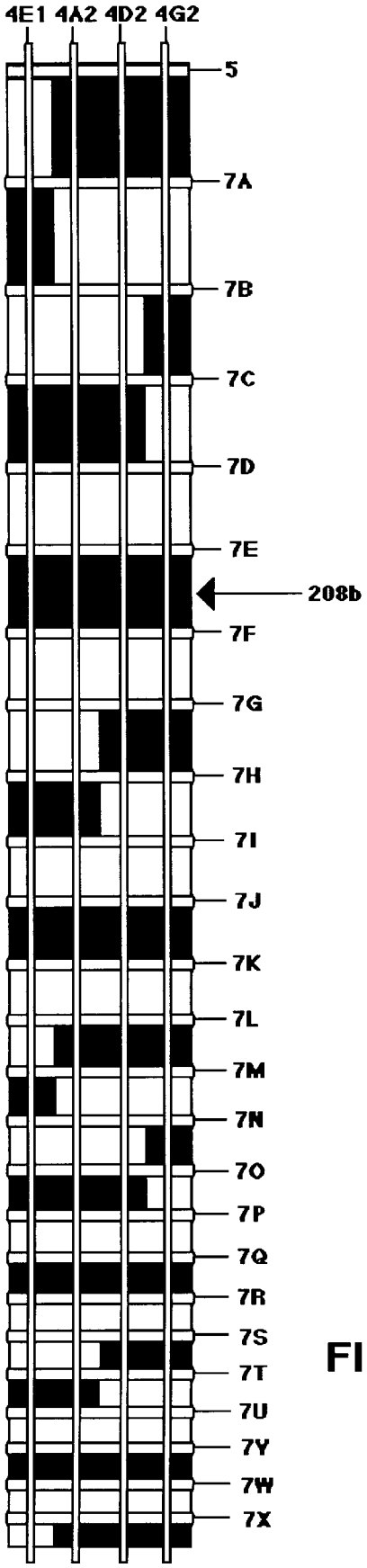
FIG. 7-b

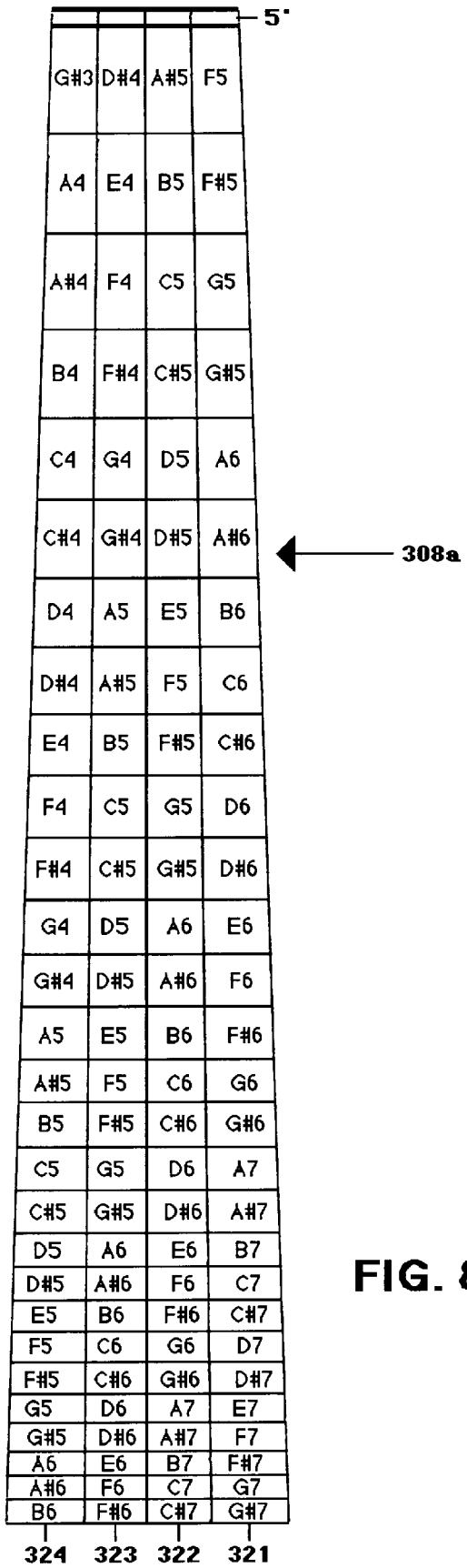
FIG. 8-a

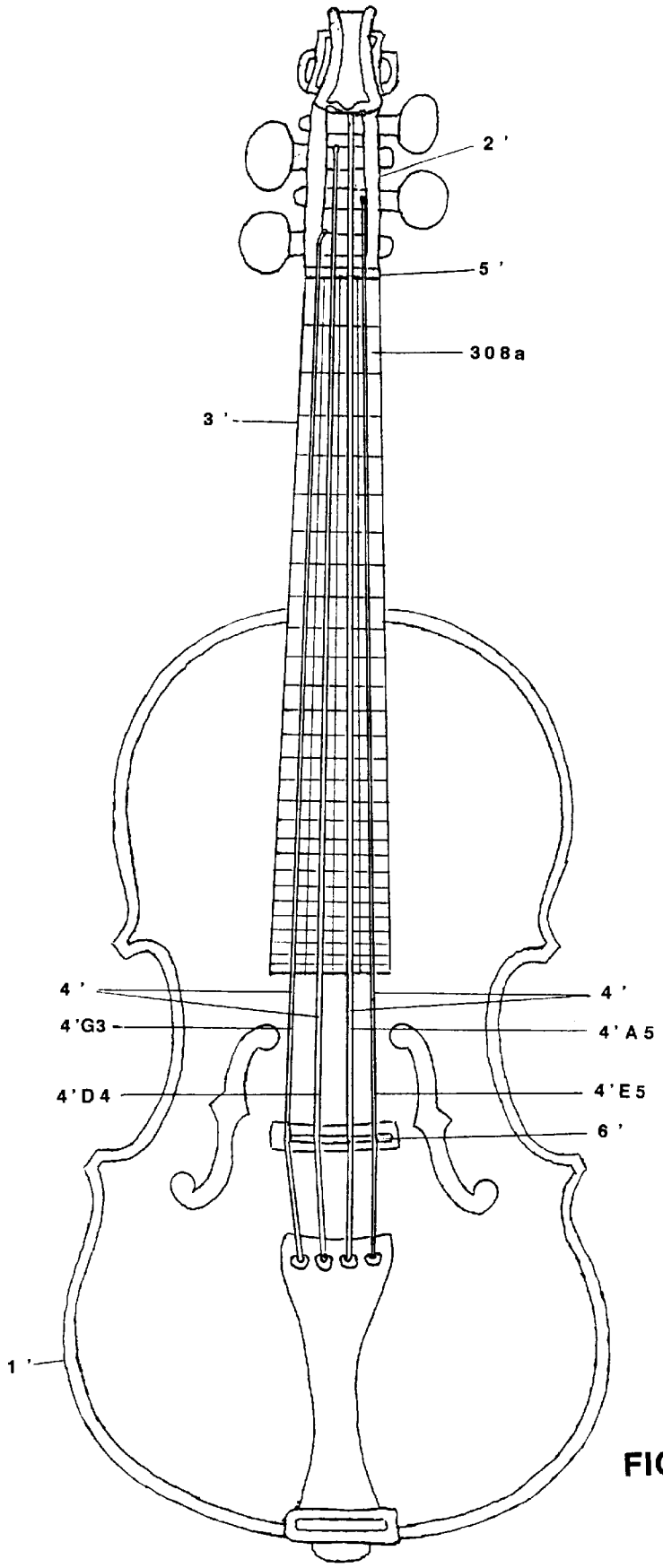
FIG. 8-b

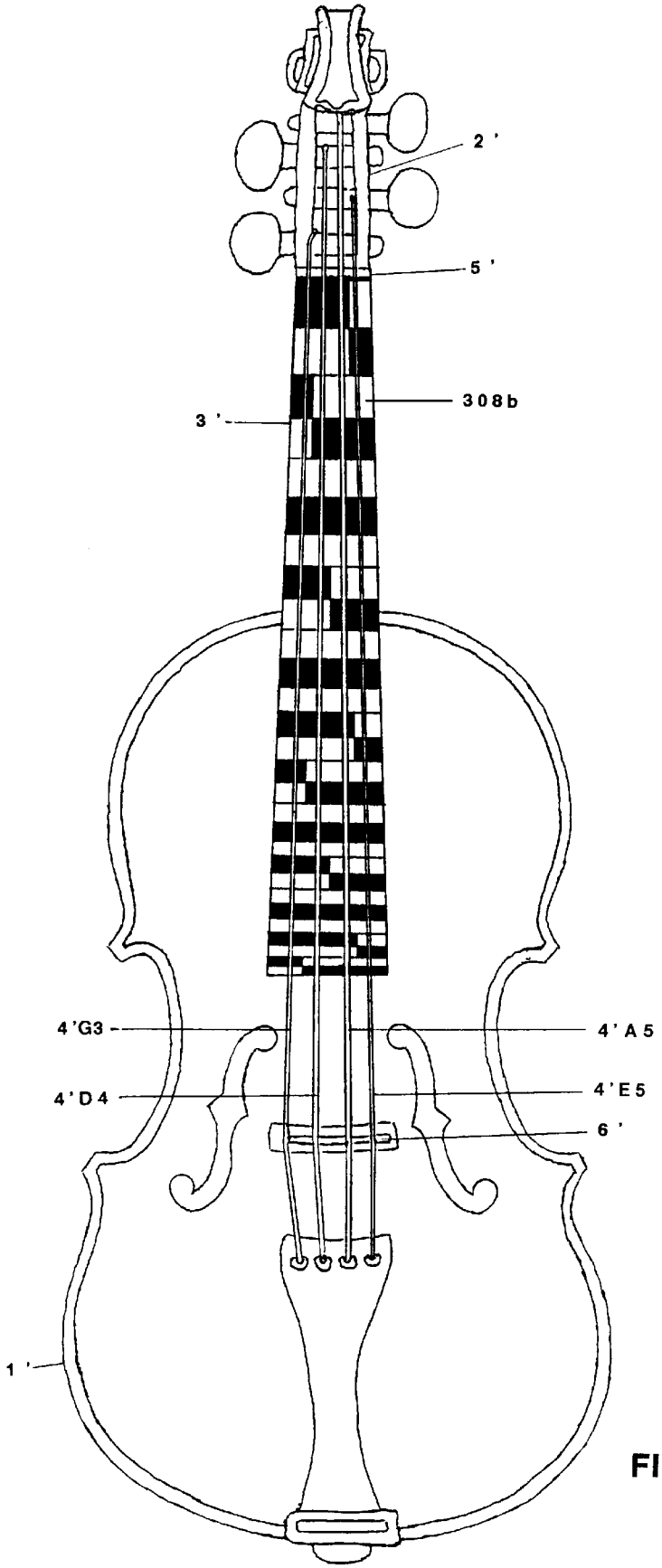
FIG. 8-c

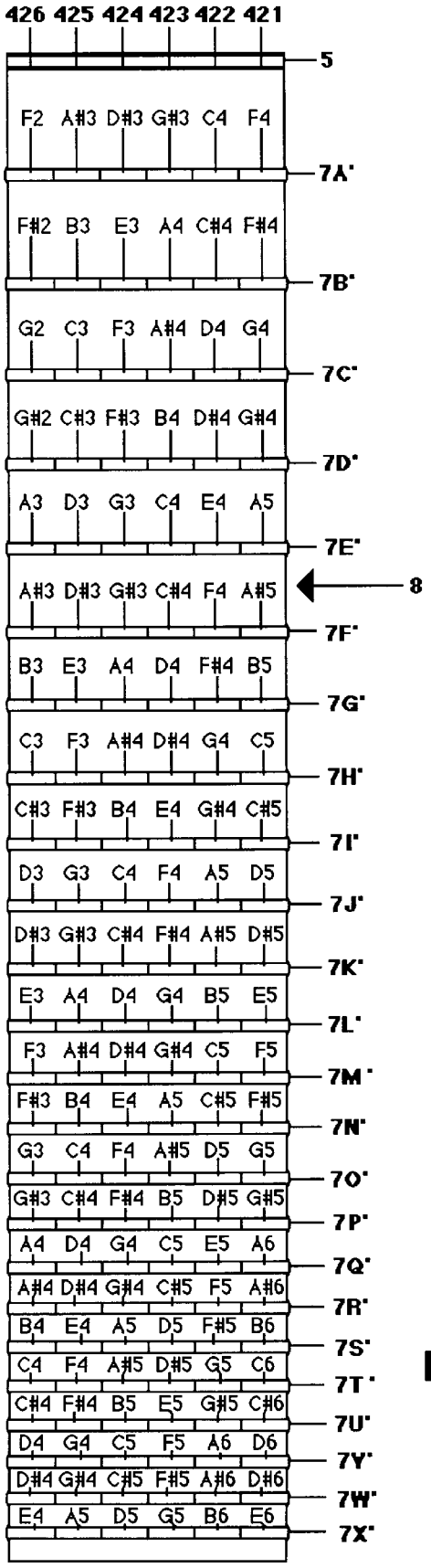
FIG. 9-a

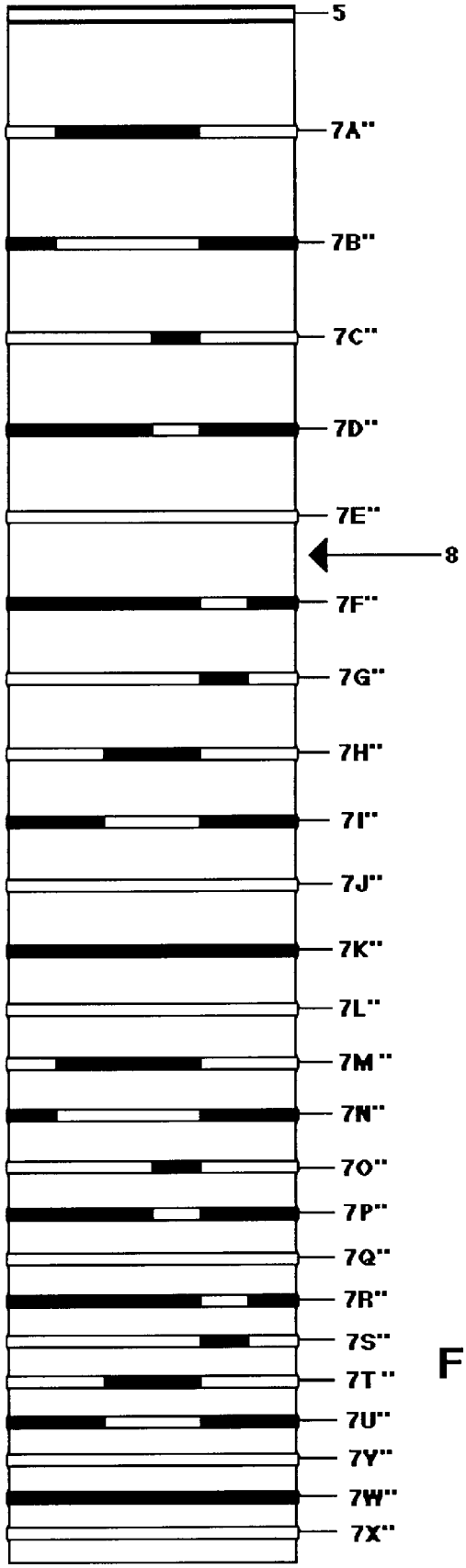
FIG. 9-b

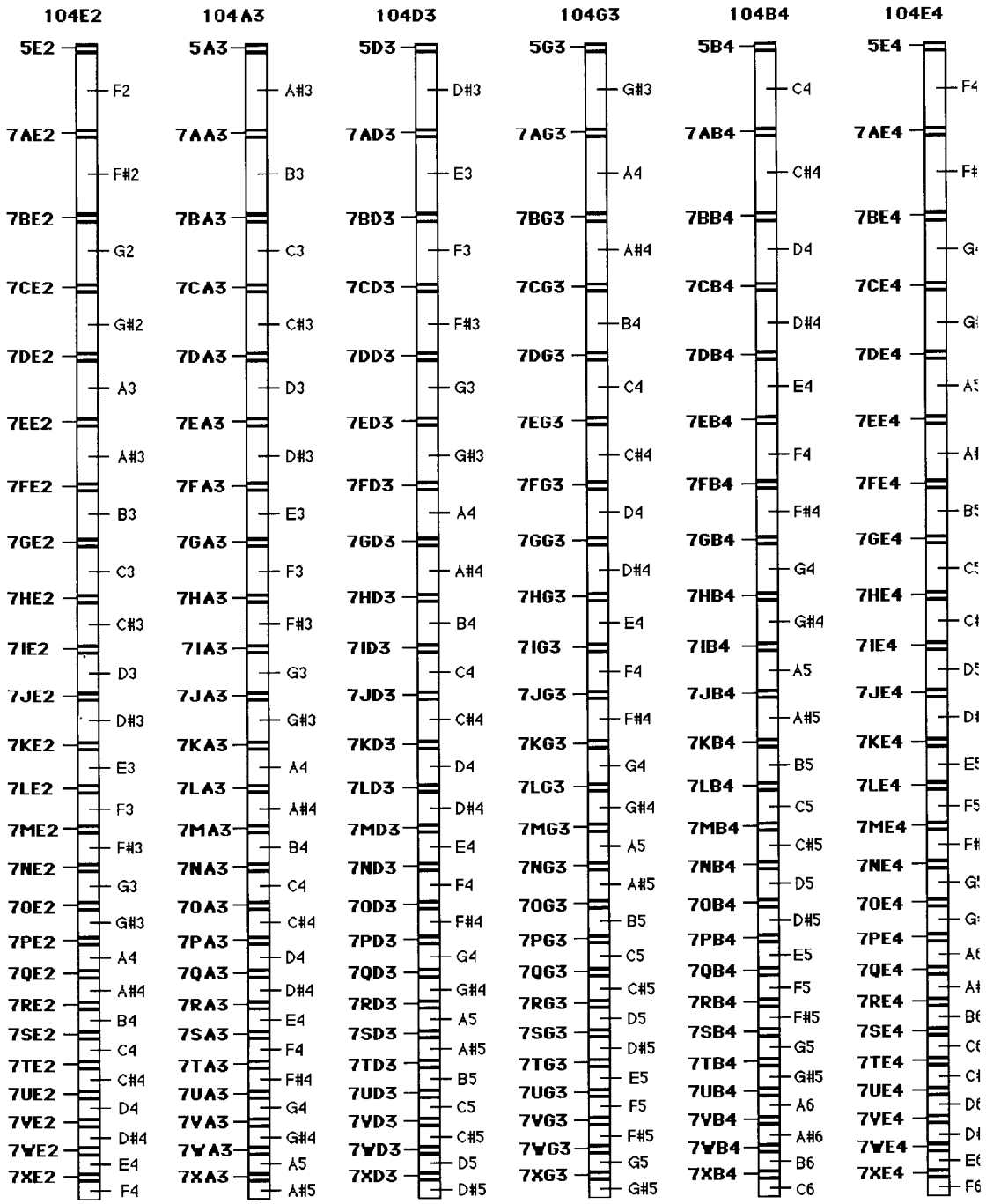
FIG. 10-a

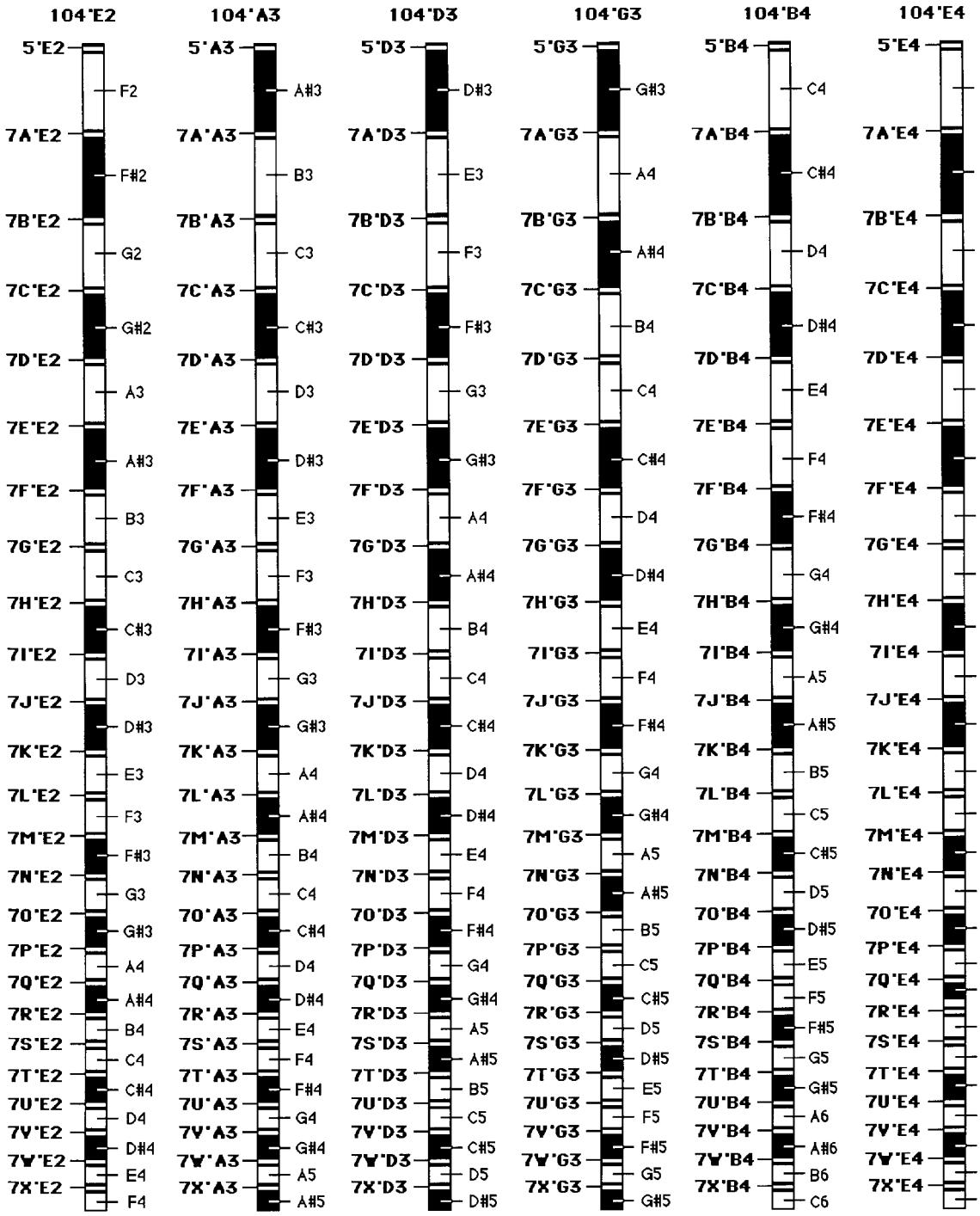
FIG. 10-b

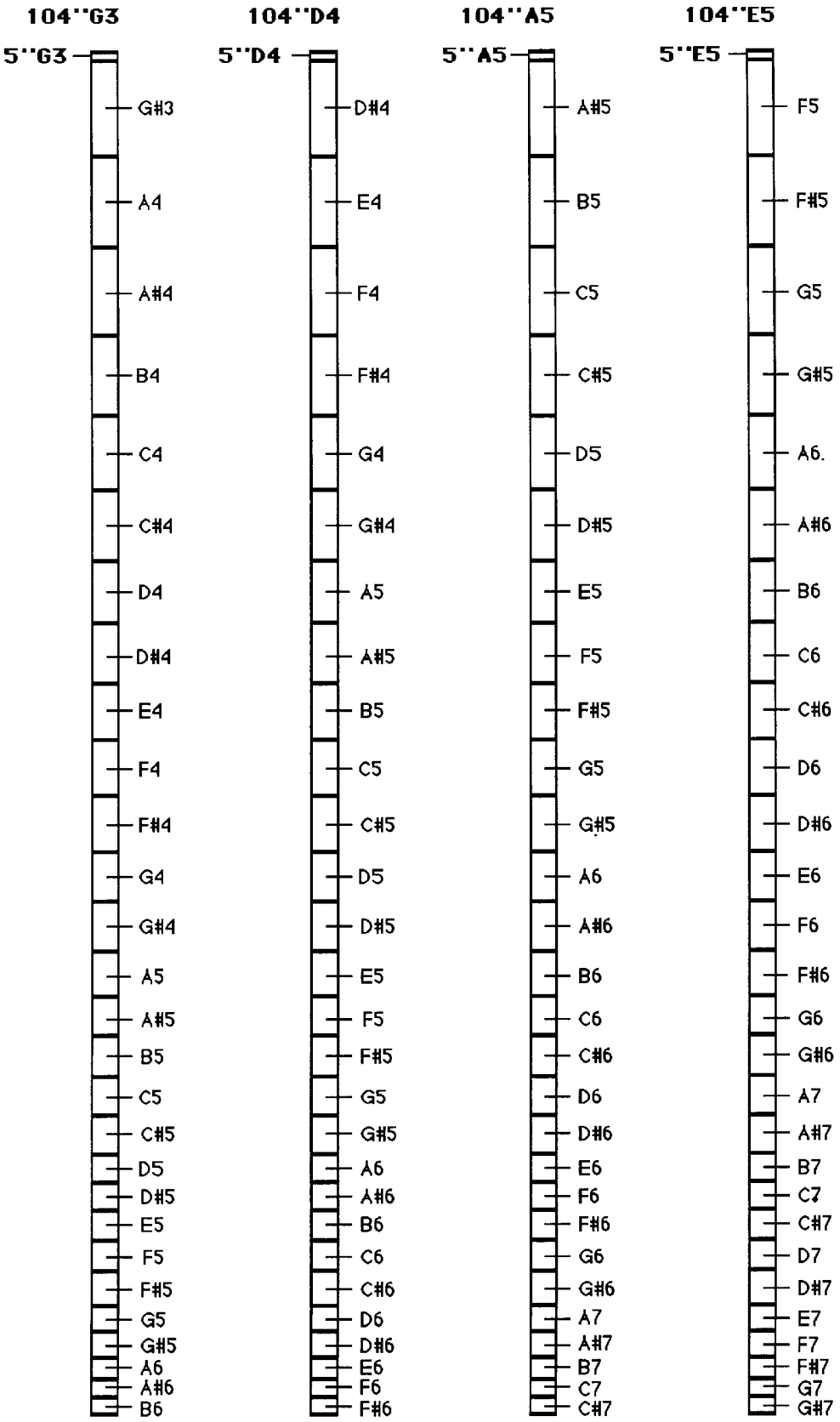
FIG. 11-a

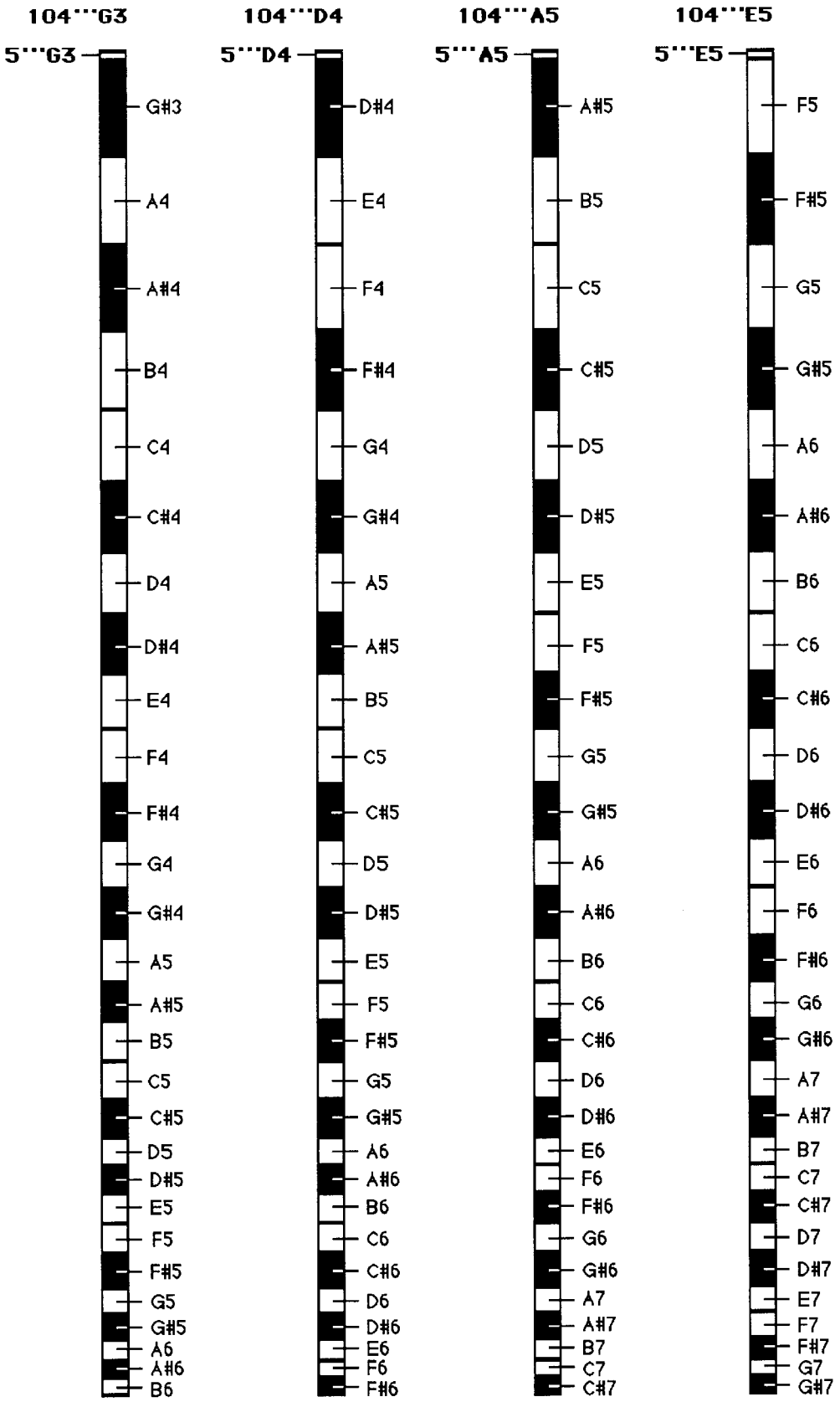
FIG. 11-b

INDICATORS FOR A STRINGED MUSICAL INSTRUMENT

BACKGROUND

Some stringed musical instruments (e.g., violin, viola, cello, and double bass) have no indicators on the fingerboard, the neck, the binding, or the strings to indicate which pitch will be produced if a player plucks a string while holding down a portion of the string against the fingerboard. Fretted stringed instruments (e.g., the guitar) may have dot markings to indicate the fret positions. However, stringed instruments having a fingerboard with strings stretched over the fingerboard do not have indicators on a portion of the instrument to differentiate the twelve notes of a chromatic scale (A; A♯, which is equivalent to B♭; B; C; C♯, which is equivalent to D♭; D; D♯, which is equivalent to E♭; E; F; F♯, which is equivalent to G♭; G; and G♯, which is equivalent to A♭). Furthermore, such stringed instruments lack the demarcations (e.g., the familiar black-and-white pattern) of a piano keyboard.

SUMMARY

The invention includes indicators for a portion of a fretted or unfretted stringed musical instrument having a fingerboard and one or more strings stretched above the fingerboard. The indicators comprise: (1) one first indicator for one string or more than one first indicator for one or more strings, each first indicator being associated with one string, each first indicator indicating where the associated string should be held down against the fingerboard to produce the pitch A when the string is plucked or bowed; (2) one second indicator for one string or more than one second indicator for one or more strings, each second indicator being associated with one string, each second indicator indicating where the associated string should be held down against the fingerboard to produce the pitch A♯ when the string is plucked or bowed; (3) one third indicator for one string or more than one third indicator for one or more strings, each third indicator being associated with one string, each third indicator indicating where the associated string should be held down against the fingerboard to produce the pitch B when the string is plucked or bowed; (4) one fourth indicator for one string or more than one fourth indicator for one or more strings, each fourth indicator being associated with one string, each fourth indicator indicating where the associated string should be held down against the fingerboard to produce the pitch C when the string is plucked or bowed; (5) one fifth indicator for one string or more than one fifth indicator for one or more strings, each fifth indicator being associated with one string, each fifth indicator indicating where the associated string should be held down against the fingerboard to produce the pitch C♯ when the string is plucked or bowed; (6) one sixth indicator for one string or more than one sixth indicator for one or more strings, each sixth indicator being associated with one string, each sixth indicator indicating where the associated string should be held down against the fingerboard to produce the pitch D when the string is plucked or bowed; (7) one seventh indicator for one string or more than one seventh indicator for one or more strings, each seventh indicator being associated with one string, each seventh indicator indicating where the associated string should be held down against the fingerboard to produce the pitch D♯ when the string is plucked or bowed; (8) one eighth indicator for one string or more than one eighth indicator for one or more strings, each eighth indicator being associated with one string, each eighth indicator indicating where the associated string should be held down against the fingerboard to produce the pitch E when the string is plucked or bowed; (9) one ninth indicator for one string or more than one ninth indicator for one or more strings, each ninth indicator being associated with one string, each ninth indicator indicating where the associated string should be held down against the fingerboard to produce the pitch F when the string is plucked or bowed; (10) one tenth indicator for one string or more than one tenth indicator for one or more strings, each tenth indicator being associated with one string, each tenth indicator indicating where the associated string should be held down against the fingerboard to produce the pitch F♯ when the string is plucked or bowed; (11) one eleventh indicator for one string or more than one eleventh indicator for one or more strings, each eleventh indicator being associated with one string, each eleventh indicator indicating where the associated string should be held down against the fingerboard to produce the pitch G when the string is plucked or bowed; and (12) one twelfth indicator for one string or more than one twelfth indicator for one or more strings, each twelfth indicator being associated with one string, each twelfth indicator indicating where the associated string should be held down against the fingerboard to produce the pitch G♯. The indicators may be decals, paint, or tiles.

The features, aspects, and advantages of the present invention will become better understood with regard to the following description, appended claims, and accompanying drawings. All of this is presented by way of example only and not limitation, obvious modifications being understood to be a portion of this document.

BRIEF DESCRIPTION OF THE DRAWINGS

FIG. 6*a* is a top plan view of the fingerboard of the present invention, the nut, and the twenty-four frets of a six-string guitar.

FIG. 6*b* is a top plan view of the another embodiment of the guitar fingerboard of the present invention with twenty-four frets and six strings stretched over the fingerboard.

FIG. 6*c* shows a top plan view of the guitar fingerboard of the present invention without the six strings.

FIG. 7*a* is a top plan view of the fingerboard of the present invention, the nut, and the twenty-four frets of a four-string bass guitar.

FIG. 7*b* shows a top plan view of another embodiment of the bass-guitar fingerboard of the present invention with the four strings.

FIG. 8*a* is a top plan view of the fingerboard of the present invention for a violin.

FIG. 8*b* is a top plan view of a violin incorporating the fingerboard from FIG. 8*a*.

FIG. 8*c* shows a top plan view of a violin with another embodiment of the fingerboard of the present invention.

FIG. 9*a* shows a top plan view of the frets of the present invention and the fingerboard for a six-string guitar.

FIG. 9*b* shows a top plan view of the another embodiment of the frets of the present invention for a six-string guitar.

FIG. 10*a* shows a top plan view of the strings of the present invention for a six-string guitar.

FIG. 10*b* shows a top plan view of another embodiment of the strings of the present invention for a six-string guitar.

FIG. 11*a* shows a top plan view of the strings of the present invention for a violin.

FIG. 11*b* shows a top plan view of another embodiment of the strings of the present invention for a violin.

DETAILED DESCRIPTION

Figure 1:
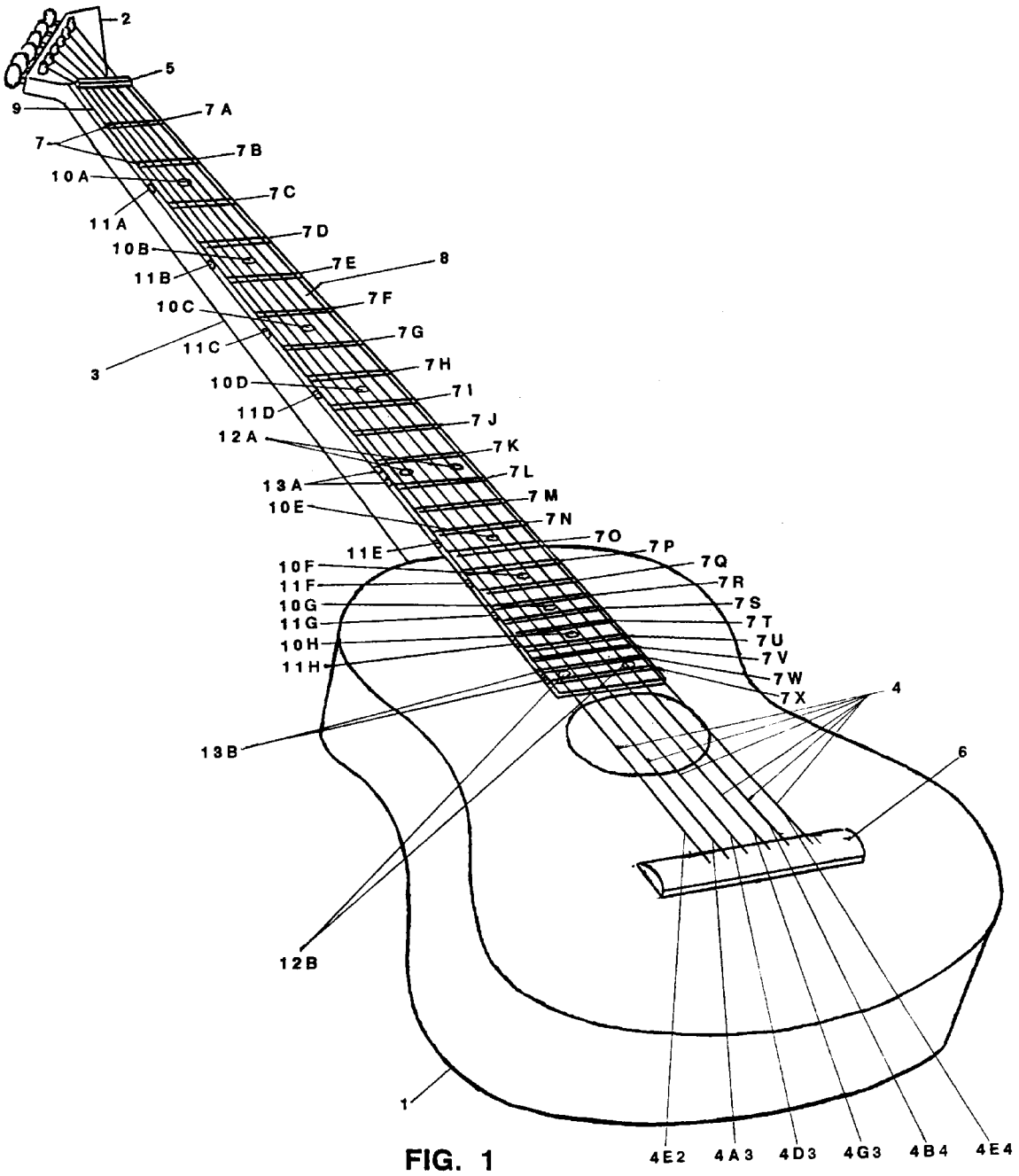
FIG. 1 PRIOR ART
FIG. 1 shows a perspective view of a standard guitar.
Figure 2:
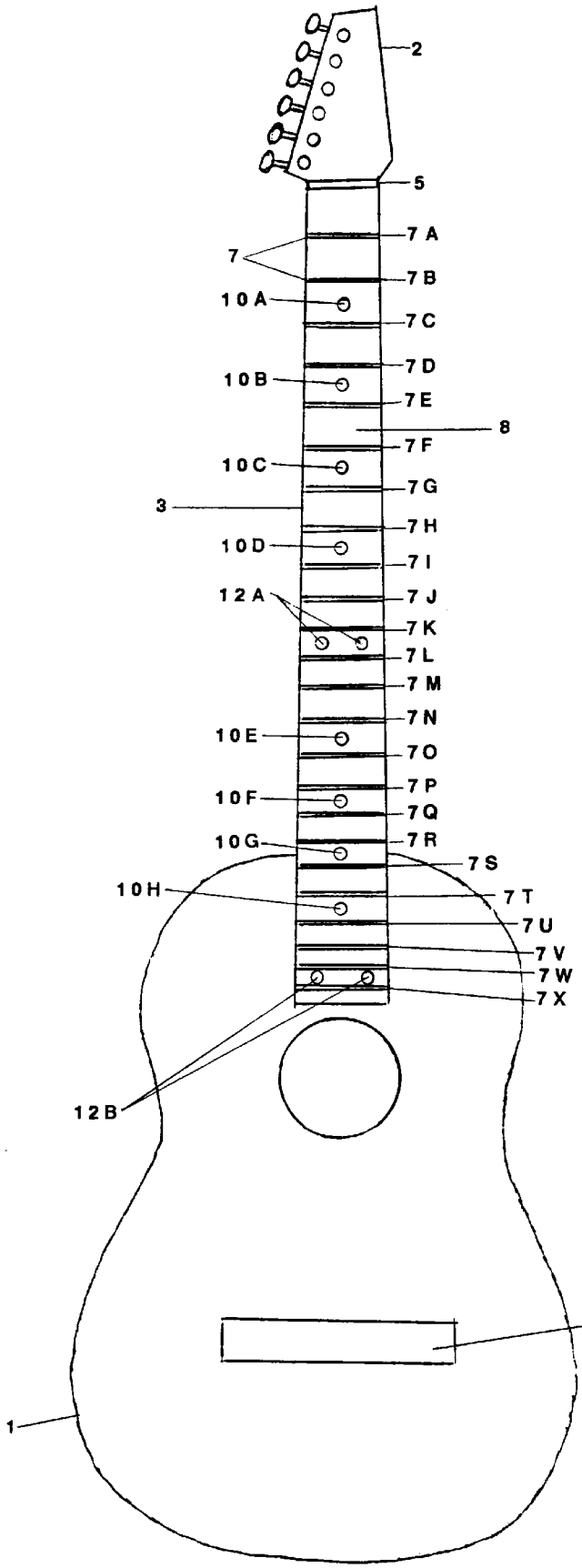
FIG. 2 PRIOR ART
FIG. 2 shows a top plan view of a standard guitar with the strings omitted.
Figure 3:
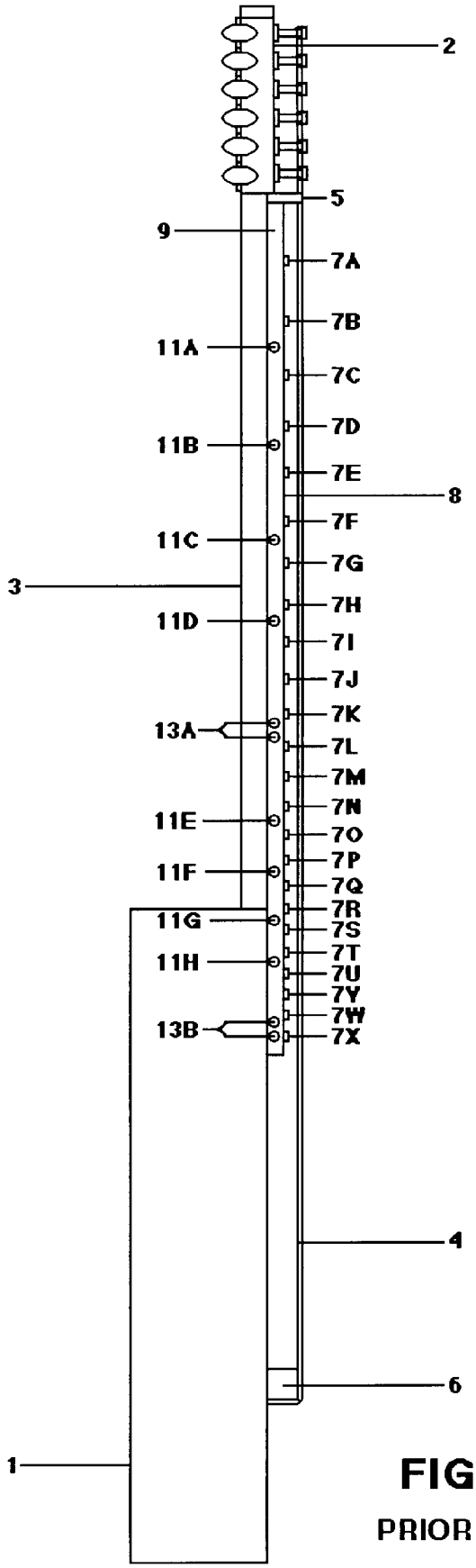
FIG. 3 PRIOR ART
FIG. 3 shows a side view of a standard guitar.
Figure 4:
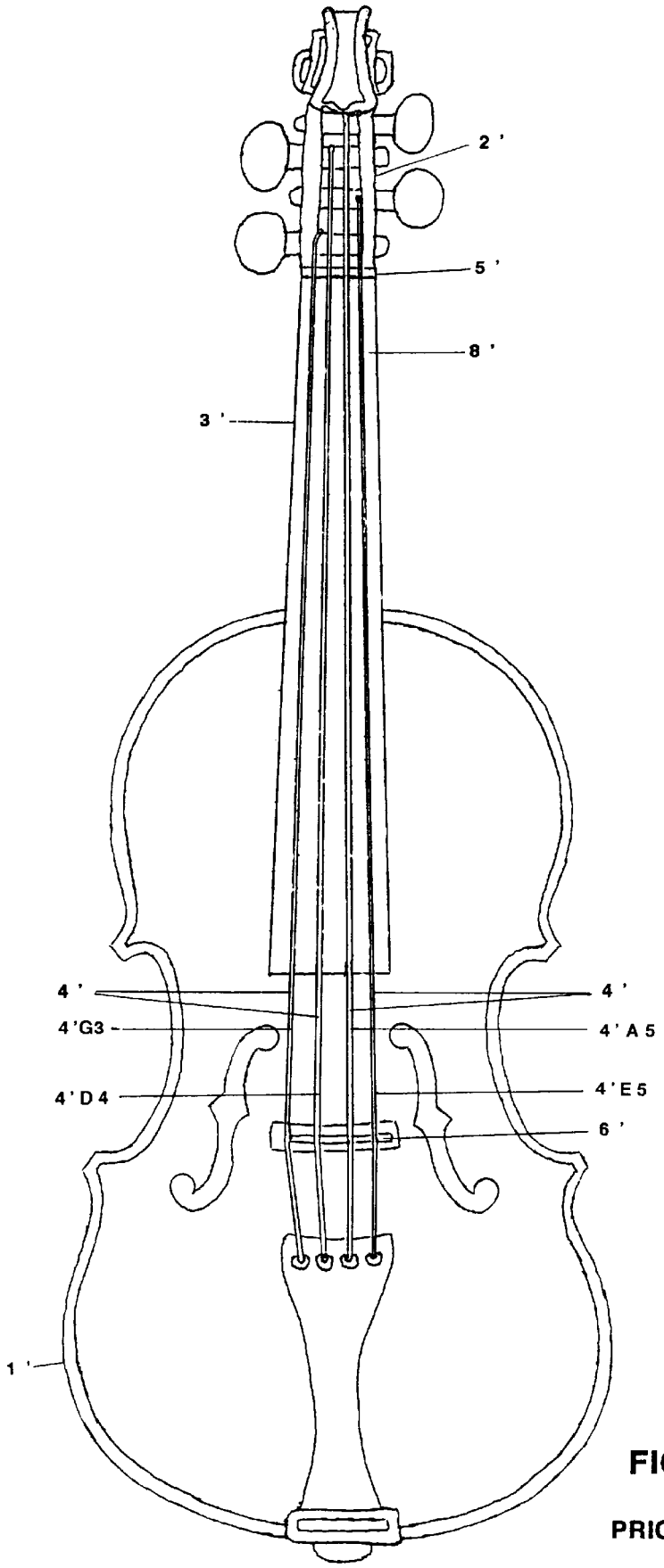
FIG. 4 PRIOR ART
FIG. 4 shows a top plan view of a standard violin.

Stringed musical instruments may be divided into two categories: (1) instruments such as a guitar, a bass guitar, a violin, a viola, a cello, a double bass, a banjo, a dobro, a lute, a mandolin, and a ukulele, where the player touches the strings directly; and (2) instruments such as a piano, a pianoforte, a fortepiano, and a harpsichord, where the player does not touch the strings directly. Examples of two instruments from the first category are shown in FIGS. 1–4. FIG. 1 shows a perspective view of a standard guitar; FIG. 2 shows a top plan view of a standard guitar with the strings omitted; FIG. 3 shows a side view of a standard guitar; and FIG. 4 shows a top plan view of a standard violin.

Instruments from the first category generally may comprise a body 1 (FIGS. 1–3) or 1' (FIG. 4); a head 2 (FIGS. 1–3) or 2' (FIG. 4); a neck 3 (FIGS. 1–3) or 3' (FIG. 4) connecting the head 2 or 2' and the body 1 or 1'; and strings 4 (FIGS. 1–3) or 4' (FIG. 4) connected to the head 2 or 2' and to the body 1 or 1'. The top side of the neck 3 or 3' comprises a fingerboard 8 (FIGS. 1–3) or 8' (FIG. 4). A nut 5 (FIGS. 1–3) or 5' (FIG. 4) engages the strings 4 or 4' and is located on the neck 3 or 3', immediately adjacent to the head 2 or 2'. A bridge 6 (FIGS. 1–3) or 6' (FIG. 4) engages the strings 4 or 4' and is located on the body 1 or 1'. The strings 4 or 4' stretch from the head 2 or 2' to the body 1 or 1' and engage the nut 5 or 5' and the bridge 6 or 6' without engaging anything between the nut 5 or 5' and the bridge 6 or 6'.

Instruments from the first category may be divided into two classes: (1) fretted instruments such as a guitar, a bass guitar, a banjo, a dobro, a lute, a mandolin, and a ukulele; and (2) unfretted instruments such as a violin, a viola, a cello, and a double bass. Fretted instruments have frets 7 on their necks 3, the tops of the frets 7 being raised above the fingerboard 8, as illustrated in FIGS. 1–3. For example, the standard guitar shown in FIGS. 1–3 has 24 frets: a first fret 7A, a second fret 7B, a third fret 7C, a fourth fret 7D, a fifth fret 7E, a sixth fret 7F, a seventh fret 7G, and eighth fret 7H, a ninth fret 7I, a tenth fret 7J, an eleventh fret 7K, a twelfth fret 7L, a thirteenth fret 7M, a fourteenth fret 7N, a fifteenth fret 7O, a sixteenth fret 7P, a seventeenth fret 7Q, an eighteenth fret 7R, a nineteenth fret 7S, a twentieth fret 7T, a twenty-first fret 7U, a twenty-second fret 7V, a twenty-third fret 7W, and a twenty-fourth fret 7X. Unfretted instruments have no frets.

A player can play a stringed instrument from the first category by bowing the strings 4 or 4' with a bow or plucking the strings with a pick or a finger. The portion of the string 4 or 4' that is plucked or bowed is between the nut 5 or 5' and the bridge 6 or 6' and generally is the portion that is stretched over the body 1 or 1' of the instrument. When a string 4 or 4' is plucked or bowed, a portion (hereinafter referred to as the "vibrating portion") of the string 4 or 4' vibrates and produces a pitch. The pitch depends upon the length of the vibrating portion, the composition and the thickness of the string 4 or 4', and the tension of the string 4 or 4'. For a string 4 or 4' with a particular composition, thickness, and tension, the pitch can be increased by decreasing the length of the vibrating portion; and the pitch can be decreased by increasing the length of the vibrating portion. Thus, each string 4 or 4' can produce a variety of pitches if the player changes the length of the vibrating portion. The length of the vibrating portion can be changed if a portion of the string 4 or 4' that is over the fingerboard 8 or 8' of the instrument is held down against the fingerboard 8 or 8' by the player's finger while the string 4 or 4' is plucked or bowed. The vibrating portion of the string 4 or 4' is longest when the portion of the string 4 or 4' that is over the fingerboard 8 or 8' of the instrument is not held down against the fingerboard 8 or 8' by the player's finger. In this instance, the length of the vibrating portion of the string 4 or 4' extends from the bridge 6 or 6' to the nut 5 or 5'. The vibrating portion of the string 4 or 4' is shortened when the portion of the string 4 or 4' that is over the fingerboard 8 or 8' of the instrument is held down against the fingerboard 8 or 8' by a player's finger. To vary the length of the vibrating portion of the string 4 or 4', a player can hold the string 4 or 4' down against the fingerboard 8 or 8' at various points along the fingerboard 8 or 8'.

When a player plucks or bows a string 4' while holding down a portion of the string 4' against the fingerboard 8' of an unfretted instrument, the vibrating portion of the string 4' extends from the bridge 6' to the player's finger that is holding down the string 4'. The length of the vibrating portion of the string 4' can be decreased and the resulting pitch produced by the string 4' can be increased by moving the finger that is holding down the string 4' closer to the bridge 6'. The length of the vibrating portion of the string 4' can be increased and the resulting pitch produced by the string 4' can be decreased by moving the finger that is holding down the string 4' closer to the nut 5'. Standard unfretted instruments have no indicators on the fingerboard 8', the neck 3' or on the strings 4' to indicate which pitch will be produced if a player plucks or bows a string 4' while holding down a portion of the string 4' against the fingerboard 8'.

When a player's finger holds down a string 4 against the fingerboard 8 of a fretted instrument, the string 4 is engaged by the fret 7 that is located between the bridge 6 and the player's finger and that is closest to the player's finger. Hereinafter, the fret that engages the string 4 will be referred to as the "engaging fret." When a player plucks a string 4 while holding down a portion of the string 4 against the fingerboard 8 of a fretted instrument, the vibrating portion of the string 4 extends from the bridge 6 to the engaging fret 7. The length of the vibrating portion of the string 4 can be decreased and the resulting pitch produced by the string 4 can be increased by moving the finger that is holding down the string 4 closer to the bridge 6 so that a fret 7 that is closer to the bridge 6 engages the string. The length of the vibrating portion of the string 4 can be increased and the resulting pitch produced by the string 4 can be decreased by moving the finger that is holding down the string 4 closer to the nut 5 so that a fret 7 that is closer to the nut 5 engages the string.

When a player plucks a string 4 while holding down a portion of the string 4 against the fingerboard 8 between the nut 5 and the first fret 7A of a fretted instrument, the first fret 7A is the engaging fret; and the pitch produced is one half step higher than the pitch that is produced when the string 4 is plucked and is not held down against the fingerboard 8. When a player plucks the string 4 while holding down a portion of the string 4 against the fingerboard 8 between the first fret 7A and the second fret 7B, the second fret 7B is the engaging fret; and the pitch produced is one half step higher than the pitch that is produced when the first fret 7A is the engaging fret. When a player plucks the string 4 while holding down a portion of the string 4 against the fingerboard 8 between the second fret 7B and the third fret 7C, the third fret 7C is the engaging fret; and the pitch produced is one half step higher than the pitch that is produced when the second fret 7B is the engaging fret.

When the fourth fret 7D is the engaging fret, the pitch produced is one half step higher than the pitch produced when the third fret 7C is the engaging fret. When the fifth fret 7E is the engaging fret, the pitch produced is one half step higher than the pitch produced when the fourth fret 7D is the engaging fret. When the sixth fret 7F is the engaging fret, the pitch produced is one half step higher than the pitch produced when the fifth fret 7E is the engaging fret. When the seventh fret 7G is the engaging fret, the pitch produced is one half step higher than the pitch produced when the sixth fret 7F is the engaging fret. When the eighth fret 7H is the engaging fret, the pitch produced is one half step higher than the pitch produced when the seventh fret 7G is the engaging fret. When the ninth fret 7I is the engaging fret, the pitch produced is one half step higher than the pitch produced when the eighth fret 7H is the engaging fret. When the tenth fret 7J is the engaging fret, the pitch produced is one half step higher than the pitch produced when the ninth fret 7I is the engaging fret. When the eleventh fret 7K is the engaging fret, the pitch produced is one half step higher than the pitch produced when the tenth fret 7J is the engaging fret. When the twelfth fret 7L is the engaging fret, the pitch produced is one half step higher than the pitch produced when the eleventh fret 7K is the engaging fret. When the thirteenth fret 7M is the engaging fret, the pitch produced is one half step higher than the pitch produced when the twelfth fret 7L is the engaging fret. When the fourteenth fret 7N is the engaging fret, the pitch produced is one half step higher than the pitch produced when the thirteenth fret 7M is the engaging fret. When the fifteenth fret 7O is the engaging fret, the pitch produced is one half step higher than the pitch produced when the fourteenth fret 7N is the engaging fret. When the sixteenth fret 7P is the engaging fret, the pitch produced is one half step higher than the pitch produced when the fifteenth fret 7O is the engaging fret. When the seventeenth fret 7Q is the engaging fret, the pitch produced is one half step higher than the pitch produced when the fifteenth fret 7P is the engaging fret. When the eighteenth fret 7R is the engaging fret, the pitch produced is one half step higher than the pitch produced when the seventeenth fret 7Q is the engaging fret. When the nineteenth fret 7S is the engaging fret, the pitch produced is one half step higher than the pitch produced when the eighteenth fret 7R is the engaging fret. When the twentieth fret 7T is the engaging fret, the pitch produced is one half step higher than the pitch produced when the nineteenth fret 7S is the engaging fret. When the twenty-first fret 7U is the engaging fret, the pitch produced is one half step higher than the pitch produced when the twentieth fret 7T is the engaging fret. When the twenty-second fret 7V is the engaging fret, the pitch produced is one half step higher than the pitch produced when the twenty-first fret 7U is the engaging fret. When the twenty-third fret 7W is the engaging fret, the pitch produced is one half step higher than the pitch produced when the twenty-second fret 7V is the engaging fret. When the twenty-fourth fret 7X is the engaging fret, the pitch produced is one half step higher than the pitch produced when the twenty-third fret 7W is the engaging fret.

Except for the first fret 7A and the twenty-fourth fret 7X, which each have only one immediately adjacent fret (7B and 7W, respectively), all of the frets 7 have two immediately adjacent frets 7, one of which is closer to the bridge 6 and one of which is farther from the bridge 6. The pitch is increased by one half step when the engaging fret 7 is changed to the immediately adjacent fret 7 that is closer to the bridge 6. The pitch is decreased by one half step when the engaging fret 7 is changed to the immediately adjacent fret 7 that is farther from the bridge 6.

A standard fretted instrument may have demarcations on the fingerboard 8 and/or on the binding 9 to identify adjacent frets 7. As shown in FIGS. 1–3, the standard guitar may have: a dot 10A on the fingerboard 8 and a dot 11A on the binding 9 between the second fret 7B and the third fret 7C; a dot 10B on the fingerboard 8 and a dot 11B on the binding 9 between the fourth fret 7D and the fifth fret 7E; a dot 10C on the fingerboard 8 and a dot 11C on the binding 9 between the sixth fret 7F and the seventh fret 7G; a dot 10D on the fingerboard 8 and a dot 11D on the binding 9 between the eighth fret 7H and the ninth fret 7I; two dots 12A on the fingerboard 8 and two dots 13A on the binding 9 between the eleventh fret 7K and the twelfth fret 7L; a dot 10E on the fingerboard 8 and a dot 11E on the binding 9 between the fourteenth fret 7N and the fifteenth fret 7O; a dot 10F on the fingerboard 8 and a dot 11F on the binding 9 between the sixteenth fret 7P and the seventeenth fret 7Q; a dot 10G on the fingerboard 8 and a dot 11G on the binding 9 between the eighteenth fret 7R and the nineteenth fret 7S; a dot 10H on the fingerboard 8 and a dot 11H on the binding 9 between the twentieth fret 7T and the twenty-first fret 7U; and two dots 12B on the fingerboard 8 and two dots 13B on the binding 9 between the twenty-third fret 7W and the twenty-fourth fret 7X. The two dots 12A indicate that when the string 4 is held down against the fingerboard 8 between the eleventh fret 7K and the twelfth fret 7L so that the twelfth fret 7L is the engaging fret, the pitch produced when the string 4 is plucked is one octave higher than the pitch produced when the string 4 is plucked and is not held down against the fingerboard 8. The two dots 12B indicate that when the string 4 is held down against the fingerboard 8 between the twenty-third fret 7W and the twenty-fourth fret 7X so that the twenty-fourth fret 7X is the engaging fret, the pitch produced when the string 4 is plucked is two octaves higher than the pitch produced when the string 4 is plucked and is not held down against the fingerboard 8. Otherwise, standard fretted instruments generally have no indicators on the fingerboard 8, the neck 3, the binding 9, or the strings 4 to indicate which pitch will be produced if a player plucks a string 4 while holding down a portion of the string 4 against the fingerboard 8.

Figure 5:
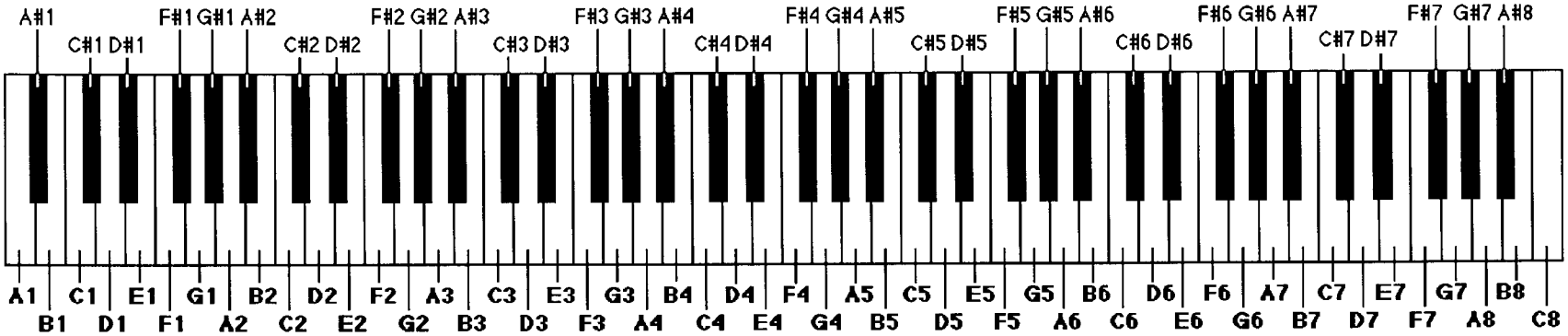
FIG. 5 PRIOR ART
FIG. 5 shows a standard piano keyboard.

A chromatic scale comprises twelve half steps: A; A♯, which is equivalent to B♭; B; C; C♯, which is equivalent to D♭; D; D♯, which is equivalent to E♭; E; F; F♯, which is equivalent to G♭; G; and G♯, which is equivalent to A♭. This sequence of twelve steps can be repeated at various octaves. FIG. 5 represents a standard piano keyboard.

In FIG. 5, the keys corresponding to the twelve half steps of the chromatic scale are labelled to indicate the various octaves. The chromatic scale at the lowest octave is: A1, A♯1, B1, C1, C♯1, D1, D♯1, E1, F1, F♯1, G1, and G♯1. The chromatic scale at the next highest octave is: A2, A♯2, B2, C2, C♯2, D2, D♯2, E2, F2, F♯2, G2, and G♯2. The chromatic scale at the next highest octave is: A3, A♯3, B3, C3, C♯3, D3, D♯3, E3, F3, F♯3, G3, and G♯3. The chromatic scale at the next highest octave is: A4, A♯4, B4, C4, C♯4, D4, D♯4, E4, F4, F♯4, G4, and G♯4. The chromatic scale at the next highest octave is: A5, A♯5, B5, C5, C♯5, D5, D♯5, E5, F5, F♯5, G5, and G♯5. The chromatic scale at the next highest octave is:

A6, A♯6, B6, C6, C♯6, D6, D♯6, E6, F6, F♯6, G6, and G♯6. The chromatic scale at the next highest octave is: A7, A♯7, B7, C7, C♯7, D7, D♯7, E7, F7, F♯7, G7, and G♯7. The partial chromatic scale at the next highest octave is: A8, A♯8, B8, and C8.

Unlike a piano, where the keys corresponding to the pitches A, B, C, D, E, F, and G have one color (usually a light color such as white) and the keys corresponding to the pitches A♯, C♯, D♯, F♯, and G♯ have a different color (usually a dark color such as black), standard fretted and unfretted stringed instruments have no such demarcations to differentiate the pitches produced by the strings. In one embodiment of the present invention, the demarcations of a piano keyboard are adapted for fretted and unfretted stringed instruments. In another embodiment of the present invention, fretted and unfretted stringed instruments have a different demarcation for each of the twelve pitches of the chromatic scale. In another embodiment of the present invention, fretted and unfretted stringed instruments have a different demarcation for each of the seven pitches A, B, C, D, E, F, and G and a single separate demarcation (e.g., black) for all five of the pitches A♯, C♯, D♯, F♯, and G♯. These embodiments and others are described in greater detail below and in the corresponding figures. In the figures, the same or generally similar elements are labelled with the same reference numerals; and analogous elements are labelled with analogous reference numerals.

When the strings 4 of a standard six-string guitar, such as the one shown in FIGS. 1–3, are plucked without being held down against the fingerboard 8, the first string 4E3 produces the pitch E3; the second string 4A4 produces the pitch A4; the third string 4D4 produces the pitch D4; the fourth string 4G4 produces the pitch G4; the fifth string 4B5 produces the pitch B5; and the sixth string 4E5 produces the pitch E5.

FIG. 6*a* is a top plan view of the fingerboard 108*a*, the nut 5, and the twenty-four frets (7A through 7X) of a six-string guitar. The fingerboard 108*a* has a column of twenty-five generally rectangular areas for each of the six strings 4. The first column 121 corresponds to the first string 4E3; the second column 122 corresponds to the second string 4A4; the third column 123 corresponds to the third string 4D4; the fourth column 124 corresponds to the fourth string 4G4; the fifth column 125 corresponds to the fifth string 4B5; and the sixth column 126 corresponds to the sixth string 4E5. The twenty-five generally rectangular areas in each column indicate where the corresponding string 4 should be held down against the fingerboard 108*a* to produce the particular pitches shown in FIG. 6*a* when the string 4 is plucked.

FIG. 6*b* is a top plan view of a preferred embodiment of the present invention having twenty-four frets and six strings stretched over the fingerboard 108*b*. A pattern of indicators is laid out on the fingerboard 108*b* with each string 4E2, 4A3, 4D3, 4G3, 4B4, or 4E4, overlying each pattern of generally alternating black and white squares. In other words, looking along the length of a single string 4E2, 4A3, 4D3, 4G3, 4B4, or 4E4, the black and white squares sequentially repeat, so when seen from one end of the string at nut 5 to the opposite bridge end, a pattern of black and white squares immediately beneath that string becomes apparent. The pattern corresponds to the notes of a chromatic scale. To be sure, the black and white squares forming the pattern coincide to the black and white arrangement of keys on a conventional piano. Also noticeable in the plan view of FIG. 6*b* is that the pattern of black and white squares changes from one string to the next string. Twenty-four frets 7A through 7X of the six-string guitar are also shown.

FIG. 7*a* is a top plan view of the fingerboard 208*a*, the nut 5, and the twenty-four frets (7A through 7X) of a four-string bass guitar. The four strings 4 of a bass guitar are shown in FIG. 7*b*, but not in FIG. 7*a*. When the strings 4 of a four-string bass guitar are plucked without being held down against the fingerboard 208*a* (FIG. 7*a*) or 208*b* (FIG. 7*b*), the first string 4E2 produces the pitch E2; the second string 4A3 produces the pitch A3; the third string 4D3 produces the pitch D3; and the fourth string 4G3 produces the pitch G3. The fingerboard 208*a* has a column of twenty-five generally rectangular areas for each of the four strings 4. The first column 221 corresponds to the first string 4E2; the second column 222 corresponds to the second string 4A3; the third column 223 corresponds to the third string 4D3; and the fourth column 224 corresponds to the fourth string 4G3. The twenty-five generally rectangular areas in each column indicate where the corresponding string 4 should be held down against the fingerboard 208*a* to produce the particular pitches shown in FIG. 7*a* when the string 4 is plucked.

FIG. 8*a* is a top plan view of the fingerboard 308*a* and the nut 5' of a four-string violin. FIG. 8*b* is a top plan view of a violin incorporating the fingerboard 308*a*. FIG. 8*b* shows that the violin comprises the body 1'; the head 2'; the neck 3' connecting the body 1' and the head 2'; the bridge 6' on the body 1'; and the four strings 4'G3, 4'D4, 4'A5, and 4'E5. When the strings 4' of a violin are plucked or bowed without being held down against the fingerboard 8' (FIG. 4), 308*a* (FIGS. 8*a* and 8*b*), or 308*b* (FIG. 8*c*), the first string 4'G3 produces the pitch G3; the second string 4'D4 produces the pitch D4; the third string 4'A5 produces the pitch A5; and the fourth string 4'E5 produces the pitch E5. The fingerboard 308*a* has a column of twenty-eight generally rectangular areas for each of the four strings 4'. The first column 321 corresponds to the first string 4'G3; the second column 322 corresponds to the second string 4'D4; the third column 323 corresponds to the third string 4'A5; and the fourth column 324 corresponds to the fourth string 4'E5. The twenty-eight generally rectangular areas in each column indicate where the corresponding string 4' should be held down against the fingerboard 308*a* to produce the particular pitches shown in FIG. 8*a* when the string 4' is plucked or bowed. Each generally rectangular area has a side that is closest to the nut 5' and a side that is closest to the bridge 6'; and the string 4' generally should be held down against the fingerboard 308*a* midway between these two sides to produce the pitch associated with that rectangular area. The pitch can be decreased if the finger holding down the string 4' in the rectangular area is moved toward the side of the rectangular area that is closest to the nut 5'. The pitch can be increased if the finger holding down the string 4' in the rectangular area is moved toward the side of the rectangular area that is closest to the bridge 6'.

FIG. 9*a* is a top plan view of the fingerboard 8 and the twenty-four frets (7A' through 7X') of a six-string guitar. Each fret 7A' through 7X' is divided into six generally rectangular areas. The generally rectangular areas form six columns with twenty-four generally rectangular areas in each column. The first column 421 corresponds to the first string 4E3; the second column 422 corresponds to the second string 4A4; the third column 423 corresponds to the third string 4D4; the fourth column 424 corresponds to the fourth string 4G4; the fifth column 425 corresponds to the fifth string 4B5; and the sixth column 426 corresponds to the sixth string 4E5. (In order to provide an unobstructed view of the frets 7A' through 7X', the strings 4 are omitted from FIG. 9*a*.) The twenty-four generally rectangular areas in each column indicate where the corresponding string 4 should be held down against the fingerboard 8 to produce the particular pitches shown in FIG. 9*a* when the string 4 is plucked. For example, the generally rectangular areas on the second fret 7B' are labelled with the pitches F♯3, B4, E4, A5, C♯5, and F♯5 to indicate that: (1) the string 4E3 produces the pitch F♯3 when the string 4E3 is plucked while being held down against the fingerboard 8 between the first fret 7A' and the second fret 7B'; (2) the string 4A4 produces the pitch B4 when the string 4A4 is plucked while being held down against the fingerboard 8 between the first fret 7A' and the second fret 7B'; (3) the string 4D4 produces the pitch E4 when the string 4D4 is plucked while being held down against the fingerboard 8 between the first fret 7A' and the second fret 7B'; (4) the string 4G4 produces the pitch A5 when the string 4G4 is plucked while being held down against the fingerboard 8 between the first fret 7A' and the second fret 7B'; (5) the string 4B5 produces the pitch C♯5 when the string 4B5 is plucked while being held down against the fingerboard 8 between the first fret 7A' and the second fret 7B'; and (6) the string 4E5 produces the pitch F♯5 when the string 4E5 is plucked while being held down against the fingerboard 8 between the first fret 7A' and the second fret 7B'.

FIG. 10*a* is a top plan view of the strings for a six-string guitar. When the strings shown in FIG. 10*a* are used on a six-string guitar and are plucked without being held down against the fingerboard 8, the first string 104E3 produces the pitch E3; the second string 104A4 produces the pitch A4; the third string 104D4 produces the pitch D4; the fourth string 104G4 produces the pitch G4; the fifth string 104B5 produces the pitch B5; and the sixth string 104E5 produces the pitch E5. When the first string 104E3 is used on a six-string guitar, the generally rectangular region 5E3 on the first string 104E3 should be generally positioned on top of the nut 5; and the twenty-four generally rectangular regions 7AE3 through 7XE3 should be positioned above the frets 7A through 7X, respectively. When the second string 104A4 is used on a six-string guitar, the generally rectangular region 5A4 on the second string 104A4 should be generally positioned on top of the nut 5; and the twenty-four generally rectangular regions 7AA4 through 7XA4 should be positioned above the frets 7A through 7X, respectively. When the third string 104D4 is used on a six-string guitar, the generally rectangular region 5D4 on the third string 104D4 should be generally positioned on top of the nut 5; and the twenty-four generally rectangular regions 7AD4 through 7XD4 should be positioned above the frets 7A through 7X, respectively. When the fourth string 104G4 is used on a six-string guitar, the generally rectangular region 5G4 on the fourth string 104G4 should be generally positioned on top of the nut 5; and the twenty-four generally rectangular regions 7AG4 through 7XG4 should be positioned above the frets 7A through 7X, respectively. When the fifth string 104B5 is used on a six-string guitar, the generally rectangular region 5B5 on the fifth string 104B5 should be generally positioned on top of the nut 5; and the twenty-four generally rectangular regions 7AB5 through 7XB5 should be positioned above the frets 7A through 7X, respectively. When the sixth string 104E5 is used on a six-string guitar, the generally rectangular region 5E3 on the sixth string 104E5 should be generally positioned on top of the nut 5; and the twenty-four generally rectangular regions 7AE5 through 7XE5 should be positioned above the frets 7A through 7X, respectively. Each string shown in FIG. 10*a* has twenty-five remaining generally rectangular areas. These twenty-five generally rectangular areas on each string indicate which part of the string should be held down against the fingerboard 8 to produce the particular pitches shown in FIG. 10*a* when the string is plucked. Thus, the rectangular area labelled "F3" on the first string 104E3 in FIG. 10*a* indicates that the portion of the first string 104E3 between the nut 5 and the first fret 7A should be held down against the fingerboard 8 to produce the pitch F3 when the string 104E3 is plucked. The rectangular area labelled "F♯3" on the first string 104E3 in FIG. 10*a* indicates that the portion of the first string 104E3 between the first fret 7A and the second fret 7B should be held down against the fingerboard 8 to produce the pitch F♯3 when the string 104E3 is plucked.

FIG. 11*a* is a top plan view of the strings for a violin. When the strings shown in FIG. 11*a* are used on a violin and are plucked or bowed without being held down against the fingerboard 8', the first string 104"G3 produces the pitch G3; the second string 104"D4 produces the pitch D4; the third string 104"A5 produces the pitch A5; and the fourth string 104"E5 produces the pitch E5. When the first string 104"G3 is used on a violin, the generally rectangular region 5"G3 on the first string 104"G3 should be generally positioned on top of the nut 5'. When the second string 104"D4 is used on a violin, the generally rectangular region 5"D4 on the second string 104"D4 should be generally positioned on top of the nut 5'. When the third string 104"A5 is used on a violin, the generally rectangular region 5"A5 on the third string 104"A5 should be generally positioned on top of the nut 5'. When the fourth string 104"E5 is used on a violin, the generally rectangular region 5"E5 on the fourth string 104"E5 should be generally positioned on top of the nut 5'. Each string shown in FIG. 11*a* has twenty-eight remaining generally rectangular areas. These twenty-eight generally rectangular areas on each string indicate which part of the string should be held down against the fingerboard 8' to produce the particular pitches shown in FIG. 11*a* when the string is plucked or bowed. Thus, the rectangular area labelled "A4" on the first string 104"G3 in FIG. 11*a* indicates the portion of the first string 104"G3 that should be held down against the fingerboard 8' to produce the pitch A4 when the string 104"G3 is plucked or bowed. The rectangular area labelled "A♯4" on the first string 104"G3 in FIG. 11*a* indicates the portion of the first string 104"G3 that should be held down against the fingerboard 8' to produce the pitch A♯4 when the string 104"G3 is plucked or bowed.

Figure 12:
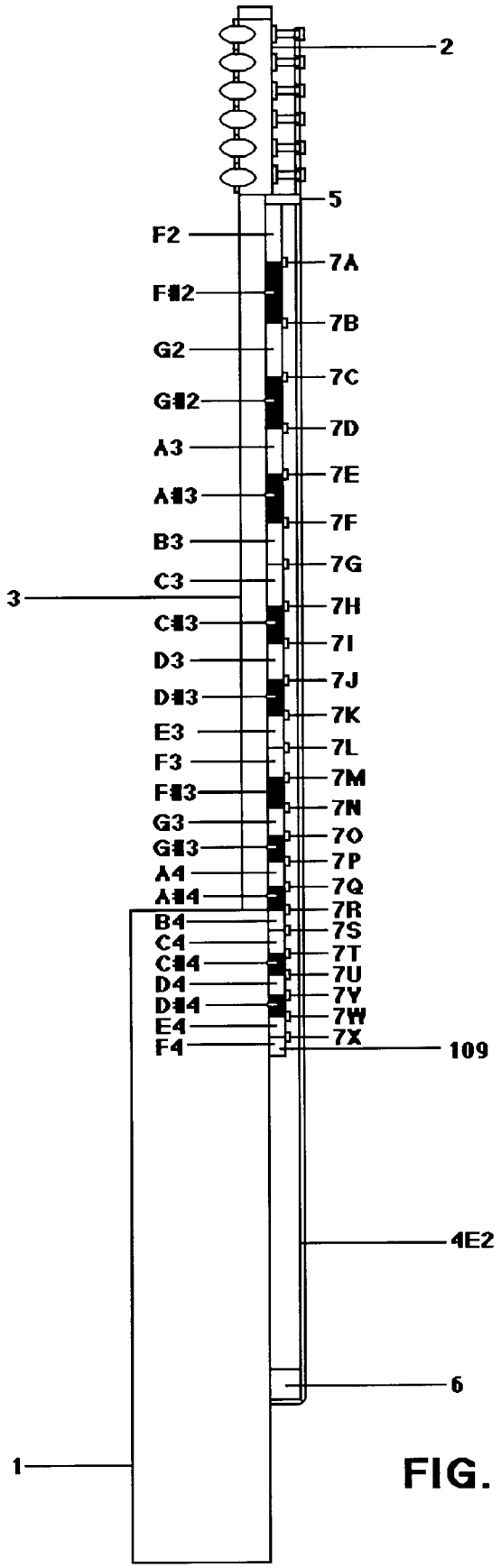
FIG. 12 shows a side view of a six-string guitar with the binding of the present invention.

FIG. 12 is a side view of a six-string guitar having a head 2, a neck 3, a body 1, a binding 109, a first string 4E3, and twenty-four frets (7A through 7X). The binding 109 has twenty-five generally rectangular areas. These twenty-five generally rectangular areas on the binding 109 indicate which part of the first string 4E3 should be held down against the fingerboard 8 to produce the particular pitches shown in FIG. 12 when the string 4E3 is plucked. Thus, the generally rectangular area labelled "F2" on the binding 109 indicates that the portion of the first string 4E3 between the nut 5 and the first fret 7A should be held down against the fingerboard 8 to produce the pitch F3 when the string 4E3 is plucked. The rectangular area labelled "F♯3" on the binding 109 in FIG. 12 indicates that the portion of the first string 4E3 between the first fret 7A and the second fret 7B should be held down against the fingerboard 8 to produce the pitch F♯3 when the string 4E3 is plucked.

In one embodiment of the present invention, indicators are on or are an integral part of a portion (e.g. the neck; the fingerboard; the frets, if any; the nut and any frets; the bridge and any frets; the fingerboard between any frets; the binding, if any; and/or one or more strings) of a fretted or unfretted stringed musical instrument having a neck with a fingerboard and one or more strings stretched above the fingerboard, the indicators comprising: (1) one first indicator for one string or more than one first indicator for one or more strings, each first indicator being associated with one string, each first indicator indicating where the associated string should be held down against the fingerboard to produce the pitch A (e.g., A1, A2, A3, A4, A5, A6, A7, or A8) when the string is plucked or bowed; (2) one second indicator for one string or more than one second indicator for one or more strings, each second indicator being associated with one string, each second indicator indicating where the associated string should be held down against the fingerboard to produce the pitch A♯ (e.g., A♯1, A♯2, A♯3, A♯4, A♯5, A♯6, A♯7, or A♯8) when the string is plucked or bowed; (3) one third indicator for one string or more than one third indicator for one or more strings, each third indicator being associated with one string, each third indicator indicating where the associated string should be held down against the fingerboard to produce the pitch B (e.g., B1, B2, B3, B4, B5, B6, B7, or B8) when the string is plucked or bowed; (4) one fourth indicator for one string or more than one fourth indicator for one or more strings, each fourth indicator being associated with one string, each fourth indicator indicating where the associated string should be held down against the fingerboard to produce the pitch C (e.g., C1, C2, C3, C4, C5, C6, C7, or C8) when the string is plucked or bowed; (5) one fifth indicator for one string or more than one fifth indicator for one or more strings, each fifth indicator being associated with one string, each fifth indicator indicating where the associated string should be held down against the fingerboard to produce the pitch C♯ (e.g., C♯1, C♯2, C♯3, C♯4, C♯5, C♯6, or C♯7) when the string is plucked or bowed; (6) one sixth indicator for one string or more than one sixth indicator for one or more strings, each sixth indicator being associated with one string, each sixth indicator indicating where the associated string should be held down against the fingerboard to produce the pitch D (e.g., D1, D2, D3, D4, D5, D6, or D7) when the string is plucked or bowed; (7) one seventh indicator for one string or more than one seventh indicator for one or more strings, each seventh indicator being associated with one string, each seventh indicator indicating where the associated string should be held down against the fingerboard to produce the pitch D♯ (e.g., D♯1, D♯2, D♯3, D♯4, D♯5, D♯6, or D♯7) when the string is plucked or bowed; (8) one eighth indicator for one string or more than one eighth indicator for one or more strings, each eighth indicator being associated with one string, each eighth indicator indicating where the associated string should be held down against the fingerboard to produce the pitch E (e.g., E1, E2, E3, E4, E5, E6, or E7) when the string is plucked or bowed; (9) one ninth indicator for one string or more than one ninth indicator for one or more strings, each ninth indicator being associated with one string, each ninth indicator indicating where the associated string should be held down against the fingerboard to produce the pitch F (e.g., F1, F2, F3, F4, F5, F6, or F7) when the string is plucked or bowed; (10) one tenth indicator for one string or more than one tenth indicator for one or more strings, each tenth indicator being associated with one string, each tenth indicator indicating where the associated string should be held down against the fingerboard to produce the pitch F♯ (e.g., F♯1, F♯2, F♯3, F♯4, F♯5, F♯6, or F♯7) when the string is plucked or bowed; (11) one eleventh indicator for one string or more than one eleventh indicator for one or more strings, each eleventh indicator being associated with one string, each eleventh indicator indicating where the associated string should be held down against the fingerboard to produce the pitch G (e.g., G1, G2, G3, G4, G5, G6, or G7) when the string is plucked or bowed; and (12) one twelfth indicator for one string or more than one twelfth indicator for one or more strings, each twelfth indicator being associated with one string, each twelfth indicator indicating where the associated string should be held down against the fingerboard to produce the pitch G♯ (e.g., G♯1, G♯2, G♯3, G♯4, G♯5, G♯6, or G♯7). The first, second, third, fourth, fifth, sixth, seventh, eighth, ninth, tenth, eleventh, and twelfth indicators supplement and/or replace any standard indicators or demarcations that the instrument might have. For a fretted instrument, the twelve indicators supplement the frets. For a guitar, the indicators may supplement or replace the dots (10A through 10H, 11A through 11H, 12A, 12B, 13A, 13B).

If the indicators are on the fingerboard or the frets of a stringed instrument, the string that is held down against the fingerboard to produce a particular pitch touches the indicator corresponding to that pitch when the string is held down against the fingerboard. For example, when the string is held down against the fingerboard and plucked or bowed to produce the pitch A (e.g., A1, A2, A3, A4, A5, A6, A7, or A8), the string touches the first indicator. When the string is held down against the fingerboard and plucked or bowed to produce the pitch A♯ (e.g., A♯1, A♯2, A♯3, A♯4, A♯5, A♯6, A♯7, or A♯8), the string touches the second indicator. When the string is held down against the fingerboard and plucked or bowed to produce the pitch B (e.g., B1, B2, B3, B4, B5, B6, B7, or B8), the string touches the third indicator. When the string is held down against the fingerboard and plucked or bowed to produce the pitch C (e.g., C1, C2, C3, C4, C5, C6, C7, or C8), the string touches the fourth indicator. When the string is held down against the fingerboard and plucked or bowed to produce the pitch C♯ (e.g., C♯1, C♯2, C♯3, C♯4, C♯5, C♯6, or C♯7), the string touches the fifth indicator. When the string is held down against the fingerboard and plucked or bowed to produce the pitch D (e.g., D1, D2, D3, D4, D5, D6, or D7), the string touches the sixth indicator. When the string is held down against the fingerboard and plucked or bowed to produce the pitch D♯ (e.g., D♯1, D♯2, D♯3, D♯4, D♯5, D♯6, or D♯7), the string touches the seventh indicator. When the string is held down against the fingerboard and plucked or bowed to produce the pitch E (e.g., E1, E2, E3, E4, E5, E6, or E7) , the string touches the eighth indicator. When the string is held down against the fingerboard and plucked or bowed to produce the pitch F (e.g., F1, F2, F3, F4, F5, F6, or F7), the string touches the ninth indicator. When the string is held down against the fingerboard and plucked or bowed to produce the pitch F♯ (e.g., F♯1, F♯2, F♯3, F♯4, F♯5, F♯6, or F♯7), the string touches the tenth indicator. When the string is held down against the fingerboard and plucked or bowed to produce the pitch G (e.g., G1, G2, G3, G4, G5, G6, or G7), the string touches the eleventh indicator. When the string is held own against the fingerboard and plucked or bowed to produce the pitch G♯ (e.g., G♯1, G♯2, G♯3, G♯4, G♯5, G♯6, or G♯7), the string touches the twelfth indicator.

According to the present invention, some or all of the rectangular areas in FIGS. 6*a*, 7*a*, 8*a*, 9*a*, 10*a*, 11*a*, and 12 are marked with the first, second, third, fourth, fifth, sixth, seventh, eighth, ninth, tenth, eleventh, and twelfth indicators. If all of the rectangular areas in FIGS. 6*a*, 7*a*, 8*a*, 9*a*, 10*a*, 11*a*, and 12 are marked with indicators, each rectangular area labeled "A*" (where "*" is a wild card representing any number) in the figures would be marked with the first indicator; each rectangular area labeled "A♯*" (where "*" is a wild card representing any number) in the figures would be marked with the second indicator; each rectangular area labeled "B*" (where "*" is a wild card representing any number) in the figures would be marked with the third indicator; each rectangular area labeled "C*" (where "*" is a wild card representing any number) in the figures would be marked with the fourth indicator; each rectangular area labeled "C♯*" (where "*" is a wild card representing any number) in the figures would be marked with the fifth indicator; each rectangular area labeled "D*" (where "*" is a wild card representing any number) in the figures would be marked with the sixth indicator; each rectangular area labeled "D♯*" (where "*" is a wild card representing any number) in the figures would be marked with the seventh indicator; each rectangular area labeled "E*" (where "*" is a wild card representing any number) in the figures would be marked with the eighth indicator; each rectangular area labeled "F*" (where "*" is a wild card representing any number) in the figures would be marked with the ninth indicator; each rectangular area labeled "F♯*" (where "*" is a wild card representing any number) in the figures would be marked with the tenth indicator; each rectangular area labeled "G*" (where "*" is a wild card representing any number) in the figures would be marked with the eleventh indicator; and each rectangular area labeled "G♯*" (where "*" is a wild card representing any number) in the figures would be marked with the twelfth indicator. Of course, some of the rectangular areas in FIGS. 6*a*, 7*a*, 8*a*, 9*a*, 10*a*, 11*a*, and 12 may be left without indicators.

The indicators may involve any one or any combination of the following: colors or shades of colors (e.g., white, red, yellow, blue, orange, light green, violet, magenta, green, light violet, black, light blue, gray, combinations thereof, and any other suitable color); sizes (e.g., extra fine, very fine, fine, extra small, very small, small, medium-small, medium, medium-large, large, very large, extra large, or any other suitable size or combination of sizes); shapes (e.g., a square, a rectangle, a circle, a ring, an ellipse, a star, a triangle, a pentagon, a hexagon, a heptagon, an octagon, a nonagon, a decagon, or any other suitable shape or combination of shapes); alphanumeric characters (e.g., A♭, A, A♯, B♭, B, C, C♯, D♭, D, D♯, E♭, E, F, F♯, G♭, G, G♯, ♯, ♭, ♮, 1, 2, 3, 4, 5, 6, 7, 8, 9, 10, 11, 12, or any other suitable alphanumeric character or combination of alphanumeric characters); texture (e.g., smooth, rough, the various textures between smooth and rough, and any other suitable texture or combination of textures); apparent or actual temperatures (e.g., cold, hot, the various temperatures between cold and hot, and any other suitable temperature or combination of temperatures); fluorescence; different colored lights; and any other suitable characteristic that is discernable by touch and/or sight.

The first, second, third, fourth, fifth, sixth, seventh, eighth, ninth, tenth, eleventh, and twelfth indicators may be different from each other so that each of the twelve pitches (A, A♯, B, C, C♯, D, D♯, E, F, F♯, G, and G♯) of the chromatic scale has a unique indicator. For example, in FIGS. 6*a*, 7*a*, 8*a*, 9*a*, 10*a*, 11*a*, and 12, the first indicator may be light violet; the second indicator may be black; the third indicator may be light blue; the fourth indicator may be white; the fifth indicator may be red; the sixth indicator may be yellow; the seventh indicator may be blue; the eighth indicator may be orange; the ninth indicator may be light green; the tenth indicator may be violet; the eleventh indicator may be magenta; and the twelfth indicator may be green. Of course, other colors or shades of colors may be used. For example, the first indicator may be white (0% black), the second indicator may be light gray (9% black) , the third indicator may be a slightly darker gray (18% black) ; the fourth indicator may be a slightly darker gray (27% black); the fifth indicator may be a slightly darker gray (36% black); the sixth indicator may be an even darker gray (45% black) ; the seventh indicator may be a darker gray (54% black); the eighth indicator may be an even darker gray (63% black) ; the ninth indicator may be a slightly darker gray (72% black); the tenth indicator may be a darker gray (81% black); the eleventh indicator may be a darker gray (90% black); and the twelfth indicator may be black (100% black). Alternatively, instead of twelve different colors or shades of colors, twelve different shapes could be used to differentiate the first, second, third, fourth, fifth, sixth, seventh, eighth, ninth, tenth, eleventh, and twelfth indicators from each other. In another alternative, the first indicator may be "A"; the second indicator may be "A♯"; the third indicator may be "B"; the fourth indicator may be "C"; the fifth indicator may be "C♯"; the sixth indicator may be "D"; the seventh indicator may be "D♯"; the eighth indicator may be "E"; the ninth indicator may be "F"; the tenth indicator may be "F♯"; the eleventh indicator may be "G"; and the twelfth indicator may be "G♯".

Alternatively, some of the twelve indicators may be different from each other and the remaining indicators may not be different from each other. For example, the first, third, fourth, sixth, eighth, ninth, and eleventh indicators may be different from each other and different from the second, fifth, seventh, tenth, and twelfth indicators; and the second, fifth, seventh, tenth, and twelfth indicators may not be different from each other. Thus, in FIGS. 6*a*, 7*a*, 8*a*, 9*a*, 10*a*, 11*a*, and 12, the first indicator may be light violet; the third indicator may be light blue; the fourth indicator may be white; the sixth indicator may be yellow; the eighth indicator may be orange; the ninth indicator may be light green; the eleventh indicator may be magenta; and the second, fifth, seventh, tenth, and twelfth indicators may be black. Alternatively, the first indicator may be a circle; the third indicator may be a triangle; the fourth indicator may be a hexagon; the sixth indicator may be a star; the eighth indicator may be a heptagon; the ninth indicator may be an octagon; the eleventh indicator may be a decagon; and the second, fifth, seventh, tenth, and twelfth indicators may be a square.

In another alternative, the second, fifth, seventh, tenth, and twelfth indicators may be different from each other and different from the first, third, fourth, sixth, eighth, ninth, and eleventh indicators; and the first, third, fourth, sixth, eighth, ninth, and eleventh indicators may not be different from each other. Thus, in FIGS. 6*a*, 7*a*, 8*a*, 9*a*, 10*a*, 11*a*, and 12, the second indicator may be black; the fifth indicator may be red; the seventh indicator may be blue; the tenth indicator may be violet; the twelfth indicator may be green; and the first, third, fourth, sixth, eighth, ninth, and eleventh indicators may be white.

In another alternative, the first, third, fourth, sixth, eighth, ninth, and eleventh indicators may be different from the second, fifth, seventh, tenth, and twelfth indicators; the first, third, fourth, sixth, eighth, ninth, and eleventh indicators may not be different from each other; and the second, fifth, seventh, tenth, and twelfth indicators may not be different from each other. For example, in FIGS. 6*a*, 7*a*, 8*a*, 9*a*, 10*a*, 11*a*, and 12, the first, third, fourth, sixth, eighth, ninth, and eleventh indicators may be white; and the second, fifth, seventh, tenth, and twelfth indicators may be black. In this example, the logic of the black and white piano keys is adapted for use with a stringed musical instrument, as shown in FIGS. 6*b*, 6*c*, 7*b*, 8*c*, 9*b*, 10*b*, 11*b*, and 12.

FIG. 6*b* is a top plan view of the fingerboard 108*b* of a guitar with twenty-four frets (7A through 7X) and six strings (4E3, 4A4, 4D4, 4G4, 4B5, and 4E5) stretched over the fingerboard 108*b*. In FIG. 6*b*, the first, third, fourth, sixth, eighth, ninth, and eleventh indicators are white; and the second, fifth, seventh, tenth, and twelfth indicators are black.

The fingerboard 108*b* in FIG. 6*b* is derived from the fingerboard 108*a* in FIG. 6*a*. Fingerboard 108*b* is produced if the rectangular areas of the fingerboard 108*a* corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F3, F4, F5, F6, and F7), and the pitch C (G3, G4, G5, and G6) are colored white and if the rectangular areas of the fingerboard 108*a* corresponding to the pitch A♯ (A♯4, A♯5, A♯6, and A♯7), the pitch C♯ (C♯4, C♯5, C♯6, and C♯7), the pitch D♯ (D♯4, D♯5, D♯6, and D♯7), the pitch F♯ (F♯3, F♯4, F♯5, and F♯6), and the pitch G♯ (G♯3, G♯4, G♯5, and G♯6) are colored black. FIG. 6*c* shows a top plan view of the fingerboard 108*b* without the strings. As can be seen in FIG. 6*c*, if two white indicators are adjacent to each other, there is no demarcation between the two indicators; and if two black indicators are adjacent to each other, there is no demarcation between the two indicators. Alternatively, the fingerboard 108*b* could be modified to include such demarcations.

FIG. 7*b* is a top plan view of the fingerboard 208*b* of a bass guitar with twenty-four frets (7A through 7X) and four strings (4E2, 4A3, 4D3, and 4G3) stretched over the fingerboard 208*b*. In FIG. 7*b*, the first, third, fourth, sixth, eighth, ninth, and eleventh indicators are white; and the second, fifth, seventh, tenth, and twelfth indicators are black. The fingerboard 208*b* in FIG. 7*b* is derived from the fingerboard 208*a* in FIG. 7*a*. Fingerboard 208*b* is produced if the rectangular areas of the fingerboard 208*a* corresponding to the pitch A (A3, A4, and A5), the pitch B (B3, B4, and B5), the pitch C (C3, C4, and C5), the pitch D (D3, D4, and D5), the pitch E (E3, E4, and E5), the pitch F (F2, F3, F4, and F5), and the pitch G (G2, G3, G4, and G5) are colored white and if the rectangular areas of the fingerboard 208*a* corresponding to the pitch A♯ (A♯3, A♯4, and A♯5), the pitch C♯ (C♯3, C♯4, and C♯5), the pitch D♯ (D♯3, D♯4, and D♯5), the pitch F♯ (F♯2, F♯3, F♯4, and F♯5), and the pitch G♯ (G♯2, G♯3, G♯4, and G♯5) are colored black. In FIG. 7*b*, if two white indicators are adjacent to each other, there is no demarcation between the two indicators; and if two black indicators are adjacent to each other, there is no demarcation between the two indicators. Alternatively, the fingerboard 208*b* could be modified to include such demarcations.

FIG. 8*c* is a top plan view of a violin having a fingerboard 308*b*, a body 1', a head 2', and four strings (4'G3, 4'D4, 4'A5, and 4'E54) stretched over the fingerboard 308*b*. In FIG. 8*c*, the first, third, fourth, sixth, eighth, ninth, and eleventh indicators are white; and the second, fifth, seventh, tenth, and twelfth indicators are black. The fingerboard 308*b* in FIG. 8*c* is derived from the fingerboard 308*a* in FIGS. 8*a* and 8*b*. Fingerboard 308*b* is produced if the rectangular areas of the fingerboard 308*a* corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F3, F4, F5, F6, and F7), and the pitch G (G4, G5, G6, and G7) are colored white and if the rectangular areas of the fingerboard 308*a* corresponding to the pitch A♯ (A♯4, A♯5, A♯6, and A♯7), the pitch C♯ (C♯4, C♯5, C♯6, and C♯7), the pitch D♯ (D♯4, D♯5, D♯6, and D♯7), the pitch F♯ (F♯4, F♯5, F♯6, and F♯7), and the pitch G♯ (G♯3, G♯4, G♯5, G♯6, and G♯7) are colored black. In FIG. 8*c*, if two white indicators in the same row are adjacent to each other, there is no demarcation between the two indicators; and if two black indicators in the same row are adjacent to each other, there is no demarcation between the two indicators. Alternatively, the fingerboard 308*b* could be modified to include such demarcations.

FIG. 9*b* is a top plan view of the fingerboard 8 of a six-string guitar with twenty-four frets (7A" through 7X"). In FIG. 9*b*, the first, third, fourth, sixth, eighth, ninth, and eleventh indicators are white; and the second, fifth, seventh, tenth, and twelfth indicators are black. The twenty-four frets (7A" through 7X") in FIG. 9*b* are derived from the twenty-four frets (7A' through 7X', respectively) in FIG. 9*a*. Frets 7A" through 7X" are produced if the rectangular areas of the frets 7A' through 7X' corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F3, F4, F5, and F6), and the pitch G (G3, G4, G5, and G6) are colored white and if the rectangular areas of the frets 7A' through 7X' corresponding to the pitch A♯ (A♯4, A♯5, A♯6, and A♯7), the pitch C♯ (C♯4, C♯5, C♯6, and C♯7), the pitch D♯ (D♯4, D♯5, D♯6, and D♯7), the pitch F♯ (F♯3, F♯4, F♯5, and F♯6), and the pitch G♯ (G♯3, G♯4, G♯5, and G♯6) are colored black. In FIG. 9*b*, if two white indicators are adjacent to each other, there is no demarcation between the two indicators; and if two black indicators are adjacent to each other, there is no demarcation between the two indicators. Alternatively, the frets 7A" through 7X" could be modified to include such demarcations.

FIG. 10*b* is a top plan view of the six strings (104'E3, 104'A4, 104'D4, 104'G4, 104'B5, and 104'E5) of a guitar. When the sixth string 104'E3 is used on a six-string guitar, the generally rectangular region 5'E3 on the sixth string 104'E3 should be generally positioned on top of the nut 5'; and the twenty-four generally rectangular regions 7A'E3 through 7X'E3 should be positioned above the frets 7A through 7X, respectively. When the fifth string 104'A4 is used on a six-string guitar, the generally rectangular region 5'A4 on the fifth string 104'A4 should be generally positioned on top of the nut 5'; and the twenty-four generally rectangular regions 7A'A4 through 7X'A4 should be positioned above the frets 7A through 7X, respectively. When the fourth string 104'D4 is used on a six-string guitar, the generally rectangular region 5'D4 on the fourth string 104'D4 should be generally positioned on top of the nut 5'; and the twenty-four generally rectangular regions 7A'D4 through 7X'D4 should be positioned above the frets 7A through 7X, respectively. When the third string 104'G4 is used on a six-string guitar, the generally rectangular region 5'G4 on the third string 104'G4 should be generally positioned on top of the nut 5'; and the twenty-four generally rectangular regions 7A'G4 through 7X'G4 should be positioned above the frets 7A through 7X, respectively. When the second string 104'B5 is used on a six-string guitar, the generally rectangular region 5'B5 on the second string 104'B5 should be generally positioned on top of the nut 5'; and the twenty-four generally rectangular regions 7A'B5 through 7X'B5 should be positioned above the frets 7A through 7X, respectively. When the first string 104'E5 is used on a six-string guitar, the generally rectangular region 5'E3 on the first string 104'E5 should be generally positioned on top of the nut 5'; and the twenty-four generally rectangular regions 7A'E5 through 7X'E5 should be positioned above the frets 7A through 7X, respectively. In FIG. 10*b*, the first, third, fourth, sixth, eighth, ninth, and eleventh indicators are white; and the second, fifth, seventh, tenth, and twelfth indicators are black. The strings 104'E3, 104'A4, 104'D4, 104'G4, 104'B5, and 104'E5 in FIG. 10*b* are derived from the strings 104E3, 104A4, 104D4, 104G4, 104B5, and 104E5, respectively, in FIG. 10*a*. Strings 104'E3, 104'A4, 104'D4, 104'G4, 104'B5, and 104'E5 are produced if the rectangular areas of the strings 104E3, 104A4, 104D4,

104G4, 104B5, and 104E5 corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F3, F4, F5, F6, and F7), and the pitch G (G3, G4, G5, and G6) are colored white and if the rectangular areas of the strings 104E3, 104A4, 104D4, 104G4, 104B5, and 104E5 corresponding to the pitch A♯ (A♯4, A♯5, A♯6, and A♯7), the pitch C♯ (C♯4, C♯5, C♯6, and C♯7), the pitch D♯ (D♯4, D♯5, D♯6, and D♯7), the pitch F♯ (F♯3, F♯4, F♯5, and F♯6), and the pitch G♯ (G♯3, G♯4, G♯5, and G♯6) are colored black.

FIG. 11*b* is a top plan view of the four strings (104'''G3, 104'''D4, 104'''A5, and 104'''E5) of a violin. When the first string 104'''G3 is used on a violin, the generally rectangular region 5'''G3 on the first string 104'''G3 should be generally positioned on top of the nut 5'. When the second string 104'''D4 is used on a violin, the generally rectangular region 5'''D4 on the second string 104'''D4 should be generally positioned on top of the nut 5'. When the third string 104'''A5 is used on a violin, the generally rectangular region 5'''A5 on the third string 104'''A5 should be generally positioned on top of the nut 5'. When the fourth string 104'''E5 is used on a violin, the generally rectangular region 5'''E5 on the fourth string 104'''E5 should be generally positioned on top of the nut 5'. In FIG. 11*b*, the first, third, fourth, sixth, eighth, ninth, and eleventh indicators are white; and the second, fifth, seventh, tenth, and twelfth indicators are black. The strings 104'''G3, 104'''D4, 104'''A5, and 104'''E5 in FIG. 11*b* are derived from the strings 104"G3, 104"D4, 104"A5, and 104"E5, respectively, in FIG. 11*a*. Strings 104'''G3, 104'''D4, 104'''A5, and 104'''E5 are produced if the rectangular areas of the strings 104"G3, 104"D4, 104"A5, and 104"E5 corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F3, F4, F5, F6, and F7), and the pitch G (G4, G5, G6, and G7) are colored white and if the rectangular areas of the strings 104"G3, 104"D4, 104"A5, and 104"E5 corresponding to the pitch A♯ (A♯4, A♯5, A♯6, and A♯7), the pitch C♯ (C♯4, C♯5, C♯6, and C♯7), the pitch D♯ (D♯4, D♯5, D♯6, and D♯7), the pitch F♯ (F♯4, F♯5, F♯6, and F♯7), and the pitch G♯ (G♯3, G♯4, G♯5, G♯6, and G♯7) are colored black. In FIG. 11*b*, if two white indicators are adjacent to each other on the same string, there is a demarcation between the two indicators. Alternatively, the strings 104'''G3, 104'''D4, 104'''A5, and 104'''E5 could be modified to exclude such demarcations.

In FIG. 12, the first, third, fourth, sixth, eighth, ninth, and eleventh indicators on the binding 109 are white; and the second, fifth, seventh, tenth, and twelfth indicators on the binding 109 are black. The binding 109 is produced if the rectangular areas of the binding 109 corresponding to the pitch A (A4, and A5), the pitch B (B4, and B5), the pitch C (C4 and C5), the pitch D (D4 and D5), the pitch E (E4 and E5), the pitch F (F3, F4, and F5), and the pitch G (G3, and G4) are colored white and if the rectangular areas of the binding 109 corresponding to the pitch A♯ (A♯4 and A♯5), the pitch C♯ (C♯4 and C♯5), the pitch D♯ (D♯4 and D♯5), the pitch F♯ (F♯3 and F♯4), and the pitch G♯ (G♯3 and G♯4) are colored black. In FIG. 12, if two white indicators are adjacent to each other, there is a demarcation between the two indicators. Alternatively, the binding 109 could be modified to exclude such demarcations.

In FIGS. 6*b*, 6*c*, 7*b*, 8*c*, 9*b*, 10*b*, 11*b*, and 12, the logic of the piano keyboard is used for fretted and unfretted stringed instruments. In these figures, all of indicators for the pitches A, B, C, D, E, F, and G are white; and all of the indicators for the pitches A♯, C♯, D♯, F♯, and G♯ are black. Thus, a repeating black-and-white pattern is formed. If one follows the 12-tone chromatic scale from A to G♯, the pattern is: white, black, white, white, black, white, black, white, white, black, white, and black. This pattern repeats whenever the chromatic scale repeats. Portions of this pattern repeat whenever portions of the chromatic scale repeat.

Alternatively, all of the indicators for the pitches A, B, C, D, E, F, and G may be black; and all of the indicators for the pitches A♯, C♯, D♯, F♯, and G♯ may be white. Of course, other indicators can be used instead of the colors black and white. For example, the indicators for the pitches A, B, C, D, E, F, and G may be tan; and the indicators for the pitches A♯, C♯, D♯, F♯, and G♯ may be dark brown. In another alternative, the indicators for the pitches A, B, C, D, E, F, and G may be squares; and the indicators for the pitches A♯, C♯, D♯, F♯, and G♯ may be triangles. In another alternative, the indicators for the pitches A, B, C, D, E, F, and G may be smooth surfaces; and the indicators for the pitches A♯, C♯, D♯, F♯, and G♯ may be rough surfaces. In another alternative, the indicators for the pitches A, B, C, D, E, F, and G may be lighted surfaces; and the indicators for the pitches A♯, C♯, D♯, F♯, and G♯ may be unlighted surfaces. In another alternative, the indicators for the pitches A, B, C, D, E, F, and G may be small squares; and the indicators for the pitches A♯, C♯, D♯, F♯, and G♯ may be larger squares.

Figure 13:
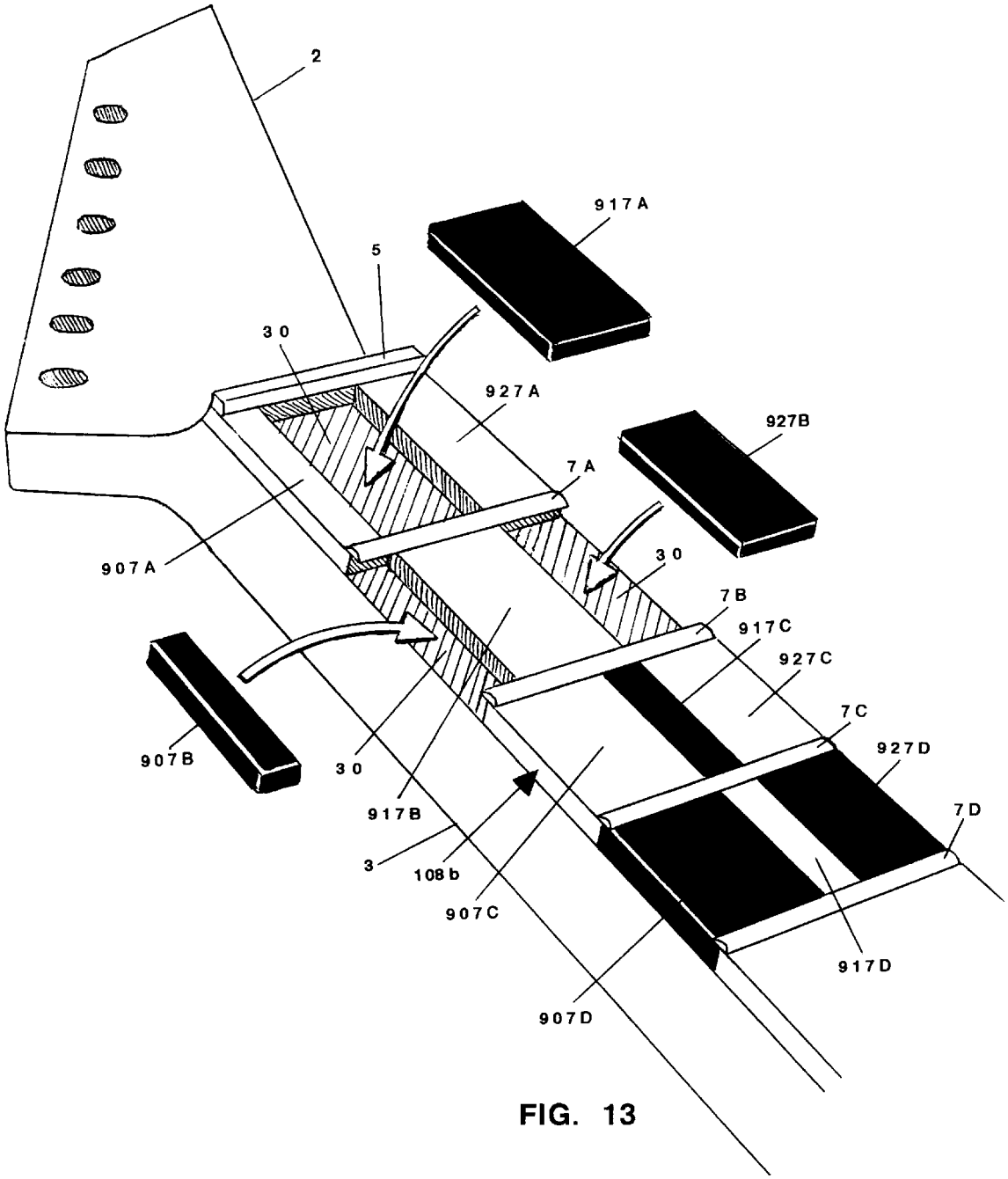
FIG. 13 shows how black and white tiles can be fitted together to form the fingerboard of the present invention.

One method of making a fingerboard 108*b* as shown in FIGS. 6*b* and 6*c* is illustrated in FIG. 13. The method comprises: (1) providing a flat surface (e.g., the top 30 of the neck 3); (2) gluing the nut 5 to the flat surface; (3) gluing the tiles 907A, 917A, and 927A to the nut and to the top of the flat surface; gluing the first fret 7A to the tiles 907A, 917A, and 927A and to the flat surface; (4) gluing the tiles 907B, 917B, and 927B to the first fret 7A and to the flat surface; (5) gluing the second fret 7B to the tiles 907B, 917D, and 927B and to the flat surface; (6) gluing the tiles 907C, 917C, and 927C to the second fret 7B and to the flat surface; (7) gluing the third fret 7C to 15 the tiles 907C, 917C, and 927C and to the flat surface; (8) gluing the tiles 907D, 917D, and 927D to the third fret 7C and to the flat surface; (9) gluing the fourth fret 7D to the tiles 907D, 917D, and 927D and to the flat surface; and (10) repeating the foregoing process of gluing frets and tiles until all of the frets and tiles are glued to the flat surface. In order to ensure that the frets and tiles are glued to the flat surface and to each other, pressure clamps should be used to apply pressure in three orthogonal directions: perpendicularly to the assembled fingerboard 108*b*; (2) longitudinally to the assembled fingerboard 108*b*; and (3) laterally to the assembled fingerboard 108*b*.

In FIGS. 6*c* and 13, tile 907A comprises the ninth indicator; tile 917A comprises the second, seventh, and twelfth indicators; tile 927A comprises the fourth and ninth indicators; tile 907B comprises the tenth indicator; tile 917B comprises the third, eighth, and first indicators; tile 927B comprises the fifth and tenth indicators; tile 907C comprises the eleventh, fourth, and ninth indicators; tile 917C comprises the second indicator; tile 927C comprises the sixth and eleventh indicators; tile 907D comprises the twelfth, fifth, and tenth indicators; tile 917D comprises the third indicator; and tile 927D comprises the seventh and twelfth indicators. In FIGS. 6*c* and 13, the first, third, fourth, sixth, eighth, ninth, and eleventh indicators are white, and the second, fifth, seventh, tenth, and twelfth indicators are black. The white tiles 907A, 927A, 917B, 907C, 927C, and 917D may be made of a light-colored wood such as maple; and the black tiles 917A, 907B, 927B, 917C, 907D, and 927D may be made of a dark-colored wood such as ebony. The wood may be bleached to provide whiter tiles or stained to provide blacker tiles. Of course, the tiles may be made of any other suitable material, including, but not necessarily limited to: wood (e.g., maple, oak, pine, rosewood, and birch), metal, ivory, plastic, ceramics, rubber, textiles, and glass.

Another method of making the fingerboard 108*b* as shown in FIGS. 6*b* and 6*c* comprises: (1) providing a flat piece of light-colored wood (such as maple) ; (2) routing out recesses for receiving the dark-colored tiles 917A, 907B, 927B, 917C, 907D, and 927D; (3) gluing the contrasting tiles into the corresponding recesses; (4) routing out recesses for receiving the frets; and (5) gluing the frets into the recesses for the frets so that the finished fingerboard 108*b* appears as in FIG 6*c*.

According to the foregoing methods, the indicators are an integral part of the fingerboard 108*b*. Alternatively, the indicators can be applied to the surface of a fingerboard. For example, decals or paint could be applied to the fingerboard. One such method involving painting comprises: (1) providing a fingerboard 8 or 8'; (2) painting the entire fingerboard white; (3) allowing the white paint to dry; and (4) painting the second, fifth, seventh, tenth, and twelfth indicators black. One method involving decals comprises: (1) providing a fingerboard 8 or 8' with a light-colored or white surface; (2) cutting out dark-colored (e.g., black) decals for the second, fifth, seventh, tenth, and twelfth indicators; and (3) applying the dark-colored decals to the appropriate parts of the fingerboard. If two or more adjacent indicators are the same, the decals for these indicators can be integrally connected to each other and need not be cut apart. Alternatively, for each area between adjacent frets, a single decal can be applied, the decal optionally having end portions to cover the binding, the decal being a single integrated piece with all of the indicators needed to label some or all of the notes that are produced when the string is plucked while being held down against the decal-covered fingerboard. For the fingerboard 108*b* of a six-string guitar, the resulting black-and-white pattern is shown in FIG. 6*c*. For the fingerboard 208*b* of a four-string bass guitar, the resulting black-and-white pattern is shown in FIG. 7*b*. For the fingerboard 308*b* of a violin, the resulting black-and-white pattern is shown in FIG. 8*c*.

Alternatively, the fingerboard could be made of a stainable wood; and the fingerboard of the present invention could be stained different colors for the different indicators. For example, one such method involving staining comprises: (1) providing a wooden fingerboard 8 or 8'; (2) bleaching or staining the entire fingerboard white; and (3) staining the second, fifth, seventh, tenth, and twelfth indicators black.

The indicators can be applied to the frets by staining or painting the frets. The indicators can be applied to the binding by staining or painting the binding. The indicators can be applied to the strings by staining or painting the strings. Alternatively, decals can be applied to the frets and the binding.

The present invention can be used with fretted and unfretted musical instruments having a fingerboard with one or more strings stretched over the fingerboard. Such instruments include, but are not necessarily limited to: a guitar, a 12-string guitar, an electric guitar, an electric bass guitar, an acoustic guitar, a lap steel, a pedal steel, or a leg steel, a bass guitar, a violin, a viola, a cello, a double bass, a banjo, a dobro, a lute, a mandolin, and a ukulele. The present invention facilitates playing of such stringed instruments because the player can more readily see or feel the finger positions to play specific notes. The present invention also provides the player with new musical insights, which become apparent because the logic of a piano keyboard has been adapted for use with stringed instruments. For a lap steel and pedal steel guitars, the indicators indicate where to place a metal slide to produce the indicated pitches.

The invention illustratively disclosed herein suitably may be practiced in the absence of any element which is not specifically disclosed herein. Thus, the invention may comprise, consist of, or consist essentially of the elements disclosed herein.

Although the present invention has been described in considerable detail with reference to certain preferred embodiments, the specification also lists many other embodiments. Therefore, the spirit and the scope of the appended claims should not be limited to the description of the preferred embodiments contained herein.

Furthermore, although a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the followings claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, a nail and a screw nevertheless may be equivalent structures in the environment of fastening wooden parts. Consequently, elements interchangeable with those specifically listed herein may also be employed and are intended to be covered in the following claims.

I claim:

1. Indicators for a portion of a fretted stringed musical instrument having a fingerboard and one or more strings stretched above the fingerboard's pattern of indicators for generating specific pitches corresponding to specific notes of a chromatic scale, the indicators comprising:

(1) one first indicator for one string or more than one first indicator for one or more strings, each first indicator being associated with one string, each first indicator indicating where the associated string should be held down against the fingerboard indicator to produce the pitch A when the string is plucked or bowed;

(2) one second indicator for one string or more than one second indicator for one or more strings, each second indicator being associated with one string, each second indicator indicating where the associated string should be held down against the fingerboard indicator to produce the pitch A♯ when the string is plucked or bowed;

(3) one third indicator for one string or more than one third indicator for one or more strings, each third indicator being associated with one string, each third indicator indicating where the associated string should be held down against the fingerboard indicator to produce the pitch B when the string is plucked or bowed;

(4) one fourth indicator for one string or more than one fourth indicator for one or more strings, each fourth indicator being associated with one string, each fourth indicator indicating where the associated string should be held down against the fingerboard indicator to produce the pitch C when the string is plucked or bowed;

(5) one fifth indicator for one string or more than one fifth indicator for one or more strings, each fifth indicator being associated with one string, each fifth indicator indicating where the associated string should be held down against the fingerboard indicator to produce the pitch C♯ when the string is plucked or bowed;

(6) one sixth indicator for one string or more than one sixth indicator for one or more strings, each sixth indicator being associated with one string, each sixth indicator indicating where the associated string should be held down against the fingerboard indicator to produce the pitch D when the string is plucked or bowed;

(7) one seventh indicator for one string or more than one seventh indicator for one or more strings, each seventh indicator being associated with one string, each seventh indicator indicating where the associated string should be held down against the fingerboard indicator to produce the pitch D♯ when the string is plucked or bowed;

(8) one eighth indicator for one string or more than one eighth indicator for one or more strings, each eighth indicator being associated with one string, each eighth indicator indicating where the associated string should be held down against the fingerboard indicator to produce the pitch E when the string is plucked or bowed;

(9) one ninth indicator for one string or more than one ninth indicator for one or more strings, each ninth indicator being associated with one string, each ninth indicator indicating where the associated string should be held down against the fingerboard indicator to produce the pitch F when the string is plucked or bowed;

(10) one tenth indicator for one string or more than one tenth indicator for one or more strings, each tenth indicator being associated with one string, each tenth indicator indicating where the associated string should be held down against the fingerboard indicator to produce the pitch F♯ when the string is plucked or bowed;

(11) one eleventh indicator for one string or more than one eleventh indicator for one or more strings, each eleventh indicator being associated with one string, each eleventh indicator indicating where the associated string should be held down against the fingerboard indicator to produce the pitch G when the string is plucked or bowed;

(12) one twelfth indicator for one string or more than one twelfth indicator for one or more strings, each twelfth indicator being associated with one string, each twelfth indicator indicating where the associated string should be held down against the fingerboard indicator to produce the pitch G♯ when the string is plucked or bowed;

wherein at least the first through twelfth indicators are disposed on the fingerboard substantially underlying the strings but not on the frets.

2. The indicators as claimed in claim 1, wherein the fingerboard is connected to a neck and the indicators are on the neck of the instrument.

3. The indicators as claimed in claim 1, wherein the indicators are on at least one string of the instrument.

4. The indicators as claimed in claim 1, wherein the fingerboard is connected to a neck with a binding and the indicators are on the binding.

5. The indicators as claimed in claim 1, wherein the instrument has frets and the indicators are on the frets.

6. The indicators as claimed in claim 5, wherein the string that is held down against the fingerboard to produce one pitch touches the indicator corresponding to that pitch when the string is held down against the fingerboard.

7. The indicators as claimed in claim 1, wherein the indicators are on the fingerboard of the instrument.

8. The indicators as claimed in claim 5, wherein the string that is held down against the fingerboard to produce one pitch touches the indicator corresponding to that pitch when the string is held down against the fingerboard.

9. The indicators as claimed in claim 1, wherein the instrument is fretted.

10. The indicators as claimed in claim 1, wherein the instrument is a guitar.

11. The indicators as claimed in claim 1, wherein the instrument is unfretted.

12. The indicators as claimed in claim 1, wherein the instrument is a violin.

13. The indicators as claimed in claim 1, wherein the instrument is a viola, a cello, a double bass, a banjo, a dobro, a lute, a mandolin, or a ukulele.

14. The indicators as claimed in claim 1, wherein the first, second, third, fourth, fifth, sixth, seventh, eighth, ninth, tenth, eleventh, and twelfth indicators are different from each other.

15. The indicators as claimed in claim 1, wherein the first, second, third, fourth, fifth, sixth, seventh, eighth, ninth, tenth, eleventh, and twelfth indicators are each a different color.

16. The indicators as claimed in claim 1, wherein the first indicator is "A", the second indicator is "A♯", the third indicator is "B", the fourth indicator is "C", the fifth indicator is "C♯", the sixth indicator is "D", the seventh indicator is "D♯", the eighth indicator is "E", the ninth indicator is "F", the tenth indicator is "F♯", the eleventh indicator is "G", and the twelfth indicator is "G♯".

17. The indicators as claimed in claim 1, wherein the first, second, third, fourth, fifth, sixth, seventh, eighth, ninth, tenth, eleventh, and twelfth indicators are each a different shape.

18. The indicators as claimed in claim 1, wherein the first, third, fourth, sixth, eighth, ninth, and eleventh indicators are different from each other and different from the second, fifth, seventh, tenth, and twelfth indicators; and the second, fifth, seventh, tenth, and twelfth indicators are not different from each other.

19. The indicators as claimed in claim 1, wherein the first indicator is "A", the third indicator is "B", the fourth indicator is "C", the sixth indicator is "D", the eighth indicator is "E", the ninth indicator is "F", the eleventh indicator is "G", and the second, fifth, seventh, tenth, and twelfth indicators are black.

20. The indicators as claimed in claim 1, wherein the first, third, fourth, sixth, eighth, ninth, and eleventh indicators are different from the second, fifth, seventh, tenth, and twelfth indicators; the first, third, fourth, sixth, eighth, ninth, and eleventh indicators are not different from each other; and the second, fifth, seventh, tenth, and twelfth indicators are not different from each other.

21. The indicators as claimed in claim 1, wherein the first, third, fourth, sixth, eighth, ninth, and eleventh indicators are white, and the second, fifth, seventh, tenth, and twelfth indicators are black.

22. The indicators as claimed in claim 1, wherein the first, third, fourth, sixth, eighth, ninth, and eleventh indicators are a color, and the second, fifth, seventh, tenth, and twelfth indicators are a different color.

23. The indicators as claimed in claim 1, wherein the first, third, fourth, sixth, eighth, ninth, and eleventh indicators are rectangles, and the second, fifth, seventh, tenth, and twelfth indicators are larger rectangles.

24. The indicators as claimed in claim 1, wherein the first, third, fourth, sixth, eighth, ninth, and eleventh indicators are smooth, and the second, fifth, seventh, tenth, and twelfth indicators are rough.

25. The indicators as claimed in claim 1, wherein the first, third, fourth, sixth, eighth, ninth, and eleventh indicators are hot, and the second, fifth, seventh, tenth, and twelfth indicators are cold.

26. The indicators as claimed in claim 1, wherein the indicators are decals, paint, stained wood, or tiles.

27. A stringed musical instrument having a fingerboard for use by a musician and at least one string disposed thereon vibrated by the musician, the instrument comprising:

first and second indicators representing notes repeated in a pattern corresponding to a chromatic scale;

wherein the pattern is disposed on the fingerboard but not on a fret;

wherein the at least one string is disposed overlying the pattern; and wherein holding the string against one of the first and second indicators and vibrating the string generate a tone with a frequency corresponding to one of the notes of the chromatic scale.

28. The stringed musical instrument of claim 27, wherein the instrument includes twelve first and second indicators corresponding to twelve notes of the chromatic scale.

29. The stringed musical instrument of claim 27, wherein the notes of the chromatic scale include A, A♯, B, C, C♯, D, D♯, E, F, F♯, G, G♯.

30. The stringed musical instrument of claim 27, wherein the pattern includes the first indicator, the second indicator, the first indicator, the second indicator, the first indicator, the second indicator, the first indicator, the first indicator, the second indicator, the first indicator, the second indicator, the first indicator.

31. The stringed musical instrument of claim 27, wherein the pattern corresponds to at least an octave of black and white keys of a keyboard musical instrument.

32. The stringed musical instrument of claim 27, wherein the musical instrument includes a plurality of strings and a plurality of patterns with each string overlying each pattern.

33. A stringed musical instrument having a fingerboard and at least one string disposed thereon and fastened at opposite ends to permit vibration thereof by contact of a musician, the instrument comprising:

first and second indicators representing notes repeated in a pattern corresponding to a chromatic scale;

wherein the pattern is disposed on the fingerboard but not on a fret;

wherein the at least one string is disposed overlying the pattern;

wherein when the musician holds the string against the first indicator and vibrates the string, the string vibrates at a frequency corresponding to a first note of the chromatic scale; and wherein when the musician holds the string against the second indicator and vibrates the string, the string vibrates at a frequency corresponding to a second note of the chromatic scale.

34. A stringed musical instrument of claim 33, wherein the instrument includes six strings and six patterns wherein each string overlies each pattern.

* * * * *

UNITED STATES PATENT AND TRADEMARK OFFICE

CERTIFICATE OF CORRECTION

PATENT NO. : 5,977,462
DATED : November 2, 1999
INVENTOR(S) : Aaron William Wolfson It is certified that error appears in the above-identified patent and that said Letters Patent is hereby corrected as shown below:

Specification,
Delete columns 1 - 24 and substitute the attached columns 1 - 24 as shown on the attached pages.

Signed and Sealed this

Tenth Day of September, 2002

*Attest:*

*Attesting Officer*

JAMES E. ROGAN
*Director of the United States Patent and Trademark Office*

INDICATORS FOR A STRINGED MUSICAL INSTRUMENT

BACKGROUND

Some stringed musical instruments (e.g., violin, viola, cello, and double bass) have no indicators on the fingerboard, the neck, the binding, or the strings to indicate which pitch will be produced if a player plucks a string while holding down a portion of the string against the fingerboard. Fretted stringed instruments (e.g., the guitar) may have dot markings to indicate the fret positions. However, stringed instruments having a fingerboard with strings stretched over the fingerboard do not have indicators on a portion of the instrument to differentiate the twelve notes of a chromatic scale (A; A♯, which is equivalent to B♭; B; C; C♯, which is equivalent to D♭; D; D♯, which is equivalent to E♭; E; F; F♯, which is equivalent to G♭; G; and G♯, which is equivalent to A♭). Furthermore, such stringed instruments lack the demarcations (e.g., the familiar black-and-white pattern) of a piano keyboard.

SUMMARY

The invention includes indicators for a portion of a fretted or unfretted stringed musical instrument having a fingerboard and one or more strings stretched above the fingerboard. The indicators comprise: (1) one first indicator for one string or more than one first indicator for one-or more strings, each first indicator being associated with one string, each first indicator indicating where the associated string should be held down against the fingerboard to produce the pitch A when the string is plucked or bowed; (2) one second indicator for one string or more than one second indicator for one or more strings, each second indicator being associated with one string, each second indicator indicating where the associated string should be held down against the fingerboard to produce the pitch A♯ when the string is plucked or bowed; (3) one third indicator for one string or more than one third indicator for one or more strings, each third indicator being associated with one string, each third indicator indicating where the associated string should be held down against the fingerboard to produce the pitch B when the string is plucked or bowed; (4) one fourth indicator for one string or more than one fourth indicator for one or more strings, each fourth indicator being associated with one string, each fourth indicator indicating where the associated string should be held down against the fingerboard to produce the pitch C when the string is plucked or bowed; (5) one fifth indicator for one string or more than one fifth indicator for one or more strings, each fifth indicator being associated with one string, each fifth indicator indicating where the associated string should be held down against the fingerboard to produce the pitch C♯ when the string is plucked or bowed; (6) one sixth indicator for one string or more than one sixth indicator for one or more strings, each sixth indicator being associated with one string, each sixth indicator indicating where the associated string should be held down against the fingerboard to produce the pitch D when the string is plucked or bowed; (7) one seventh indicator for one string or more than one seventh indicator for one or more strings, each seventh indicator being associated with one string, each seventh indicator indicating where the associated string should be held down against the fingerboard to produce the pitch D♯ when the string is plucked or bowed; (8) one eighth indicator for one string or more than one eighth indicator for one or more strings, each eighth indicator being associated with one string, each eighth indicator indicating where the associated string should be held down against the fingerboard to produce the pitch E when the string is plucked or bowed; (9) one ninth indicator for one string or more than one ninth indicator for one or more strings, each ninth indicator being associated with one string, each ninth indicator indicating where the associated string should be held down against the fingerboard to produce the pitch F when the string is plucked or bowed; (10) one tenth indicator for one string or more than one tenth indicator for one or more strings, each tenth indicator being associated with one string, each tenth indicator indicating where the associated string should be held down against the fingerboard to produce the pitch F♯ when the string is plucked or bowed; (11) one eleventh indicator for one string or more than one eleventh indicator for one or more strings, each eleventh indicator being associated with one string, each eleventh indicator indicating where the associated string should be held down against the fingerboard to produce the pitch G when the string is plucked or bowed; and (12) one twelfth indicator for one string or more than one twelfth indicator for one or more strings, each twelfth indicator being associated with one string, each twelfth indicator indicating where the associated string should be held down against the fingerboard to produce the pitch G♯. The indicators may be decals, paint, or tiles.

The features, aspects, and advantages of the present invention will become better understood with regard to the following description, appended claims, and accompanying drawings. All of this is presented by way of example only and not limitation, obvious modifications being understood to be a portion of this document.

BRIEF DESCRIPTION OF THE DRAWINGS

FIG. 1 shows a perspective view of a standard guitar.

FIG. 2 shows a top plan view of a standard guitar with the strings omitted.

FIG. 3 shows a side view of a standard guitar.

FIG. 4 shows a top plan view of a standard violin.

FIG. 5 shows a standard piano keyboard.

FIG. 6*a* is a top plan view of the fingerboard of the present invention, the nut, and the twenty-four frets of a six-string guitar.

FIG. 6*b* is a top plan view of the another embodiment of the guitar fingerboard of the present invention with twenty-four frets and six strings stretched over the fingerboard.

FIG. 6*c* shows a top plan view of the guitar fingerboard of the present invention without the six strings.

FIG. 7*a* is a top plan view of the fingerboard of the present invention, the nut, and the twenty-four frets of a four-string bass guitar.

FIG. 7*b* shows a top plan view of another embodiment of the bass-guitar fingerboard of the present invention with the four strings.

FIG. 8*a* is a top plan view of the fingerboard of the present invention for a violin.

FIG. 8*b* is a top plan view of a violin incorporating the fingerboard from FIG. 8*a*.

FIG. 8*c* shows a top plan view of a violin with another embodiment of the fingerboard of the present invention.

FIG. 9*a* shows a top plan view of the frets of the present invention and the fingerboard for a six-string guitar.

FIG. 9*b* shows a top plan view of the another embodiment of the frets of the present invention for a six-string guitar.

FIG. 10*a* shows a top plan view of the strings of the present invention for a six-string guitar.

FIG. 10*b* shows a top plan view of another embodiment of the strings of the present invention for a six-string guitar.

FIG. 11*a* shows a top plan view of the strings of the present invention for a violin.

FIG. 11*b* shows a top plan view of another embodiment of the strings of the present invention for a violin.

FIG. 12 shows a side view of a six-string guitar with the binding of the present invention.

FIG. 13 shows how black and white tiles can be fitted together to form the fingerboard of the present invention.

DETAILED DESCRIPTION

Stringed musical instruments may be divided into two categories: (1) instruments such as a guitar, a bass guitar, a violin, a viola, a cello, a double bass, a banjo, a dobro, a lute, a mandolin, and a ukulele, where the player touches the strings directly; and (2) instruments such as a piano, a pianoforte, a fortepiano, and a harpsichord, where the player does not touch the strings directly. Examples of two instruments from the first category are shown in FIGS. 1–4. FIG. 1 shows a perspective view of a standard guitar; FIG. 2 shows a top plan view of a standard guitar with the strings omitted; FIG. 3 shows a side view of a standard guitar; and FIG. 4 shows a top plan view of a standard violin.

Instruments from the first category generally may comprise a body 1 (FIGS. 1–3) or 1' (FIG. 4); a head 2 (FIGS. 1–3) or 2' (FIG. 4); a neck 3 (FIGS. 1–3) or 3' (FIG. 4) connecting the head 2 or 2' and the body 1 or 1'; and strings 4 (FIGS. 1–3) or 4' (FIG. 4) connected to the head 2 or 2' and to the body 1 or 1'. The top side of the neck 3 or 3' comprises a fingerboard 8 (FIGS. 1–3) or 8' (FIG. 4). A nut 5 (FIGS. 1–3) or 5' (FIG. 4) engages the strings 4 or 4' and is located on the neck 3 or 3', immediately adjacent to the head 2 or 2'. A bridge 6 (FIGS. 1–3) or 6' (FIG. 4) engages the strings 4 or 4' and is located on the body 1 or 1'. The strings 4 or 4' stretch from the head 2 or 2' to the body 1 or, 1' and engage the nut 5 or 5' and the bridge 6 or 6' without engaging anything between the nut 5 or 5' and the bridge 6 or 6'.

Instruments from the first category may be divided into two classes: (1) fretted instruments such as a guitar, a bass guitar, a banjo, a dobro, a lute, a mandolin, and a ukulele; and (2) unfretted instruments such as a violin, a viola, a cello, and a double bass. Fretted instruments have frets 7 on their necks 3, the tops of the frets 7 being raised above the fingerboard 8, as illustrated in FIGS. 1–3. For example the standard guitar shown in FIGS. 1–3 has 24 frets: a first fret 7A, a second fret 7B, a third fret 7C, a fourth fret 7D, a fifth fret 7E, a sixth fret 7F, a seventh fret 7G, and eighth fret 7H, a ninth fret 7I, a tenth fret 7J, an eleventh fret 7K, a twelfth fret 7L, a thirteenth fret 7M, a fourteenth fret 7N, a fifteenth fret 70, a sixteenth fret 7P, a seventeenth fret 7Q, an eighteenth fret 7R, a nineteenth fret 7S, a twentieth fret 7T, a twenty-first fret 7U, a twenty-second fret 7V, a twenty-third fret 7W, and a twenty-fourth fret 7X. Unfretted instruments have no frets.

A player can play a stringed instrument from the first category by bowing the strings 4 or 4' with a bow or plucking the strings with a pick or a finger. The portion of the string 4 or 4' that is plucked or bowed is between the nut 5 or 5' and the bridge 6 or 6' and generally is the portion that is stretched over the body 1 or 1' of the instrument. When a string 4 or 4' is plucked or bowed, a portion (hereinafter referred to as the "vibrating portion") of the string 4 or 4' vibrates and produces a pitch. The pitch depends upon the length of the vibrating portion, the composition and the thickness of the string 4 or 4', and the tension of the string 4 or 4'. For a string 4 or 4' with a particular composition, thickness, and tension, the pitch can be increased by decreasing the length of the vibrating portion; and the pitch can be decreased by increasing the length of the vibrating portion. Thus, each string 4 or 4' can produce a variety of pitches if the player changes the length of the vibrating portion. The length of the vibrating portion can be changed if a portion of the string 4 or 4' that is over the fingerboard 8 or 8' of the instrument is held down against the fingerboard 8 or 8' by the player's finger while the string 4 or 4' is plucked or bowed. The vibrating portion of the string 4 or 4' is longest when the portion of the string 4 or 4' that is over the fingerboard 8 or 8' of the instrument is not held down against the fingerboard 8 or 8' by the player's finger. In this instance, the length of the vibrating portion of the string 4 or 4' extends from the bridge 6 or 6' to the nut 5 or 5'. The vibrating portion of the string 4 or 4' is shortened when the portion of the string 4 or 4' that is over the fingerboard 8 or 8' of the instrument is held down against the fingerboard 8 or 8' by a player's finger. To vary the length of the vibrating portion of the string 4 or 4', a player can hold the string 4 or 4' down against the fingerboard 8 or 8' at various points along the fingerboard 8 or 8'.

When a player plucks or bows a string 4' while holding down a portion of the string 4' against the fingerboard 8' of an unfretted instrument, the vibrating portion of the string 4' extends from the bridge 6' to the player's finger that is holding down the string 4'. The length of the vibrating portion of the string 4' can be decreased and the resulting pitch produced by the string 4' can be increased by moving the finger that is holding down the string 4' closer to the bridge 6'. The length of the vibrating portion of the string 4' can be increased and the resulting pitch produced by the string 4' can be decreased by moving the finger that is holding down the string 4' closer to the nut 5'. Standard unfretted instruments have no indicators on the fingerboard 8', the neck 3' or on the strings 4' to indicate which pitch will be produced if a player plucks or bows a string 4' while holding down a portion of the string 4' against the fingerboard 8'.

When a player's finger holds down a string 4 against the fingerboard 8 of a fretted instrument, the string 4 is engaged by the fret 7 that is located between the bridge 6 and the player's finger and that is closest to the player's finger. Hereinafter, the fret that engages the string 4 will be referred to as the "engaging fret." When a player plucks a string 4 while holding down a portion of the string 4 against the fingerboard 8 of a fretted instrument, the vibrating portion of the string 4 extends from the bridge 6 to the engaging fret 7. The length of the vibrating portion of the string 4 can be decreased and the resulting pitch produced by the string 4 can be increased by moving the finger that is holding down the string 4 closer to the bridge 6 so that a fret 7 that is closer to the bridge 6 engages the string. The length of the vibrating portion of the string 4 can be increased and the resulting pitch produced by the string 4 can be decreased by moving the finger that is holding down the string 4 closer to the nut 5 so that a fret 7 that is closer to the nut 5 engages the string.

When a player plucks a string 4 while holding down a portion of the string 4 against the fingerboard 8 between the nut 5 and the first fret 7A of a fretted instrument, the first fret 7A is the engaging fret; and the pitch produced is one half step higher than the pitch that is produced when the string 4 is plucked and is not held down against the fingerboard 8. When a player plucks the string 4 while holding down a portion of the string 4 against the fingerboard 8 between the first fret 7A and the second fret 7B, the second fret 7B is the engaging fret; and the pitch produced is one half step higher than the pitch that is produced when the first fret 7A is the engaging fret. When a player plucks the string 4 while holding down a portion of the string 4 against the fingerboard 8 between the second fret 7B and the third fret 7C, the third fret 7C is the engaging fret; and the pitch produced is one half step higher than the pitch that is produced when the second fret 7B is the engaging fret.

When the fourth fret 7D is the engaging fret, the pitch produced is one half step higher than the pitch produced when the third fret 7C is the engaging fret. When the fifth fret 7E is the engaging fret, the pitch produced is one half step higher than the pitch produced when the fourth fret 7D is the engaging fret. When the sixth fret 7F is the engaging fret, the pitch produced is one half step higher than the pitch produced when the fifth fret 7E is the engaging fret. When the seventh fret 7G is the engaging fret, the pitch produced is one half step higher than the pitch produced when the sixth fret 7P is the engaging fret. When the eighth fret 7H is the engaging fret, the pitch produced is one half step higher than the pitch produced when the seventh fret 7G is the engaging fret. When the ninth fret 7I is the engaging fret, the pitch produced is one half step higher than the pitch produced when the eighth fret 7H is the engaging fret. When the tenth fret 7J is the engaging fret, the pitch produced is one half step higher than the pitch produced when the ninth fret 7I is the engaging fret. When the eleventh fret 7K is the engaging fret, the pitch produced is one half step higher than the pitch produced when the tenth fret 7J is the engaging fret. When the twelfth fret 7L is the engaging fret, the pitch produced is one half step higher than the pitch produced when the eleventh fret 7K is the engaging fret. When the thirteenth fret 7M is the engaging fret, the pitch produced is one half step higher than the pitch produced when the twelfth fret 7L is the engaging fret. When the fourteenth fret 7N is the engaging fret, the pitch produced is one half step higher than the pitch produced when the thirteenth fret 7M is the engaging fret. When the fifteenth fret 7O is the engaging fret, the pitch produced is one half step higher than the pitch produced when the fourteenth fret 7N is the engaging fret. When the sixteenth fret 7P is the engaging fret, the pitch produced is one half step higher than the pitch produced when the fifteenth fret 7O is the engaging fret. When the seventeenth fret 7Q is the engaging fret, the pitch produced is one half step higher than the pitch produced when the sixteenth fret 7P is the engaging fret. When the eighteenth fret 7R is the engaging fret, the pitch produced is one half step higher than the pitch produced when the seventeenth fret 7Q is the engaging fret. When the nineteenth fret 7S is the engaging fret, the pitch produced is one half step higher than the pitch produced when the eighteenth fret 7R is the engaging fret. When the twentieth fret 7T is the engaging fret, the pitch produced is one half step higher than the pitch produced when the nineteenth fret 7S is the engaging fret. When the twenty-first fret 7U is the engaging fret, the pitch produced is one half step higher than the pitch produced when the twentieth fret 7T is the engaging fret. When the twenty-second fret 7V is the engaging fret, the pitch produced is one half step higher than the pitch produced when the twenty-first fret 7U is the engaging fret. When the twenty-third fret 7W is the engaging fret, the pitch produced is one half step higher than the pitch produced when the twenty-second fret 7V is the engaging fret. When the twenty-fourth fret 7X is the engaging fret, the pitch produced is one half step-higher than the pitch produced when the twenty-third fret 7W is the engaging fret.

Except for the first fret 7A and the twenty-fourth fret 7X, which each have only one immediately adjacent fret (7B and 7W, respectively), all of the frets 7 have two immediately adjacent frets 7, one of which is closer to the bridge 6 and one of which is farther from the bridge 6. The pitch is increased by one half step when the engaging fret 7 is changed to the immediately adjacent fret 7 that is closer to the bridge 6. The pitch is decreased by one half step when the engaging fret 7 is changed to the immediately adjacent fret 7 that is farther from the bridge 6.

A standard fretted instrument may have demarcations on the fingerboard 8 and/or on the binding 9 to identify adjacent frets 7. As shown in FIGS. 1–3, the standard guitar may have: a dot 10A on the fingerboard 8 and a dot 11A on the binding 9 between the second fret 7B and the third fret 7C; a dot 10B on the fingerboard 8 and a dot 11B on the binding 9 between the fourth fret 7D and the fifth fret 7E; a dot 10C on the fingerboard 8 and a dot 11C on the binding 9 between the sixth fret 7F and the seventh fret 7G; a dot 10D on the fingerboard 8 and a dot 11D on the binding 9 between the eighth fret 7H and the ninth fret 7I; two dots 12A on the fingerboard 8 and two dots 13A on the binding 9 between the eleventh fret 7K and the twelfth fret 7L; a dot 10E on the fingerboard 8 and a dot 11E on the binding 9 between the fourteenth fret 7N and the fifteenth fret 7O; a dot 10F on the fingerboard 8 and a dot 11F on the binding 9 between the sixteenth fret 7P and the seventeenth fret 7Q; a dot 10G on the fingerboard 8 and a dot 11G on the binding 9 between the eighteenth fret 7R and the nineteenth fret 7S; a dot 10H on the fingerboard 8 and a dot 11H on the binding 9 between the twentieth fret 7T and the twenty-first fret 7U; and two dots 12B on the fingerboard 8 and two dots 13B on the binding 9 between the twenty-third fret 7W and the twenty-fourth fret 7X. The two dots 12A indicate that when the string 4 is held down against the fingerboard 8 between the eleventh fret 7K and the twelfth fret 7L so that the twelfth fret 7L is the engaging fret, the pitch produced when the string 4 is plucked is one octave higher than the pitch produced when the string 4 is plucked and is not held down against the fingerboard 8. The two dots 12B indicate that when the string 4 is held down against the fingerboard 8 between the twenty-third fret 7W and the twenty-fourth fret 7X so that the twenty-fourth fret 7X is the engaging fret, the pitch produced when the string 4 is plucked is two octaves higher than the pitch produced when the string 4 is plucked and is not held down against the fingerboard 8. Otherwise, standard fretted instruments generally have no indicators on the fingerboard 8, the neck 3, the binding 9, or the strings 4 to indicate which pitch will be produced if a player plucks a string 4 while holding down a portion of the string 4 against the fingerboard 8.

A chromatic scale comprises, twelve half steps: A; A♯, which is equivalent to B♭; B; C; C♯, which is equivalent to D♭; D; D♯, which is equivalent to E♭; E; F; F♯, which is equivalent to G♭; G; and G♯, which is equivalent to A♭. This sequence of twelve steps can be repeated at various octaves. FIG. 5 represents a standard piano keyboard.

In FIG. 5, the keys corresponding to the twelve half steps of the chromatic scale are labelled to indicate the various octaves. The chromatic scale at the lowest octave is: A1, A♯1, B1, C1, C♯1, D1, D♯1, E1, F1, F♯1, G1, and G♯1. The chromatic scale at the next highest octave is: A2, A♯2, B2, C2, C♯2, D2, D♯2, E2, F2, F♯2, G2, and G♯2. The chromatic scale at the next highest octave is: A3, A♯3, B3, C3, C♯3, D3, D♯3, E3, F3, F♯3, G3, and G♯3. The chromatic scale at the next highest octave is: A4, A♯4, B4, C4, C♯4, D4, D♯4, E4, F4, F♯4, G4, and G♯4. The chromatic scale at the next highest octave is: A5, A♯5, B5, C5, C♯5, D5, D♯5, E5, F5, F♯5, G5, and G♯5. The chromatic scale at the next highest octave is:

A6, A♯6, B6, C6, C♯6, D6, D♯6, E6, F6, F♯6, G6, and G♯6. The chromatic scale at the next highest octave is: A7, A♯7, B7, C7, C♯7, D7, D♯7, E7, F7, F♯7, G7, and G♯7. The partial chromatic scale at the next highest octave is:. A8, A♯8, B8, and C8.

Unlike a piano, where the keys corresponding to the pitches A, B, C, D, E, F, and G have one color (usually a light color such as white) and the keys corresponding to the pitches A♯, C♯, D♯, F♯, and G♯ have a different color (usually a dark color such as black), standard fretted and unfretted stringed instruments have no such demarcations to differentiate the pitches produced by the strings. In one embodiment of the present invention, the demarcations of a piano keyboard are adapted for fretted and unfretted stringed instruments. In another embodiment of the present invention, fretted and unfretted stringed instruments have a different demarcation for each of the twelve pitches of the chromatic scale. In another embodiment of the present invention, fretted and unfretted stringed instruments have a different demarcation for each of the seven pitches A, B, C, D, E, F, and G and a single separate demarcation (e.g., black) for all five of the pitches A♯, C♯, D♯, F♯, and G♯. These embodiments and others are described in greater detail below and in the corresponding figures. In the figures, the same or generally similar elements are labelled with the same reference numerals; and analogous elements are labelled with analogous reference numerals.

When the strings 4 of a standard six-string guitar, such as the one shown in FIGS. 1–3, are plucked without being held down against the fingerboard 8, the sixth string 4E2 produces the pitch E2; the fifth string 4A3 produces the pitch A3; the fourth string 4D3 produces the pitch D3; the third string 4G3 produces the pitch G3; the second string 4B4 produces the pitch B4; and the first string 4E4 produces the pitch E4.

FIG. 6*a* is a top plan view of the fingerboard 108*a*, the nut 5, and the twenty-four frets (7A through 7X) of a six-string guitar. The fingerboard 108*a* has a column of twenty-five generally rectangular areas for each of the six strings 4. The first column 126 corresponds to the sixth string 4E2; the second column 125 corresponds to the fifth string 4A3; the third column 124 corresponds to the fourth string 4D3; the fourth column 123 corresponds to the third string 4G3; the fifth column 122 corresponds to the second string 4B4; and the first column 121 corresponds to the first string 4E4. The twenty-five generally rectangular areas in each column indicate where the corresponding string 4 should be held down against the fingerboard 108*a* to produce the particular pitches shown in FIG. 6*a* when the string 4 is plucked.

FIG. 6*b* is a top plan view of a preferred embodiment of the present invention having twenty-four frets and six strings stretched over the fingerboard 108*b*. A pattern of indicators is laid out on the fingerboard 108*b* with each string 4E2, 4A3, 4D3, 4G3, 4B4, or 4E4, overlying each pattern of generally alternating black and white squares. In other words, looking along the length of a single string 4E2, 4A3, 4D3, 4G3, 4B4, or 4E4, the black and white squares sequentially repeat, so when seen from one end of the string at nut 5 to the opposite bridge end, a pattern of black and white squares immediately beneath that string becomes apparent. The pattern corresponds to the notes of a chromatic scale. To be sure, the black and white squares forming the pattern coincide to the black and white arrangement of keys on a conventional piano. Also noticeable in the plan view of FIG. 6*b* is that the pattern of black and white squares changes from one string to the next string. Twenty-four frets 7A through 7X of the six-string guitar are also shown.

FIG. 7*a* is a top plan view of the fingerboard 208*a*, the nut 5, and the twenty-four frets (7A through 7X) of a four-string bass guitar. The four strings 4 of a bass guitar are shown in FIG. 7*b*, but not in FIG. 7*a*. When the strings 4 of a four-string bass guitar are plucked without being held down against the fingerboard 208*a* (FIG. 7*a*) or 208*b* (FIG. 7*b*), the fourth string 4E1 produces the pitch E1; the third string 4A2 produces the pitch A3; the second string 4D2 produces the pitch D3; and the first string 4G2 produces the pitch G2. The fingerboard 208*a* has a column of twenty-five generally rectangular areas for each of the four strings 4. The fourth column 224 corresponds to the fourth strings 4E1; the third column 222 corresponds to the third string 4A2; the second column 222 corresponds to the second string 4D2; and the first column 221 corresponds to the first string 4G2. The twenty-five generally rectangular areas in each column indicate where the corresponding string 4 should be held down against the fingerboard 208*a* to produce the particular pitches shown in FIG. 7*a* when the string 4 is plucked.

FIG. 8*a* is a top plan view of the fingerboard 308*a* and the nut 5' of a four-string violin. FIG. 8*b* is a top plan view of a violin incorporating the fingerboard 308*a*. FIG. 8*b* shows that the violin comprises the body 1'; the head 2'; the neck 3' connecting the body 1' and the head 2'; the bridge 6' on the body 1'; and the four strings 4'G3, 4'D4, 4'A5, and 4'E5. When the strings 4' of a violin are plucked or bowed without being held down against the fingerboard 8' (FIG. 4), 308*a* (FIGS. 8*a* and 8*b*), or 308*b* (FIG. 8*c*), the fourth string 4'G3 produces the pitch G3; the third string 4'D4 produces the pitch D4; the second string 4'A5 produces the pitch A5; and the first string 4'E5 produces the pitch E5. The fingerboard 308*a* has a column of twenty-eight generally rectangular areas for each of the four strings 4'. The fourth column 324 corresponds to the fourth string 4'G3; the third column 323 corresponds to the third string 4'D4; the second column 322 corresponds to the second string 4'A5; and the first column 321 corresponds to the first string 4'E5. The twenty-eight generally rectangular areas in each column indicate where the corresponding string 4' should be held down against the fingerboard 308*a* to produce the particular pitches shown in FIG. 8*a* when the string 4' is plucked or bowed. Each generally rectangular area has a side that is closest to the nut 5' and a side that is closest to the bridge 6'; and the string 4' generally should be held down against the fingerboard 308*a* midway between these two sides to produce the pitch associated with that rectangular area. The pitch can be decreased if the finger holding down the string 4' in the rectangular area is moved toward the side of the rectangular area that is closest to the nut 5'. The pitch can be increased if the finger holding down the string 4' in the rectangular area is moved toward the side of the rectangular area that is closest to the bridge 6'.

FIG. 9*a* is a top plan view of the fingerboard 8 and the twenty-four frets (7A' through 7X') of a six-string guitar. Each fret 7A' through 7X' is divided into six generally rectangular areas. The generally rectangular areas form six columns with twenty-four generally rectangular areas in each column. The first column 426 corresponds to the sixth string 4E2; the fifth column 425 corresponds to the fifth string 4A3; the fourth column 424 corresponds to the fourth string 4D3; the third column 423 corresponds to the third string 4G3; the second column 422 corresponds to the second string 4B4; and the first column 421 corresponds to the first string 4E4. (In order to provide an unobstructed view of the frets 7A' through 7X', the strings 4 are omitted from FIG. 9*a*.) The twenty-four generally rectangular areas in each column indicate where the corresponding string 4 should be help down against the fingerboard 8 to produce the particular pitches shown in FIG. 9*a* when the string 4 is plucked. For example, the generally rectangular areas on the second fret 7B' are labelled with the pitches F♯2, B3, E3, A4, C♯4, and F♯4 to indicate that:

(1) the string 4E2 produces the pitch F♯2 when the string 4E2 is plucked while being held down against the fingerboard 8 between the first fret 7A' and the second fret 7B';

(2) the string 4A3 produces the pitch B3 when the string 4A3 is plucked while being held down against the fingerboard 8 between the first fret 7A' and the second fret 7B';

(3) the string 4D3 produces the pitch E3 when the string 4D3 is plucked while being held down against the fingerboard 8 between the first fret 7A' and the second fret 7B';

(4) the string 4G3 produces the pitch A4 when the string 4G3 is plucked while being held down against the fingerboard 8 between the first fret 7A' and the second fret 7B';

(5) the string 4B4 produces the pitch C♯4 when the string 4B4 is plucked while being held down against the fingerboard 8 between the first fret 7A' and the second fret 7B'; and (6) the string 4E4 produces the pitch F♯4 when the string 4E4 is plucked while being held down against the fingerboard 8 between the first fret 7A' and the second fret 7B'.

FIG. 10*a* is a top plan view of the strings for a six-string guitar. When the strings shown in FIG. 10*a* are used on a six-string guitar and are plucked without being held down against the fingerboard 8, the sixth string 104E2 produces the pitch E2; the fifth string 104A3 produces the pitch A3; the fourth string 104D3 produces the pitch D3; the fifth string 104G3 produces the pitch G4; the fifth string 104B4 produces the pitch B4; and the first string 104E4 produces the pitch E4. When the sixth string 104E2 is used on a six-string guitar, the generally rectangular region 5E2 on the sixth string 104E2 should be generally positioned on top of the nut 5; and the twenty-four generally rectangular regions 7AE2 through 7XE2 should be positioned above the frets 7A through 7X, respectively. When the fifth string 104A3 is used on a six-string guitar, the generally rectangular region 5A3 on the fifth string 104A3 should be generally positioned on top of the nut 5; and the twenty-four generally rectangular regions 7AA3 through 7XA3 should be positioned above the frets 7A through 7X, respectively. When the fourth string 104D3 is used on a six-string guitar, the generally rectangular region 5D3 on the fourth string 104D3 should be generally positioned on top of the nut 5; and the twenty-four generally rectangular regions 7AD3 through 7XD3 should be positioned above the frets 7A through 7X, respectively. When the third string 104G3 is used on a six-string guitar, the generally rectangular region 5G3 on the third string 104G3 should be generally positioned on top of the nut 5; and the twenty-four generally rectangular regions 7AG3 through 7XG3 should be positioned above the frets 7A through 7X, respectively. When the second string 104B4 is used on a six-string guitar, the generally rectangular region 5B4 on the second string 104B4 should be generally positioned on top of the nut 5; and the twenty-four generally rectangular regions 7AB4 through 7XB4 should be positioned above the frets 7A through 7X, respectively. When the first string 104E4 is used on a six-string guitar, the generally rectangular region 5E4 on the first string 104E4 should be generally positioned on top of the nut 5; and the twenty-four generally rectangular regions 7AE4 through 7XE4 should be positioned above the frets 7A through 7X, respectively. Each string shown in FIG. 10*a* has twenty-five remaining generally rectangular areas. These twenty-five generally rectangular areas on each string indicate which part of the string should be held down against the fingerboard 8 to produce the particular pitches shown in FIG. 10*a* when the string is plucked. Thus, the rectangular area labelled "F2" on the sixth string 104E2 in FIG. 10*a* indicates that the portion of the first string 104E2 between the nut 5 and the first fret 7A should be held down against the fingerboard 8 to produce the pitch F2 when the string 104E2 is plucked. The rectangular area labelled "F♯2" on the sixth string 104E2 in FIG. 10*a* indicates that the portion of the sixth string 104E2 between the first fret 7A and the second fret 7B should be held down against the fingerboard 8 to produce the pitch F♯2 when the string 104E2 is plucked.

FIG. 11*a* is a top plan view of the strings for a violin. When the strings shown in FIG. 11*a* are used on a violin and are plucked or bowed without being held down against the fingerboard 8', the fourth string 104"G3 produces the pitch G3; the third string 104"D4 produces the pitch D4; the second string 104"A5 produces the pitch A5; and the first string 104"E5 produces the pitch E5. When the fourth string 104"G3 is used on a violin, the generally rectangular region 5"G3 on the fourth string 104"G3 should be generally positioned on top of the nut 5'. When the third string 104"D4 is used on a violin, the generally rectangular region 5"D4 on the third string 104"D4 should be generally positioned on top of the nut 5'. When the second string 104"A5 is used on a violin, the generally rectangular region 5"A5 on the second string 104"A5 should be generally positioned on top of the nut 5'. When the first string 104"E5 is used on a violin, the generally rectangular region 5"E5 on the first string 104"E5 should be generally positioned on top of the nut 5'. Each string shown in FIG. 11*a* has twenty-eight remaining generally rectangular areas. These twenty-eight generally rectangular areas on each string indicate which part of the string should be held down against the fingerboard 8' to produce the particular pitches shown in FIG. 11*a* when the string is plucked or bowed. Thus, the rectangular area labelled "A4" on the fourth string 104"G3 in FIG. 11*a* indicates the portion of the fourth string 104"G3 that should be held down against the fingerboard 8' to produce the pitch A4 when the string 104"G3 is plucked or bowed. The rectangular area labelled "A♯4" on the fourth string 104"G3 in FIG. 11*a* indicates the portion of the first string 104"G3 that should be held down against the fingerboard 8' to produce the pitch A♯4 when the string 104"G3 is plucked or bowed.

FIG. 12 is a side view of a six-string guitar having a head 2, a neck 3, a body 1, a binding 109, a sixth string 4E2, and twenty-four frets (7A through 7X). The binding 109 has twenty-five generally rectangular areas. These twenty-five generally rectangular areas on the binding 109 indicate which part of the sixth string 4E2 should be held down against the fingerboard 8 to produce the particular pitches shown in FIG. 12 when the string 4E2 is plucked. Thus, the generally rectangular area labelled "F2" on the binding 109 indicates that the portion of the sixth string 4E2 between the nut 5 and the first fret 7A should be held down against the fingerboard 8 to produce the pitch F2 when the string 4E2 is plucked. The rectangular area labelled "F♯2" on the binding 109 in FIG. 12 indicates that the portion of the sixth string 4E2 between the first fret 7A and the second fret 7B should be held down against the fingerboard 8 to produce the pitch F♯2 when the string 4E2 is plucked.

In one embodiment of the present invention, indicators are on or are an integral part of a portion (e.g. the neck; the fingerboard; the frets, if any; the nut and any frets; the bridge and any frets; the fingerboard between any frets; the binding, if any; and/or one or more strings) of a fretted or unfretted stringed musical instrument having a neck with a fingerboard and one or more strings stretched above the fingerboard, the indicators comprising: (1) one first indicator for one string or more than on first indicator for one or more strings, each first indicator being associated with one string, each first indicator indicating where the associated string should be held down against the fingerboard to produce the pitch A (e.g., A1, A2, A3, A4, A5, A6, A7, or A8) when the string is plucked or bowed; (2) one second indicator for one string or more than one second indicator for one or more strings, each second indicator being associated with one string, each second indicator indicating where the associated string should be held down against the fingerboard to produce the pitch A♯0 (e.g., A♯1, A♯2, A♯3, A♯4, A♯5, A♯6, A♯7, or A♯8) when the string is plucked or bowed; (3) one third indicator for one string or more than one third indicator for one or more strings, each third indicator being associated with one string, each third indicator indicating where the associated string should be held down against the fingerboard to produce the pitch B (e.g., B1, B2, B3, B4, B5, B6, B7, or B8) when the string is plucked or bowed; (4) one fourth indicator for one string or more than one fourth indicator for one or more strings, each fourth indicator being associated with one string, each fourth indicator indicating-where the associated string should be held down against the fingerboard to produce the pitch C (e.g., C1, C2, C3, C4, C5, C6, C7, or C8) when the string is plucked or bowed; (5) one fifth indicator for one string or more than one fifth indicator for one or more strings, each fifth indicator being associated with one string, each fifth indicator indicating where the associated string should be held down against the fingerboard to produce the pitch C♯ (e.g., C♯1, C♯2, C♯3, C♯4, C♯5, C♯6, or C♯7) when the string is plucked or bowed; (6) one sixth indicator for one string or more than one sixth indicator for one or more strings, each sixth indicator being associated with one string, each sixth indicator indicating where the associated string should be held down against the fingerboard to produce the pitch D (e.g., D1, D2, D3, D4, D5, D6, or D7) when the string is plucked or bowed; (7) one seventh indicator for one string or more than one seventh indicator for one or more strings, each seventh indicator being associated with one string, each seventh indicator indicating where the associated string should be held down against the fingerboard to produce the pitch D♯ (e.g., D♯1, D♯2, D♯3, D♯4, D♯5, D♯6, or D♯7) when the string is plucked or bowed; (8) one eighth indicator for one string or more than one eighth indicator for one or more strings, each eighth indicator being associated with one string, each eighth indicator indicating where the associated string should be held down against the fingerboard to produce the pitch E (e.g., E1, E2, E3, E4, E5, E6, or E7) when the string is plucked or bowed; (9) one ninth indicator for one string or more than one ninth indicator for one or more strings, each ninth indicator being associated with one string, each ninth indicator indicating where the associated string should be held down against the fingerboard to produce the pitch F (e.g., F1, F2, F3, F4, F5, F6, or F7) when the string is plucked or bowed; (10) one tenth indicator for one string or more than one tenth indicator for one or more strings, each tenth indicator being associated with one string, each tenth indicator indicating where the associated string should be held down against the fingerboard to produce the pitch F♯ (e.g., F♯1, F♯2, F♯3, F♯4, F♯5, F♯6, or F♯7) when the string is plucked or bowed; (11) one eleventh indicator for one string or more than one eleventh indicator for one or more strings, each eleventh indicator being associated with one string, each eleventh indicator indicating where the associated string should be held down against the fingerboard to produce the pitch G (e.g., G1, G2, G3, G4, G5, G6, or G7) when the string is plucked or bowed; and (12) one twelfth indicator for one string or more than one twelfth indicator for one or more strings, each twelfth indicator being associated with one string, each twelfth indicator indicating where the associated string should be held down against the fingerboard to produce the pitch G♯ (e.g., G♯1, G♯2, G♯3, G♯4, G♯5, G♯6, or G♯7). The first, second, third, fourth, fifth, sixth, seventh, eighth, ninth, tenth, eleventh, and twelfth indicators supplement and/or replace any standard indicators or demarcations that the instrument might have. For a fretted instrument, the twelve indicators supplement the frets. For a guitar, the indicators may supplement or replace the dots (10A through 10H, 11A through 11H, 12A, 12B, 13A, 13B).

If the indicators are on the fingerboard or the frets of a stringed instrument, the string that is held down against the fingerboard to produce a particular pitch touches the indicator corresponding to that pitch when the string is held down against the fingerboard. For example, when the string is held down against the fingerboard and plucked or bowed to produce the pitch A (e.g., A1, A2, A3, A4, A5, A6, A7, or A8), the string touches the first indicator. When the string is held down against the fingerboard and plucked or bowed to produce the pitch A♯ (e.g., A♯1, A♯2, A♯3, A♯4, A♯5, A♯6, A♯7, or A♯8), the string touches the second indicator. When the string is held down against the fingerboard and plucked or bowed to produce the pitch B (e.g., B1, B2, B3, B4, B5, B6, B7, or B8), the string touches the third indicator. When the string is held down against the fingerboard and plucked or bowed to produce the pitch C (e.g., C1, C2, C3, C4, C5, C6, C7, or C8), the string touches the fourth indicator. When the string is held down against the fingerboard and plucked or bowed to produce the pitch C♯ (e.g., C♯1, C♯2, C♯3, C♯4, C♯5, C♯6, or C♯7), the string touches the fifth indicator. When the string is held down against the fingerboard and plucked or bowed to produce the pitch D (e.g., D1, D2, D3, D4, D5, D6, or D7), the string touches the sixth indicator. When the string is held down against the fingerboard and plucked or bowed to produce the pitch D♯ (e.g., D♯1, D♯2, D♯3, D♯4, D♯5, D♯6, or D♯7), the string touches the seventh indicator. When the string is held down against the fingerboard and plucked or bowed to produce the pitch E (e.g., E1, E2, E3, E4, E5, E6, or E7), the string touches the eighth indicator. When the string is held down against the fingerboard and plucked or bowed to produce the pitch F (e.g., F1, F2, F3, F4, F5, F6, or F7), the string touches the ninth indicator. When the string is held down against the fingerboard and plucked or bowed to produce the pitch F♯ (e.g., F♯1, F♯2, F♯3, F46 4, F♯5, F♯6, or F♯7), the string touches the tenth indicator. When the string is held down against the fingerboard and plucked or bowed to produce the pitch G (e.g., G1, G2, G3, G4, G5, G6, or G7), the string touches the eleventh indicator. When the string is held down against the fingerboard and plucked or bowed to produce the pitch G♯ (e.g., G♯1, G♯2, G♯3, G♯4, G♯5, G♯6, or G♯7), the string touches the twelfth indicator.

According to the present invention, some or all of the rectangular areas in FIGS. 6*a*, 7*a*, 8*a*, 9*a*, 10*a*, 11*a*, and 12 are marked with the first, second, third, fourth, fifth, sixth, seventh, eighth, ninth, tenth, eleventh, and twelfth indicators. If all of the rectangular areas in FIGS. 6*a*, 7*a*, 8*a*, 9*a*, 10*a*, 11*a*, and 12 are marked with indicators, each rectangular area labeled "A*" (where "*" is a wild card representing any number) in the figures would be marked with the first indicator; each rectangular area labeled "A♯*" (where "*" is a wild card representing any number) in the figures would be marked with the second indicator; each rectangular area labeled "B*" (where "*" is a wild card representing any number) in the figures would be marked with the third indicator; each rectangular area labeled "C*" (where "*" is a wild card representing any number) in the figures would be marked with the fourth indicator; each rectangular area labeled "C♯*" (where "*" is a wild card representing any number) in the figures would be marked with the fifth indicator; each rectangular area labeled "D*" (where "*" is a wild card representing any number) in the figures would be marked with the sixth indicator; each rectangular area labeled "D♯*" (where "*" is a wild card representing any number) in the figures would be marked with the seventh indicator; each rectangular area labeled "E*" (where "*" is a wild card representing any number) in the figures would be marked with the eighth indicator; each rectangular area labeled "F*" (where "*" is a wild card representing any number) in the figures would be marked with the ninth indicator; each rectangular area labeled "F♯*" (where "*" is a wild card representing any number) in the figures would be marked with the tenth indicator; each rectangular area labeled "G*" (where "*" is wild card representing any number) in the figures would be marked with the eleventh indicator; and each rectangular area labeled "G♯*" (where "*" is a wild card representing any number) in the figures would be marked with the twelfth indicator. Of course, some of the rectangular areas in FIGS. 6*a*, 7*a*, 8*a*, 9*a*, 10*a*, 11*a*, and 12 may be left without indicators.

The indicators may involve any one or any combination of the following: colors or shades of colors (e.g., white, red, yellow, blue, orange, light green, violet, magenta, green, light violet, black, light blue, gray, combinations thereof, and any other suitable color); sizes (e.g., extra fine, very fine, fine, extra small, very small, small, medium-small, medium, medium-large, large, very large, extra large, or any other suitable size or combination of sizes); shapes (e.g., a square, a rectangle, a circle, a ring, an ellipse, a star, a triangle, a pentagon, a hexagon, a heptagon, an octagon, a nonagon, a decagon, or any other suitable shape or combination of shapes); alphanumeric characters (e.g., A♭, A, A♯, B♭, B, C, C♯, D♭, D, D♯, E♭, E, F, F♯, G♭, G, G♯, ♯, ♭, ♮, 1, 2, 3, 4, 5, 6, 7, 8, 9, 10, 11, 12, or any other suitable alphanumeric character or combination of alphanumeric characters); texture (e.g., smooth, rough, the various textures between smooth and rough, and any other suitable texture or combination of textures); apparent or actual temperatures (e.g., cold, hot, the various temperatures between cold and hot, and any other suitable temperature or combination of temperatures); fluorescence; different colored lights; and any other suitable characteristic that is discernable by touch and/or sight.

The first, second, third, fourth, fifth, sixth, seventh, eighth, ninth, tenth, eleventh, and twelfth indicators may be different from each other so that each of the twelve pitches (A, A♯, B, C, C♯, D, D♯, E, F, F♯, G, and G♯) of the chromatic scale has a unique indicator. For example, in FIGS. 6*a*, 7*a*, 8*a*, 9*a*, 10*a*, 11*a*, and 12, the first indicator may be light violet; the second indicator may be black; the third indicator may be light blue; the fourth indicator may be white; the fifth indicator may be red; the sixth indicator may be yellow; the seventh indicator may be blue; the eighth indicator may be orange; the ninth indicator may be light green; the tenth indicator may be violet; the eleventh indicator may be magenta; and the twelfth indicator may be green. Of course, other colors or shades of colors may be used. For example, the first indicator may be white (0% black), the second indicator may be light gray (9% black), the third indicator may be a slightly darker gray (18% black); the fourth indicator may be a slightly darker gray (27% black); the fifth indicator may be a slightly darker gray (36% black); the sixth indicator may be an even darker gray (45% black); the seventh indicator may be a darker gray (54% black); the eighth indicator may be an even darker gray (63% black); the ninth indicator may be a slightly darker gray (72% black); the tenth indicator may be a darker gray (81% black); the eleventh indicator may be a darker gray (90% black); and the twelfth indicator may be black (100% black). Alternatively, instead of twelve different colors or shades of colors, twelve different shapes could be used to differentiate the first, second, third, fourth, fifth, sixth, seventh, eighth, ninth, tenth, eleventh, and twelfth indicators from each other. In another alternative, the first indicator may be "A"; the second indicator may be "A♯"; the third indicator may be "B"; the fourth indicator may be "C"; the fifth indicator may be "C♯"; the sixth indicator may be "D"; the seventh indicator may be "D♯"; the eighth indicator may be "E"; the ninth indicator may be "F"; the tenth indicator may be "F♯"; the eleventh indicator may be "G"; and the twelfth indicator may be "G♯".

Alternatively, some of the twelve indicators may be different from each other and the remaining indicators may not be different from each other. For example, the first, third, fourth, sixth, eighth, ninth, and eleventh indicators may be different from each other and different from the second, fifth, seventh, tenth, and twelfth indicators; and the second, fifth, seventh, tenth, and twelfth indicators may not be different from each other. Thus, in FIGS. 6*a*, 7*a*, 8*a*, 9*a*, 10*a*, 11*a*, and 12, the first indicator may be light violet; the third indicator may be light blue; the fourth indicator may be white; the sixth indicator may be yellow; the eighth indicator may be orange; the ninth indicator may be light green; the eleventh indicator may be magenta; and the second, fifth, seventh, tenth, and twelfth indicators may be black. Alternatively, the first indicator may be a circle; the third indicator may be a triangle; the fourth indicator may be a hexagon; the sixth indicator may be a star; the eighth indicator may be a heptagon; the ninth indicator may be an octagon; the eleventh indicator may be a decagon; and the second, fifth, seventh, tenth, and twelfth indicators may be a square.

In another alternative, the second, fifth, seventh, tenth, and twelfth indicators may be different from each other and different from the first, third, fourth, sixth, eighth, ninth, and eleventh indicators; and the first, third, fourth, sixth, eighth, ninth, and eleventh indicators may not be different from each other. Thus, in FIGS. 6*a*, 7*a*, 8*a*, 9*a*, 10*a*, 11*a*, and 12, the second indicator may be black; the fifth indicator may be red; the seventh indicator may be blue; the tenth indicator may be violet; the twelfth indicator may be green; and the first, third, fourth, sixth, eighth, ninth, and eleventh indicators may be white.

In another alternative, the first, third, fourth, sixth, eighth, ninth, and eleventh indicators may be different from the second, fifth, seventh, tenth, and twelfth indicators; the first, third, fourth, sixth, eighth, ninth, and eleventh indicators may not be different from each other; and the second, fifth, seventh, tenth, and twelfth indicators may not be different from each other. For example, in FIGS. 6*a*, 7*a*, 8*a*, 9*a*, 10*a*, 11*a*, and 12, the first, third, fourth, sixth, eighth, ninth, and eleventh indicators may be white; and the second, fifth, seventh, tenth, and twelfth indicators may be black. In this example, the logic of the black and white piano keys is adapted for use with a stringed musical instrument, as shown in FIGS. 6*b*, 6*c*, 7*b*, 8*c*, 9*b*, 10*b*, 11*b*, and 12.

FIG. 6*b* is a top plan view of the fingerboard 108*b* of a guitar with twenty-four frets (7A through 7X) and six strings (4E2, 4A3, 4D3, 4G3, 4B4, and 4E4) stretched over the fingerboard 108*b*. In FIG. 6*b*, the first, third, fourth, sixth, eighth, ninth, and eleventh indicators are white; and the second, fifth, seventh, tenth, and twelfth indicators are black. The fingerboard 108*b* in FIG. 6*b* is derived from the fingerboard 108*a* in FIG. 6*a*. Fingerboard 108*b* is produced if the rectangular areas, of the fingerboard 108*a* corresponding to the pitch A (A3, A4, A5, and A6), the pitch B (B3, B4, B5, and B6), the pitch C (C3, C4, C5, and C6), the pitch D (D3, D4, D5, and D6), the pitch E (E3, E4, E5, and E6), the pitch F (F2, F3, F4, F5, and F6), and the pitch G (G2, G3, G4, and G5) are colored white and if the rectangular areas of the fingerboard 108*a* corresponding to the pitch $A_\sharp$ ($A_\sharp3$, $A_\sharp4$, $A_\sharp5$, and $A_\sharp6$), the pitch $C_\sharp$ ($C_\sharp3$, $C_\sharp4$, $C_\sharp5$, and $C_\sharp6$) the pitch $D_\sharp$ ($D_\sharp3$, $D_\sharp4$, $D_\sharp5$, and $D_\sharp6$), the pitch $F_\sharp$ ($F_\sharp2$, $F_\sharp3$, $F_\sharp4$, and $F_\sharp5$), and the pitch $G_\sharp$ ($G_\sharp2$, $G_\sharp3$, $G_\sharp4$ , and $G_\sharp5$) are colored black. FIG. 6*c* shows a top plan view of the fingerboard 108*b* without the strings. As can be seen in FIG. 6*c*, if two white indicators are adjacent to each other, there is no demarcation between the two indicators; and if two black indicators are adjacent to each other, there is no demarcation between the two indicators. Alternatively, the fingerboard 108*b* could be modified to include such demarcations.

FIG. 7*b* is a top plan view of the fingerboard 208*b* of a bass guitar with twenty-four frets (7A through 7X) and four strings 4E1, 4A2, 4D2, and 4G2) stretched over the fingerboard 208*b*. In FIG. 7*b*, the first, third, fourth, sixth, eighth, ninth, and eleventh indicators are white; and the second, fifth, seventh, tenth, and twelfth indicators are black. The fingerboard 208*b* in FIG. 7*b* is derived from the fingerboard 208*a* in FIG. 7*a*. Fingerboard 208*b* is produced if the rectangular areas of the fingerboard 208*a* corresponding the pitch A (A2, A3, and A4), the pitch B (B2, B3, and B4), the pitch C (C2, C3, and C4), the pitch D (D2, D3, and D4), the pitch E (E2, E3, and E4), the pitch F (F1, F2, F3, and F4), and the pitch G (G1, G2, G3, and G4) are colored white and if the rectangular areas of the fingerboard 208*a* corresponding to the pitch $A_\sharp$ ($A_\sharp2$, $A_\sharp3$, and $A_\sharp4$), the pitch $C_\sharp$ ($C_\sharp2$, $C_\sharp3$, and $C_\sharp4$) the pitch $D_\sharp$ ($D_\sharp2$, $D_\sharp3$, and $D_\sharp4$), the pitch $F_\sharp$ ($F_\sharp1$, $F_\sharp2$, $F_\sharp3$, and $F_\sharp4$), and the pitch $G_\sharp$ ($G_\sharp1$, $G_\sharp2$, $G_\sharp3$, and $G_\sharp4$) are colored black. In FIG. 7*b*, if two white indicators are adjacent to each other, there is no demarcation between the two indicators; and if two black indicators are adjacent to each other, there is no demarcation between the two indicators. Alternatively, the fingerboard 208*b* could be modified to include such demarcations.

FIG. 8*c* is a top plan view of a violin having a fingerboard 308*b*, a body 1', a head 2', and four strings (4'G3, 4'D4, 4'A5, and 4'E54) stretched over the fingerboard 308*b*. In FIG. 8*c*, the first, third, fourth, sixth, eighth, ninth, and eleventh indicators are white; and the second, fifth, seventh, tenth, and twelfth indicators are black. The fingerboard 308*b* in FIG. 8c is derived from the fingerboard 308*a* in FIGS. 8*a* and 8*b*. Fingerboard 308*b* is produced if the rectangular areas of the fingerboard 308*a* corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F4, F5, F6, F7, and F7), and the pitch G (G4, G5, G6, and G7) are colored white and if the rectangular areas of the fingerboard 308*a* corresponding to the pitch $A_\sharp$ ($A_\sharp4$, $A_\sharp5$, $A_\sharp6$, and $A_\sharp7$), the pitch $C_\sharp$ ($C_\sharp4$, $C_\sharp5$, $C_\sharp6$, and $C_\sharp7$), the pitch $D_\sharp$ ($D_\sharp4$, $D_\sharp5$, $D_\sharp6$, and $D_\sharp7$), the pitch $F_\sharp$ ($F_\sharp4$, $F_\sharp5$, $F_\sharp6$, and $F_\sharp7$), and the pitch $G_\sharp$ ($G_\sharp3$, $G_\sharp4$, $G_\sharp5$, $G_\sharp6$, and $G_\sharp7$) are colored black. In FIG. 8*c*, if two white indicators in the same row are adjacent to each other, there is no demarcation between the two indicators; and if two black indicators in the same row are adjacent to each other, there is no demarcation between the two indicators. Alternatively, the fingerboard 308*b* could be modified to include such demarcations.

FIG. 9*b* is a top plan view of the fingerboard 8 of a six-string guitar with twenty-four frets (7A" through 7X"). In FIG. 9*b*, the first, third, fourth, sixth, eighth, ninth, and eleventh indicators are white; and the second, fifth, seventh, tenth, and twelfth indicators are black. The twenty-four frets (7A" through 7X") in FIG. 9*b* are derived from the twenty-four frets (7A' through 7X', respectively) in FIG. 9*a*. Frets 7A" through 7X" are produced if the rectangular areas of the frets 7A' through 7X' corresponding to the pitch A (A3, A4, A5, and A6), the pitch B (B3, B4, B5, and B6), the pitch C (C3, C4, C5, and C6, the pitch D (D3, D4, D5, and D6), the pitch E (E3, E4, E5, and E6), the pitch F (F2, F3, F4, and F5), and the pitch G (G2, G3, G4, and G5) are colored white and if the rectangular areas of the frets 7A' through 7X' corresponding to the pitch $A_\sharp$ ($A_\sharp3$, $A_\sharp4$, $A_\sharp5$, and $A_\sharp6$), the pitch $C_\sharp$ ($C_\sharp3$, $C_\sharp4$, $C_\sharp5$, and $C_\sharp6$), the pitch $D_\sharp$ ($D_\sharp3$, $D_\sharp4$, $D_\sharp5$, and $D_\sharp6$), the pitch $F_\sharp$ ($F_\sharp2$, $F_\sharp3$, $F_\sharp4$, and $F_\sharp5$), and the pitch $G_\sharp$ ($G_\sharp2$, $G_\sharp3$, $G_\sharp4$, and $G_\sharp5$) are colored black. In FIG. 9*b*, if two white indicators are adjacent to each other, there is no demarcation between the two indicators; and if two black indicators are adjacent to each other, there is no demarcation between the two-indicators. Alternatively, the frets 7A" through 7X" could be modified to include such demarcations.

FIG. 10*b* is a top plan view of the six strings (104'E2, 104'A3, 104'D3, 104'G3, 104'B4, and 104'E4) of a guitar. When the sixth string 104'E2 is used on a six-string guitar, the generally rectangular region 5'E2 on the sixth string 104'E2 should be generally positioned on top of the nut 5'; and the twenty-four generally rectangular regions 7A'E2 through 7X'E2 should be positioned above the frets 7A through 7X, respectively. When the fifth string 104'A3 is used on a six-string guitar, the generally rectangular region 5'A3 on the fifth string 104'A3 should be generally positioned on top of the nut 5'; and the twenty-four generally rectangular regions 7A'A3 through 7X'A3 should be positioned above the frets 7A through 7X, respectively. When the fourth string 104'D3 is used on a six-string guitar, the generally rectangular region 5'D3 on the fourth string 104'D3 should be generally positioned on top of the nut 5'; and the twenty-four generally rectangular regions 7A'D3 through 7X'D3 should be positioned above the frets 7A through 7X, respectively. When the third string 104'G3 is used on a six-string guitar, the generally rectangular region 5'G3 on the third string 104'G3 should be generally positioned on tap of the nut 5'; and the twenty-four generally rectangular regions 7A'G3 through 7X'G3 should be positioned above the frets 7A through 7X, respectively. When the second string 104'B4 is used on a six-string guitar, the generally rectangular region 5'B4 on the second string 104'B4 should be generally positioned on top of the nut 5'; and the twenty-four generally rectangular regions 7A'B4 through 7X'B4 should be positioned above the frets 7A through 7X, respectively. When the first string 104'E4 is used on a six-string guitar, the generally rectangular region 5'E4 on the first string 104'E4 should be generally positioned on top of the nut 5'; and the twenty-four generally rectangular regions 7A'E4 through 7X'E4 should be positioned above the frets 7A through 7X, respectively. In FIG. 10*b*, the first, third, fourth, sixth, eighth, ninth, and eleventh indicators are white; and the second, fifth, seventh, tenth, and twelfth indicators are black. The strings 104'E2, 104'A3, 104'D3, 104'G3, 104'B4, and 104'E4 in FIG. 10*b* are derived from the strings 104E2, 104A3, 104D3, 104G3, 104B4, and 104E4, respectively, in FIG. 10*a*. Strings 104'E2, 104'A3, 104'D3, 104'G3, 104'B4, and 104'E4 are produced if the rectangular areas of the strings 104E2, 104A3, 104D3, 104G3, 104B4, and 104E4 corresponding to the pitch A (A3, A4, A5, and A6), the pitch B (B3, B4, B5, and B6), the pitch C (C3, C4, C5, and C6), the pitch D (D3, D4, D5, and D6), the pitch E (E3, E4, E5, and E6), the pitch F (F2, F3, F4, F5, and F6), and the pitch G (G2, G3, G4, and G5) are colored white and if the rectangular areas of the strings 104E2, 104A3, 104D3, 104G3, 104B4, and 104E4 corresponding to the pitch $A_\sharp$ ($A_\sharp3$, $A_\sharp4$, $A_\sharp5$, and $A_\sharp6$), the pitch $C_\sharp$ ($C_\sharp3$, $C_\sharp4$, $C_\sharp5$, and $C_\sharp6$), the pitch $D_\sharp$ ($D_\sharp3$, $D_\sharp4$, $D_\sharp5$, and $D_\sharp6$, the pitch $F_\sharp$ ($F_\sharp2$, $F_\sharp3$, $F_\sharp4$, and $F_\sharp5$), and the pitch $G_\sharp$ ($G_\sharp2$, $G_\sharp3$, $G_\sharp4$, and $G_\sharp5$) are colored black.

FIG. 11*b* is a top plan view of the four strings (104'''G3, 1041'''D4 104'''A5, and 104'''E5) of a violin. When the fourth string 104'''G3 is used on a violin, the generally rectangular region 5'''G3 on the fourth string 104'''G3 should be generally positioned on top of the nut 5'. When the third string 104'''D4 is used on a violin, the generally rectangular region 5'''D4 on the third string 104'''D4 should be generally positioned on top of the nut 5'. When the second string 104'''A5 is used on a violin, the generally rectangular region 5'''A5 on the second string 104'''A5 should be generally positioned on top of the nut 5'. When the first string 104'''E5 is used on a violin, the generally rectangular region 5'''E5 on the first string 104'''E5 should be generally positioned on top of the nut 5'. In FIG. 11*b*, the first, third, fourth, sixth, eighth, ninth, and eleventh indicators are white; and the second, fifth, seventh, tenth, and twelfth indicators are black. The strings 104'''G3, 104'''D4, 104'''A5, and 104'''E5 in FIG. 11*b* are derived from the strings 104"G3, 104"D4, 104"A5, and 104"E5, respectively, in FIG. 11*a*. Strings 104'''G3, 104'''D4, 104'''A5, and 104'''E5 are produced if the rectangular areas of the strings 104"G3, 104"D4, 104"A5, and 104"E5 corresponding to the pitch A (A4, A5, A6, and A7), the pitch B (B4, B5, B6, and B7), the pitch C (C4, C5, C6, and C7), the pitch D (D4, D5, D6, and D7), the pitch E (E4, E5, E6, and E7), the pitch F (F4, F5, F5, F6, and F7), and the pitch G (G4, G5, G6, and G7) are colored white and if the rectangular areas of the strings 104"G3, 104"D4, 104"A5, and 104"E5 corresponding to the pitch $A_\sharp$ ($A_\sharp4$, $A_\sharp5$, $A_\sharp6$, and $A_\sharp7$), the pitch $C_\sharp$ ($C_\sharp4$, $C_\sharp5$, $C_\sharp6$, and $C_\sharp7$), the pitch $D_\sharp$ ($D_\sharp4$, $D_\sharp5$, $D_\sharp6$, and $D_\sharp7$), the pitch $F_\sharp$ ($F_\sharp4$, $F_\sharp5$, $F_\sharp6$, and $F_\sharp7$), and the pitch $G_\sharp$ ($G_\sharp3$, $G_\sharp4$, $G_\sharp5$, $G_\sharp6$, and $G_\sharp7$) are colored black. In FIG. 11*b*, if two white indicators are adjacent to each other on the same string, there is a demarcation between the two indicators. Alternatively, the strings 104'''G3, 104'''D4, 104'''A5, and 104'''E5 could be modified to exclude such demarcations.

In FIG. 12, the first, third, fourth, sixth, eighth, ninth, and eleventh indicators on the binding 109 are white; and the second, fifth, seventh, tenth, and twelfth indicators on the binding 109 are black. The binding 109 is produced if the rectangular areas of the binding 109 corresponding to the pitch A (A3, and A4), the pitch B (B3, and B4), the pitch C (C3 and C4), the pitch D (D3 and D4), the pitch E (E3 and E4), the pitch F (F2, F3, and F4), and the pitch G (G2, and G3) are colored white and if the rectangular areas of the binding 109 corresponding to the pitch $A_\sharp$ ($A_\sharp3$ and $A_\sharp4$), the pitch $C_\sharp$ ($C_\sharp3$ and $C_\sharp4$), the pitch $D_\sharp$ ($D_\sharp3$ and $D_\sharp4$), the pitch $F_\sharp$ ($F_\sharp2$ and $F_\sharp3$), and the pitch $G_\sharp$ ($G_\sharp3$ and $G_\sharp4$) are colored black. In FIG. 12, if two white indicators are adjacent to each other, there is a demarcation between the two indicators. Alternatively, the binding 109 could be modified to exclude such demarcations.

In FIGS. 6*b*, 6*c*, 7*b*, 8*c*, 9*b*, 10*b*, 11*b*, and 12, the logic of the piano keyboard is used for fretted and unfretted stringed instruments. In these figures, all of indicators for the pitches A, B, C, D, E, F, and G are white; and all of the indicators for the pitches $A_\sharp$, $C_\sharp$, $D_\sharp$, $F_\sharp$, and $G_\sharp$ are black. Thus, a repeating black-and-white pattern is formed. If one follows the 12-tone chromatic scale from A up to $G_\sharp$, the pattern is: white, black, white, white, black, white, black, white, white, black, white, and black. This pattern repeats whenever the chromatic scale repeats. Portions of this pattern repeat whenever portions of the chromatic scale repeat.

Alternatively, all of the indicators for the pitches A, B, C, D, E, F, and G may be black; and all of the indicators for the pitches $A_\sharp$, $C_\sharp$, $D_\sharp$, $F_\sharp$, and $G_\sharp$ may be white. Of course, other indicators can be used instead of the colors black and white. For example, the indicators for the pitches A, B, C, D, E, F, and G may be tan; and the indicators for the pitches $A_\sharp$, $C_\sharp$, $D_\sharp$, $F_\sharp$, and $G_\sharp$ may be dark brown. In another alternative, the indicators for the pitches A, B, C, D, E, F, and G may be squares; and the indicators for the pitches $A_\sharp$, $C_\sharp$, $D_\sharp$, $F_\sharp$, and $G_\sharp$ may be triangles. In another alternative, the indicators for the pitches A, B, C, D, E, F, and G may be smooth surfaces; and the indicators for the pitches $A_\sharp$, $C_\sharp$, $D_\sharp$, $F_\sharp$, and $G_\sharp$ may be rough surfaces. In another alternative, the indicators for the pitches A, B, C, D, E, F, and G may be lighted surfaces; and the indicators for the pitches $A_\sharp$, $C_\sharp$, $D_\sharp$, $F_\sharp$, and $G_\sharp$ may be unlighted surfaces. In another alternative, the indicators for the pitches A, B, C, D, E, F, and G may be small squares; and the indicators for the pitches $A_\sharp$, $C_\sharp$, $D_\sharp$, $F_\sharp$, and $G_\sharp$ may be larger squares.

One method of making a fingerboard 108*b* as shown in FIGS. 6*b* and 6*c* is illustrated in FIG. 13. The method comprises: (1) providing a flat surface (e.g., the top 30 of the neck 3); (2) gluing the nut 5 to the flat surface; (3) gluing the tiles 907A, 917A, and 927A to the nut and to the top of the flat surface; gluing the first fret 7A to the tiles 907A, 917A, and 927A and to the flat surface; (4) gluing the tiles 907B, 917B, and 927B to the first fret 7A and to the flat surface; (5) gluing the second fret 7B to the tiles 907B, 917B, and 927B and to the flat surface; (6) gluing the tiles 907C, 917C, and 927C to the second fret 7B and to the flat surface; (7) gluing the third fret 7C to the tiles 907C, 917C, and 927C and to the flat surface; (8) gluing the tiles 907D, 917D, and 927D to the third fret 7C and to the flat surface; (9) gluing the fourth fret 7D to the tiles 907D, 917D, and 927D and to the flat surface; and (10) repeating the foregoing process of gluing frets and tiles until all of the frets and tiles are glued to the flat surface. In order to ensure that the frets and tiles are glued to the flat surface and to each other, pressure clamps should be used to apply pressure in three orthogonal directions: perpendicularly to the assembled fingerboard 108*b*; (2) longitudinally to the assembled fingerboard 108*b*; and (3) laterally to the assembled fingerboard 108*b*.

In FIGS. 6*c* and 13, tile 907A comprises the ninth indicator; tile 917A comprises the second, seventh, and twelfth indicators; tile 927A comprises the fourth and ninth indicators; tile 907B comprises the tenth indicator; tile 917B comprises the third, eighth, and first indicators; tile 927B comprises the fifth and tenth indicators; tile 907C comprises the eleventh, fourth, and ninth indicators; tile 917C comprises the second indicator; tile 927C comprises the sixth and eleventh indicators; tile 907D comprises the twelfth, fifth, and tenth indicators; tile 917D comprises the third indicator; and tile 927D comprises the seventh and twelfth indicators. In FIGS. 6*c* and 13, the first, third, fourth, sixth, eighth, ninth, and eleventh indicators are white, and the second, fifth, seventh, tenth, and twelfth indicators are black. The white tiles 907A, 927A, 917B, 907C, 927C, and 917D may be made of a light-colored wood such as maple; and the black tiles 917A, 907B, 927B, 917C, 907D, and 927D may be made of a dark-colored wood such as ebony. The wood may be bleached to provide whiter tiles or stained to provide blacker tiles. Of course, the tiles may be made of any other suitable material, including, but not necessarily limited to: wood (e.g., maple, oak, pine, rosewood, and birch), metal, ivory, plastic, ceramics, rubber, textiles, and glass.

Another method of making the fingerboard 108*b* as shown in FIGS. 6*b* and 6*c* comprises: (1) providing a flat piece of light-colored wood (such as maple); (2) routing out recesses for receiving the dark-colored tiles 917A, 907B, 927B, 917C, 907D, and 927D; (3) gluing the contrasting tiles into the corresponding recesses; (4) routing out recesses for receiving the frets; and (5) gluing the frets into the recesses for the frets so that the finished fingerboard 108*b* appears as in FIG. 6*c*.

According to the foregoing methods, the indicators are an integral part of the fingerboard 108*b*. Alternatively, the indicators can be applied to the surface of a fingerboard. For example, decals or paint could be applied to the fingerboard. One such method involving painting comprises: (1) providing a fingerboard 8 or 8'; (2) painting the entire fingerboard white; (3) allowing the white paint to dry; and (4) painting the second, fifth, seventh, tenth, and twelfth indicators black. One method involving decals comprises: (1) providing a fingerboard 8 or 8' with a light-colored or white surface; (2) cutting out dark-colored (e.g., black) decals for the second, fifth, seventh, tenth, and twelfth indicators; and (3) applying the dark-colored decals to the appropriate parts of the fingerboard. If two or more adjacent indicators are the same, the decals for these indicators can be integrally connected to each other and need not be cut apart. Alternatively, for each area between adjacent frets, a single decal can be applied, the decal optionally having end portions to cover the binding, the decal being a single integrated piece with all of the indicators needed to label some or all of the notes that are produced when the string is plucked while being held down against the decal-covered fingerboard. For the fingerboard 108*b* of a six-string guitar, the resulting black-and-white pattern is shown in FIG. 6*c*. For the fingerboard 208*b* of a four-string bass guitar, the resulting black-and-white pattern is shown in FIG. 7*b*. For the fingerboard 308*b* of a violin, the resulting black-and-white pattern is shown in FIG. 8*c*.

Alternatively, the fingerboard could be made of a stainable wood; and the fingerboard of the present invention could be stained different colors for the different indicators. For example, one such method involving staining comprises: (1) providing a wooden fingerboard 8 or 8'; (2) bleaching or staining the entire fingerboard white; and (3) staining the second, fifth, seventh, tenth, and twelfth indicators black.

The indicators can be applied to the frets by staining or painting the frets. The indicators can be applied to the binding by staining or painting the binding. The indicators can be applied to the strings by staining or painting the strings. Alternatively, decals can be applied to the frets and the binding.

The present invention can be used with fretted and unfretted musical instruments having a fingerboard with one or more strings stretched over the fingerboard. Such instruments include, but are not necessarily limited to: a guitar, a 12-string guitar, an electric guitar, an electric bass guitar, an acoustic guitar, a lap steel, a pedal steel, or a leg steel, a bass guitar, a violin, a viola, a cello, a double bass, a banjo, a dobro, a lute, a mandolin, and a ukulele. The present invention facilitates playing of such stringed instruments because the player can more readily see or feel the finger positions to play specific notes. The present invention also provides the player with new musical insights, which become apparent because the logic of a piano keyboard has been adapted for use with stringed instruments. For a lap steel and pedal steel guitars, the indicators indicate where to place a metal slide to produce the indicated pitches.

The invention illustratively disclosed herein suitably may be practiced in the absence of any element which is not specifically disclosed herein. Thus, the invention may comprise, consist of, or consist essentially of the elements disclosed herein.

Although the present invention has been described in considerable detail with reference to certain preferred embodiments, the specification also lists many other embodiments. Therefore, the spirit and the scope of the appended claims should not be limited to the description of the preferred embodiments contained herein.

Furthermore, although a few exemplary embodiments of this invention have been described in detail above, those skilled in the art will readily appreciate that many modifications are possible, in the exemplary embodiments without materially departing from the novel teachings and advantages of this invention. Accordingly, all such modifications are intended to be included within the scope of this invention as defined in the followings claims. In the claims, means-plus-function clauses are intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, a nail and a screw nevertheless may be equivalent structures in the environment of fastening wooden parts. Consequently, elements interchangeable with those specifically listed herein may also be employed and are intended to be covered in the following claims.

What is claimed is:

1. Indicators for a portion of a fretted stringed musical instrument having a fingerboard and one or more strings stretched above the fingerboard's pattern of indicators for generating specific pitches corresponding to specific notes of a chromatic scale, the indicators comprising:

(1) one first indicator for one string or more than one first indicator for one or more strings, each first indicator being associated with one string, each first indicator indicating where the associated string should be held down against the fingerboard indicator to produce the pitch A when the string is plucked or bowed;

(2) one second indicator for one string or more than one second indicator for one or more strings, each second indicator being associated with one string, each second indicator indicating where the associated string should be held down against the fingerboard indicator to produce the pitch A♯ when the string is plucked or bowed;

(3) one third indicator for one string or more than one third indicator for one or more strings, each third indicator being associated with one string, each third indicator indicating where the associated string should be held down against the fingerboard indicator to produce the pitch B when the string is plucked or bowed;

(4) one fourth indicator for one string or more than one fourth indicator for one or more strings, each fourth indicator being associated with one string, each fourth indicator indicating where the associated string should be held down against the fingerboard indicator to produce the pitch C when the string is plucked or bowed;

(5) one fifth indicator for one string or more than one fifth indicator for one or more strings, each fifth indicator being associated with one string, each fifth indicator indicating where the associated string should be held down against the fingerboard indicator to produce the pitch C♯ when the string is plucked or bowed;

(6) one sixth indicator for one string or more than one sixth indicator for one or more strings, each sixth indicator being associated with one string, each sixth indicator indicating where the associated string should be held down against the fingerboard indicator to produce the pitch D when the string is plucked or bowed;

(7) one seventh indicator for one string or more than one seventh indicator for one or more strings, each seventh indicator being associated with one string, each seventh indicator indicating where the associated string should be held down against the fingerboard indicator to produce the pitch D♯ when the string is plucked or bowed;

(8) one eighth indicator for one string or more than one eighth indicator for one or more strings, each eighth indicator being associated with one string, each eighth indicator indicating where the associated string should be held down against the fingerboard indicator to produce the pitch E when the string is plucked or bowed;

(9) one ninth indicator for one string or more than one ninth indicator for one or more strings, each ninth indicator being associated with one string, each ninth indicator indicating where the associated string should be held down against the fingerboard indicator to produce the pitch F when the string is plucked or bowed;

(10) one tenth indicator for one string or more than one tenth indicator for one or more strings, each tenth indicator being associated with one string, each tenth indicator indicating where the associated string should be held down against the fingerboard indicator to produce the pitch F♯ when the string is plucked or bowed;

(11) one eleventh indicator for one string or more than one eleventh indicator for one or more strings, each eleventh indicator being associated with one string, each eleventh indicator indicating where the associated string should be held down against the fingerboard indicator to produce the pitch G when the string is plucked or bowed;

(12) one twelfth indicator for one string or more than one twelfth indicator for one or more strings, each twelfth indicator being associated with one string, each twelfth indicator indicating where the associated string should be held down against the fingerboard indicator to produce the pitch G♯ when the string is plucked or bowed;

wherein at least the first through twelfth indicators are disposed on the fingerboard substantially underlying the strings but not on the frets.

2. The indicators as claimed in claim 1, wherein the fingerboard is connected to a neck and the indicators are on the neck of the instrument.

3. The indicators as claimed in claim 1, wherein the indicators are on at least one string of the instrument.

4. The indicators as claimed in claim 1, wherein the fingerboard is connected to a neck with a binding and the indicators are on the binding.

5. The indicators as claimed in claim 1, wherein the instrument has frets.

6. The indicators as claimed in claim 1, wherein the string that is held down against the fingerboard to produce one pitch touches the indicator corresponding to that pitch when the string is held down against the fingerboard.

7. The indicators as claimed in claim 1, wherein the indicators are on the fingerboard of the instrument.

8. The indicators as claimed in claim 5, wherein the string that is held down against the fingerboard to produce one pitch touches the indicator corresponding to that pitch when the string is held down against the fingerboard.

9. The indicators as claimed in claim 1, wherein the instrument is fretted.

10. The indicators as claimed in claim 1, wherein the instrument is a guitar.

11. The indicators as claimed in claim 1, wherein the instrument is unfretted.

12. The indicators as claimed in claim 1, wherein the instrument is a violin.

13. The indicators as claimed in claim 1, wherein the instrument is a viola, a cello, a double bass, a banjo, a dobro, a lute, a mandolin, or a ukulele.

14. The indicators as claimed in claim 1, wherein the first, second, third, fourth, fifth, sixth, seventh, eighth, ninth, tenth, eleventh, and twelfth indicators are different from each other.

15. The indicators as claimed in claim 1, wherein the first, second, third, fourth, fifth, sixth, seventh, eighth, ninth, tenth, eleventh, and twelfth indicators are each a different color.

16. The indicators as claimed in claim 1, wherein the first indicator is "A", the second indicator is "A♯", the third indicator is "B", the fourth indicator is "C". the fifth indicator is "C♯", the sixth indicator is "D", the seventh indicator is "D♯", the eighth indicator is "E", the ninth indicator is "F", the tenth indicator is "F♯", the eleventh indicator is "G", and the twelfth indicator is "G♯".

17. The indicators as claimed in claim 1, wherein the first, second, third, fourth, fifth, sixth, seventh, eighth, ninth, tenth, eleventh, and twelfth indicators are each a different shape.

18. The indicators as claimed in claim 1, wherein the first, third, fourth, sixth, eighth, ninth, and eleventh indicators are different from each other and different from the second, fifth, seventh, tenth, and twelfth indicators; and the second, fifth, seventh, tenth, and twelfth indicators are not different from each other.

19. The indicators as claimed in claim 1, wherein the first indicator is "A", the third indicator is "B", the fourth indicator is "C", the sixth indicator is "D", the eighth indicator is "E", the ninth indicator is "F", the eleventh indicator is "G", and the second, fifth, seventh, tenth, and twelfth indicators are black.

20. The indicators as claimed in claim 1, wherein the first, third, fourth, sixth, eighth, ninth, and eleventh indicators are different from the second, fifth, seventh, tenth, and twelfth indicators; the first, third, fourth, sixth, eighth, ninth, and eleventh indicators are not different from each other; and the second, fifth, seventh, tenth, and twelfth indicators are not different from each other.

21. The indicators as claimed in claim 1, wherein the first, third, fourth, sixth, eighth, ninth, and eleventh indicators are white, and the second, fifth, seventh, tenth, and twelfth indicators are black.

22. The indicators as claimed in claim 1, wherein the first, third, fourth, sixth, eighth, ninth, and eleventh indicators are a color, and the second, fifth, seventh, tenth, and twelfth indicators are a different color.

23. The indicators as claimed in claim 1, wherein the first, third, fourth, sixth, eighth, ninth, and eleventh indicators are rectangles, and the second, fifth, seventh, tenth, and twelfth indicators are larger rectangles.

24. The indicators as claimed in claim 1, wherein the first, third, fourth, sixth, eighth, ninth, and eleventh indicators are smooth, and the second, fifth, seventh, tenth, and twelfth indicators are rough.

25. The indicators as claimed in claim 1, wherein the first, third, fourth, sixth, eighth, ninth, and eleventh indicators are hot, and the second, fifth, seventh, tenth, and twelfth indicators are cold.

26. The indicators as claimed in claim 1, wherein the indicators are decals, paint, stained wood, or tiles.

27. A stringed musical instrument having a fingerboard for use by a musician and at least one string disposed thereon vibrated by the musician, the instrument comprising:

first and second indicators representing notes repeated in a pattern corresponding to a chromatic scale;

wherein the pattern is disposed on the fingerboard but not on a fret;

wherein at least one string is disposed overlying the pattern; and wherein holding the string against one of the first or second indicators and vibrating the string generate a tone with a frequency corresponding to one of the notes of a chromatic scale.

28. The stringed musical instrument of claim 27, wherein the instrument includes twelve first and second indicators corresponding to twelve notes of the chromatic scale.

29. The stringed musical instrument of claim 27, wherein the notes of the chromatic scale include A, A♯, B, C, C♯, D, D♯, E, F, F♯, G, G♯.

30. The stringed musical instrument of claim 27, wherein the pattern includes the first indicator, the second indicator, the first indicator, the second indicator, the first indicator, the first indicator, the second indicator, the first indicator, the second indicator, the first indicator.

31. The stringed musical instrument of claim 27, wherein the pattern corresponds to at least an octave of black and white keys of a keyboard musical instrument.

32. The stringed musical instrument of claim 27, wherein the musical instrument includes a plurality of strings and a plurality of patterns with each string overlying each pattern.

33. A stringed musical instrument having a fingerboard and at least one string disposed thereon and fastened at opposite ends to permit vibration thereof by contact of a musician, the instrument comprising:

first and second indicators representing notes repeated in a pattern corresponding to a chromatic scale;

wherein the pattern is disposed on the fingerboard but not on a fret;

wherein the at least one string is disposed overlying the pattern;

wherein when the musician holds the string against the first indicator and vibrates the string, the string vibrates at a frequency corresponding to a first note of the chromatic scale; and wherein when the musician holds the string against the second indicator and vibrates the string, the string vibrates at a frequency corresponding to a second note of the chromatic scale.

34. A stringed musical instrument of claim 33, wherein the instrument includes six strings and six patterns wherein each string overlies each pattern.

* * * * *